US010760260B2

(12) United States Patent
Yin et al.

(10) Patent No.: US 10,760,260 B2
(45) Date of Patent: Sep. 1, 2020

(54) CONSTRUCTION METHOD FOR A BUILDING

(71) Applicant: RUENTEX ENGINEERING & CONSTRUCTION CO., LTD., Taipei (TW)

(72) Inventors: Samuel Yin, Taipei (TW); Kun-Jung Shu, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 132 days.

(21) Appl. No.: 15/892,627

(22) Filed: Feb. 9, 2018

(65) Prior Publication Data

US 2019/0119900 A1 Apr. 25, 2019

(30) Foreign Application Priority Data

Oct. 20, 2017 (TW) ..... 106136038 A

(51) Int. Cl.
*E04B 1/20* (2006.01)
*E04B 1/04* (2006.01)
(Continued)

(52) U.S. Cl.
CPC ..... *E04B 1/20* (2013.01); *E04B 1/04* (2013.01); *E04B 1/165* (2013.01); *E04B 5/28* (2013.01);
(Continued)

(58) Field of Classification Search
CPC ... E04B 1/04; E04B 1/20; E04B 1/165; E04B 2103/02; E04B 1/35; E04B 5/43; E04B 5/44; E04C 5/0622; E04C 3/20
(Continued)

(56) References Cited

U.S. PATENT DOCUMENTS 938,458 A * 11/1909 Brockhausen ..... E04B 5/43 256/19
2,871,544 A * 2/1959 Youtz ..... E04B 1/35 249/23
(Continued)

FOREIGN PATENT DOCUMENTS

TW M242535 U 9/2004
TW I340781 B 7/2009

OTHER PUBLICATIONS

Taiwan Office Action with Search Report dated Nov. 14, 2018, by the Taiwan Intellectual Property Office in the counterpart Taiwan Application No. 106136038, 9 pages in Chinese.

*Primary Examiner* — Joshua J Michener
*Assistant Examiner* — James J Buckle, Jr.
(74) *Attorney, Agent, or Firm* — Juan Carlos A. Marquez; Marquez IP Law Office, PLLC

(57) ABSTRACT

A construction method for a building is provided that includes the steps of: hoisting and positioning a plurality of precast columns on at least a portion of a predetermined area of a construction site to form a precast column array having at least two spans along a first direction and one or more spans along a second direction substantially perpendicular to the first direction; positioning the pre-fabricated beam rebar assemblies between adjacent precast columns, positioning each of the precast slab panels on support potions on the precast columns, assembling the beam cage and pouring the concrete into the molds for the beam cage to accomplish the structure of a single story; and repeating the steps of constructing the above-mentioned precast column array until completion of the structure of all stories of the building.

25 Claims, 49 Drawing Sheets

(51) Int. Cl.

| | |
|---|---|
| ***E04C 5/06*** | (2006.01) |
| ***E04B 1/16*** | (2006.01) |
| ***E04B 5/43*** | (2006.01) |
| ***E04B 5/28*** | (2006.01) |
| ***E04B 5/29*** | (2006.01) |

(52) U.S. Cl.
CPC ..... *E04B 5/29* (2013.01); *E04B 5/43* (2013.01); *E04C 5/0609* (2013.01); *E04C 5/0622* (2013.01); *E04B 2103/02* (2013.01)

(58) Field of Classification Search
USPC ..... 52/745.13
See application file for complete search history.

(56) References Cited

U.S. PATENT DOCUMENTS 3,179,374 A * 4/1965 Walli ..... E04B 1/3511 254/109
3,354,593 A * 11/1967 Zukas ..... E04B 1/21 52/125.1
3,429,092 A * 2/1969 Hart ..... E04B 1/20 52/236.7
3,490,191 A * 1/1970 Ekblom ..... E04B 1/20 52/125.1
3,524,293 A * 8/1970 Leyten ..... E04B 1/161 249/19
3,613,325 A * 10/1971 Yee ..... E04B 1/20 52/236.8
4,081,935 A * 4/1978 Wise ..... E04B 1/21 52/236.8
5,161,340 A * 11/1992 Wetton ..... E04B 1/21 52/236.7
6,293,063 B2 * 9/2001 Van Doren ..... E04B 1/165 52/250
6,920,728 B2 * 7/2005 Powers ..... E04B 1/22 52/236.5
8,549,805 B2 * 10/2013 Kim ..... E04C 5/0645 52/253
8,671,634 B2 * 3/2014 Morcous ..... E04B 5/16 52/252
8,844,223 B2 * 9/2014 Zhong ..... E04B 1/161 52/259
9,371,648 B1 * 6/2016 Tikhovskiy ..... E04B 5/18
10,094,101 B1 * 10/2018 Jazzar ..... E04G 11/38
10,260,224 B1 * 4/2019 Jazzar ..... E04B 1/215
2012/0167501 A1 * 7/2012 Tikhovskiy ..... E04B 5/28 52/251
2019/0078314 A1 * 3/2019 Yin ..... E04B 1/20

* cited by examiner

CONSTRUCTION METHOD FOR A BUILDING

FIELD OF THE INVENTION

The present invention relates to a construction method for a building.

BACKGROUND OF THE INVENTION

The conventional method for constructing a building is normally conducted by constructing the structure of a single story occupying a predetermined construction area and repeating such a construction manner story by story from the lowest story to a predetermined highest story so as to complete the building on the construction site. Given the need to complete the construction work (including the construction of the structures of the beams, columns, and floors) of one story occupying the whole predetermined construction area according to the conventional method, the arrangements of the routes for the construction work such as hoisting the structure, shipping construction materials, or labor passageways are definitely complicated. Moreover, the route arrangements for the above-mentioned aspects will only become more complicated as the height of the construction work increases. Therefore, the conventional construction method is unable to facilitate faster construction.

In particular, given the huge scale of investment made in the high tech industry and the rapid pace of change in the market for high-tech goods, there is a need for fast construction of high-tech plants so that the further construction of interior clean rooms and the arrangements of the manufacturing machines can be expedited in order to meet or exceed the production timeline for fabrication of high-tech products such as chips. Obviously, the conventional construction method is unable to satisfy such requirements.

Given the above, it is desired to find a solution to speed up the construction work on high-tech plants.

SUMMARY OF THE INVENTION

An object of the invention is to provide a construction method for a building so that the routes for the construction work such as hoisting the structure, shipping construction materials, or labor passageways can be efficiently and reasonably arranged during construction.

Another object of invention is to provide a construction method for a building so that the building can be rapidly constructed on a construction site.

In one aspect of the invention, a method for constructing a building is provided. The method comprises the steps of: (a) hoisting and positioning a plurality of precast columns that are at least one story tall on at least one portion of a predetermined construction area on a construction site to form a precast column array having at least two spans along a first direction and having one or more spans along a second direction substantially perpendicular to the first direction; (b) from the lowest story of the plurality of precast columns, hoisting and positioning a plurality of pre-fabricated beam rebar assemblies so that each of the plurality of pre-fabricated beam rebar assemblies is positioned between each predetermined two adjacent precast columns; and further hoisting and positioning a plurality of precast slab panels so that each of the plurality of precast slab panels is positioned between each predetermined four adjacent precast columns, so as to complete a beam rebar cage between each predetermined two adjacent precast columns; (c) pouring concrete into the beam rebar cage between each predetermined two adjacent precast columns; (d) repeating step (b) to step (c) at a next story above until the construction work of step (b) to step (c) at the highest story of the plurality of the precast columns is completed, and then proceeding with step (e); (e) taking the precast columns positioned at the end of the first direction and along the second direction as the starting points of the span along the first direction to repeat step (a) to step (d) until the construction work of the precast columns and the precast slab panels occupying the whole predetermined construction area is completed.

In another aspect of the invention, a method for constructing a building is provided. The method further comprises proceeding with step (f) after the completion of step (d), step (f) comprises jointing each of another plurality of precast columns to each of the plurality of precast columns to form a jointed precast column array, and each of the another plurality of precast columns has one or more stories; repeating step (b) to step (f) until the construction of predetermined stories of the building is completed, and then proceeding with step (e).

In a further aspect of the invention, a method for constructing a building is provided. The method comprises the steps of: (a) hoisting and positioning a plurality of first precast columns that are one story tall onto at least one portion of a predetermined construction area on a construction site to form a first precast column array having at least two spans along a first direction and having one or more spans along a second direction substantially perpendicular to the first direction; (b) hoisting and positioning a plurality of pre-fabricated beam rebar assemblies so that each of the plurality of pre-fabricated beam rebar assemblies is positioned between each predetermined two adjacent first precast columns; and further hoisting and positioning a plurality of precast slab panels so that each of the plurality of precast slab panels is positioned between each predetermined four adjacent first precast columns, and then completing a beam rebar cage between each predetermined two adjacent precast columns; (c) pouring concrete into molds surrounding the beam rebar cage to form a beam between each predetermined two adjacent first precast columns; (d) end-to-end jointing each of a plurality of second precast columns that are at least one story tall respectively to each of the plurality of the first precast columns of the first precast column array respectively, wherein the first precast columns of the first precast column array positioned along the second direction at the end of the first direction are not jointed with a second precast column, so as to form a second precast column array having one fewer spans than those of the first precast column array along the first direction and having one or more spans along the second direction; (e) proceeding with the following steps on the plurality of the second precast columns story by story from the lowest story to the highest story thereof: (i) hoisting and positioning a plurality of pre-fabricated beam rebar assemblies so that each of the plurality of pre-fabricated beam rebar assemblies is positioned between each predetermined two adjacent second precast columns; and further hoisting and positioning a plurality of precast slab panels so that each of the plurality of precast slab panels is positioned between each predetermined four adjacent second precast columns, and completing a beam rebar cage between each predetermined two adjacent second precast columns; (ii) pouring concrete into molds surrounding the beam rebar cage to form a beam between each predetermined two adjacent second precast columns; (iii) repeating step (i) to step (iii) until the construction work on the structure of the highest story of the plurality of the second precast columns is completed; (f) taking the first precast columns positioned at the end of the first direction and along the second direction as the starting points of the span along the first direction and then hoisting and positioning a plurality of first precast columns having one story to form a next first precast column array having at least one span along a first direction and having one or more spans along a second direction being substantially vertical to the first direction, and repeating step (b) to step (e) until all the first and second precast columns and the precast slab panels of the building are positioned.

In another further aspect of the invention, a method for constructing a building is provided. The method comprises proceeding with step (g) after the completion of step (e), step (g) comprises jointing each of another plurality of precast columns to each of the plurality of the second precast columns to form a jointed second precast column array, and each of the another plurality of precast columns has one or more stories; repeating step (e) to step (g) until the construction of predetermined stories of the building is completed, and then proceeding with step (f).

Other embodiments of the present invention and detailed advantageous features can be appreciated from the following Brief Description of the Drawings and Detailed Description.

DETAILED DESCRIPTION

Figure 1A:
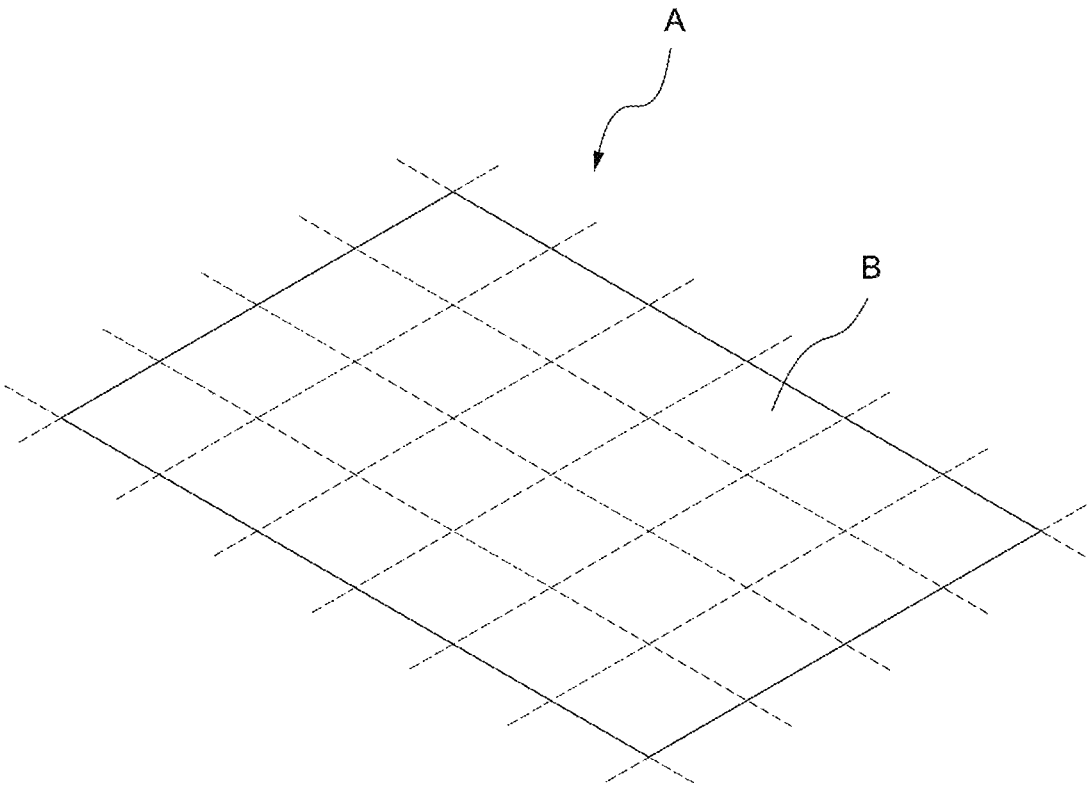
FIGS. 1*a* to 1*q* illustrate a construction method for constructing the structure of a building according to a preferred embodiment of the invention.

In order to facilitate understanding of the technical features, technical contents, technical advantages and technical effects of the subject invention, a detailed description with accompanying drawings is provided below for explanation only. The drawings only serve an auxiliary purpose for understanding of the technical contents; the scope of the subject invention should not be interpreted merely based on the scale or the relative positions between the elements illustrated in the drawings.

Figure 1B:
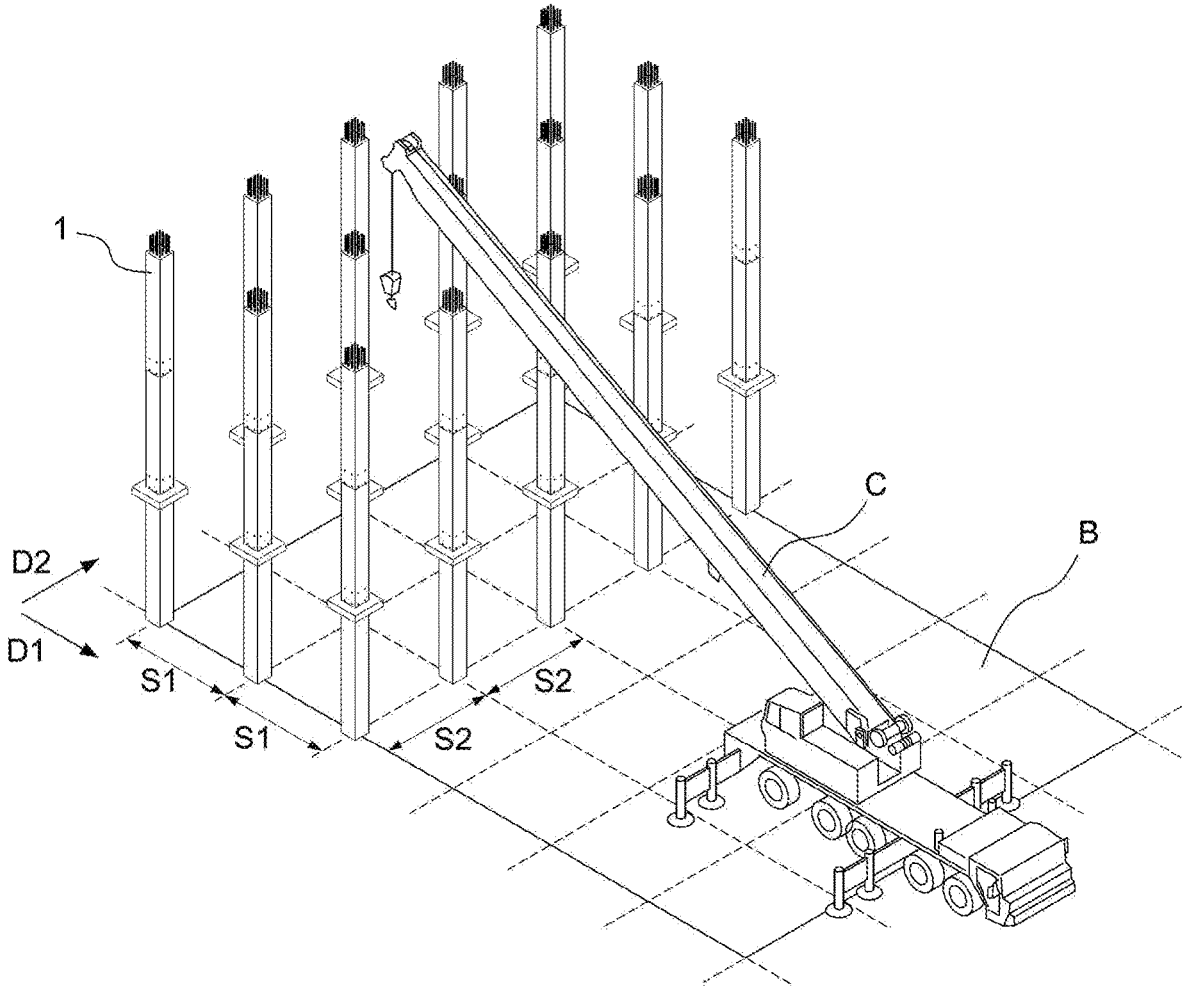
Figure 1C:
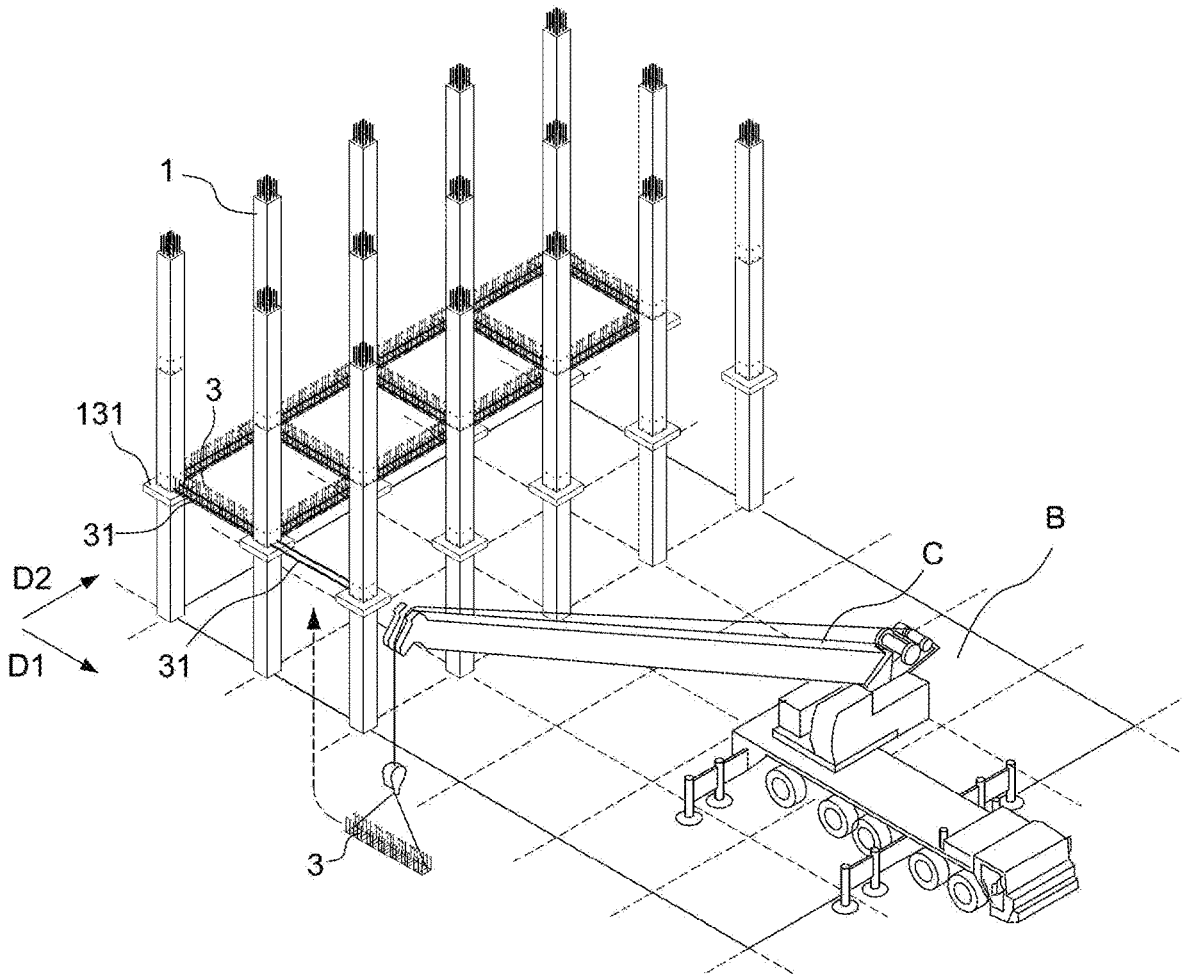
Figure 1D:
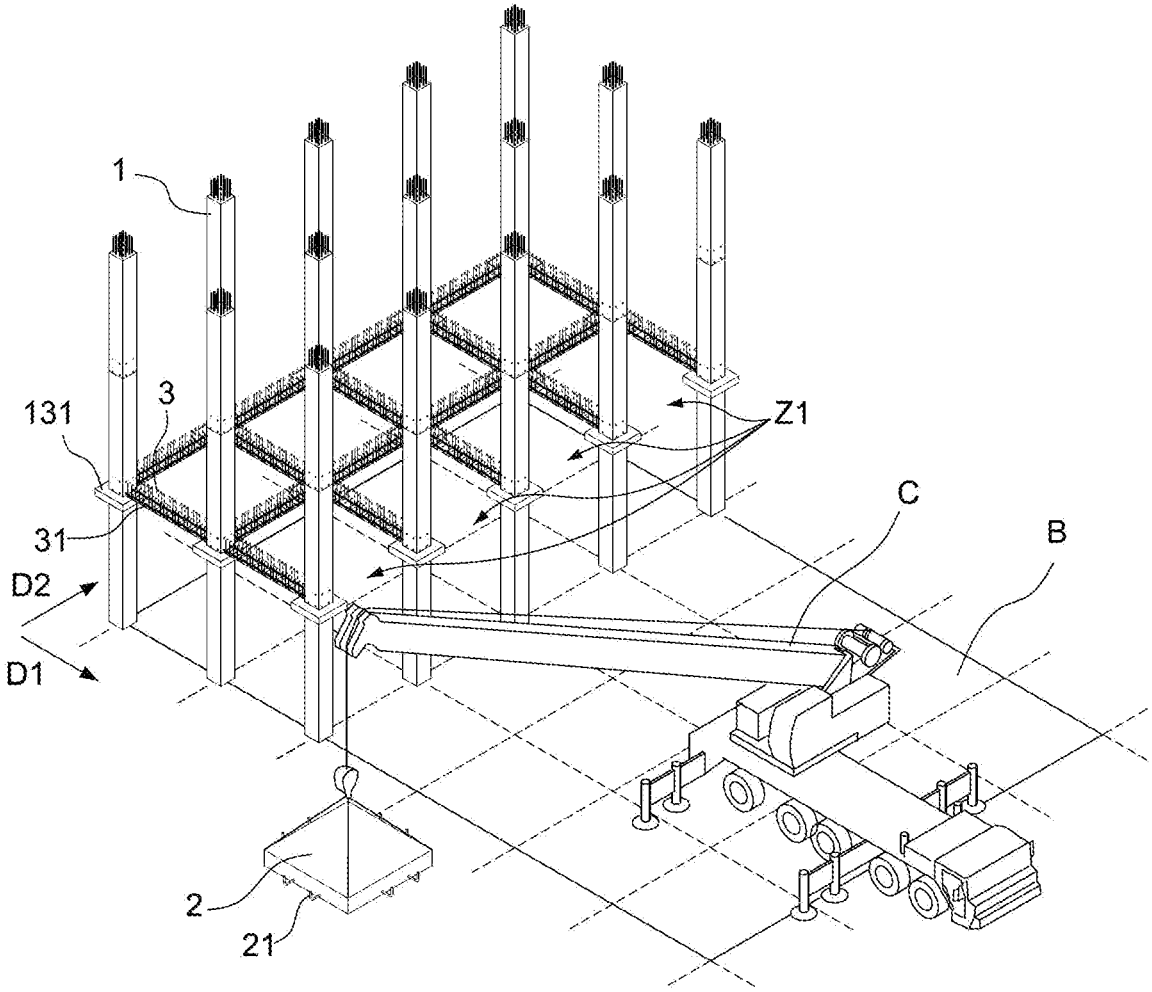
Figure 1E:
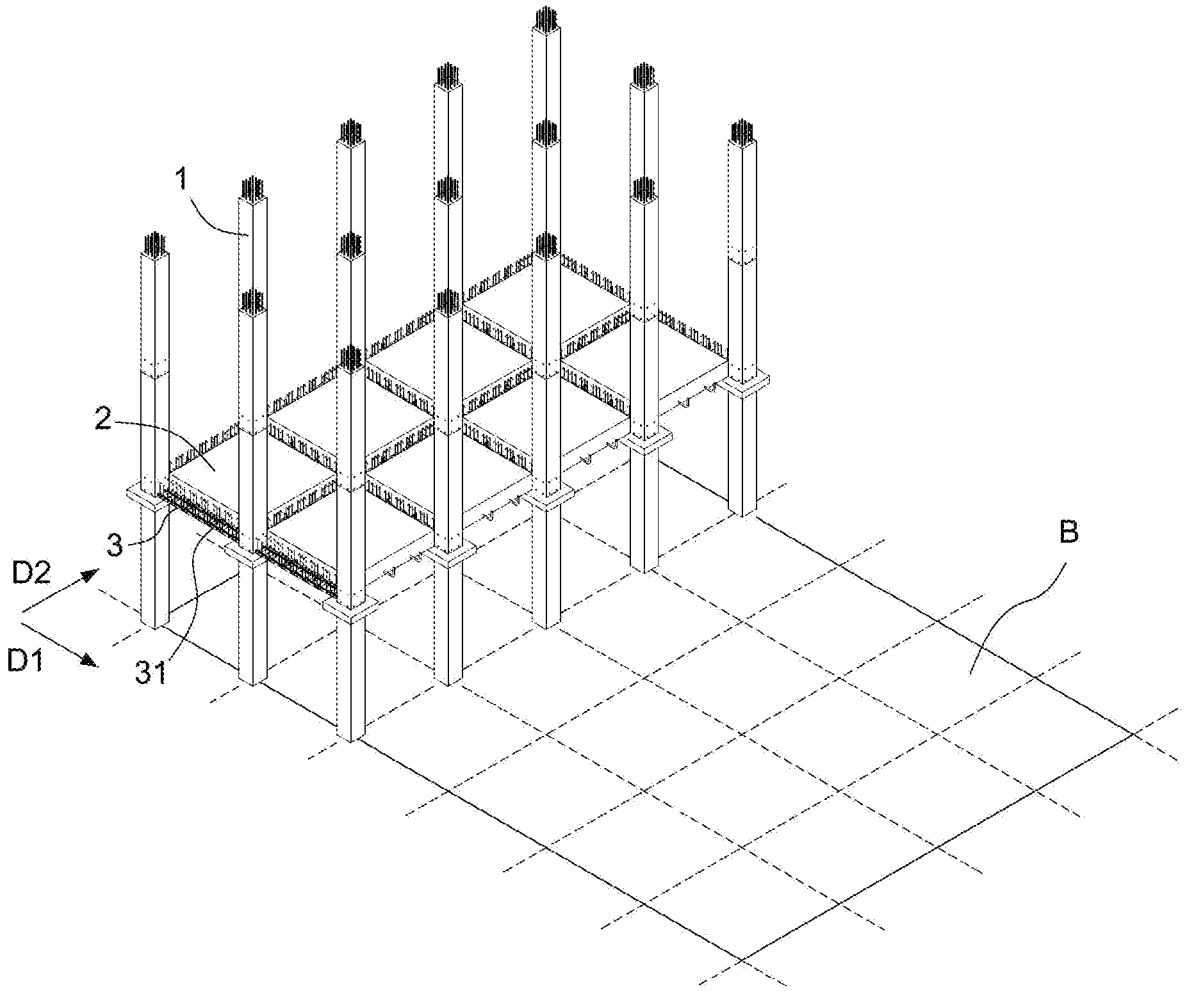
Figure 1F:
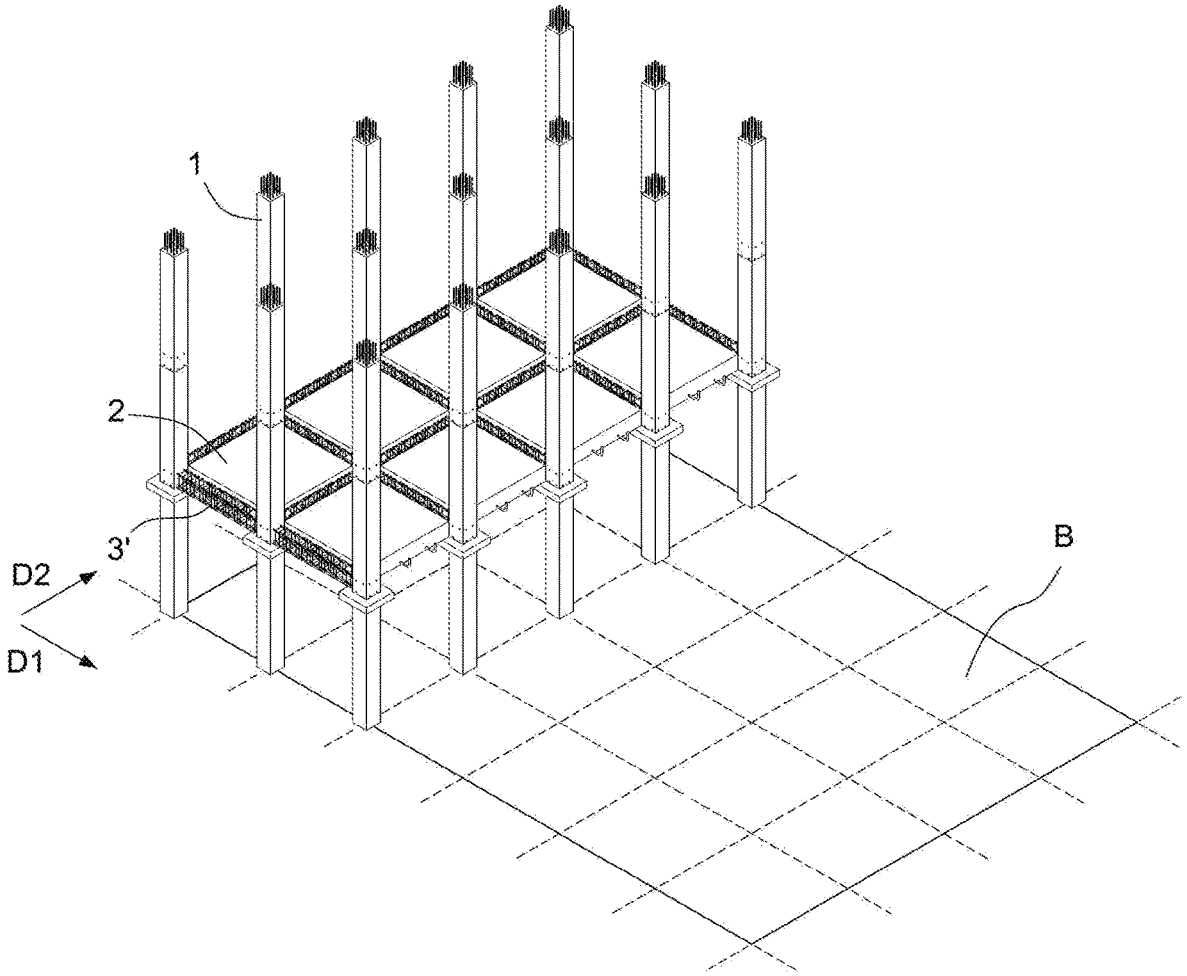
Figure 1G:
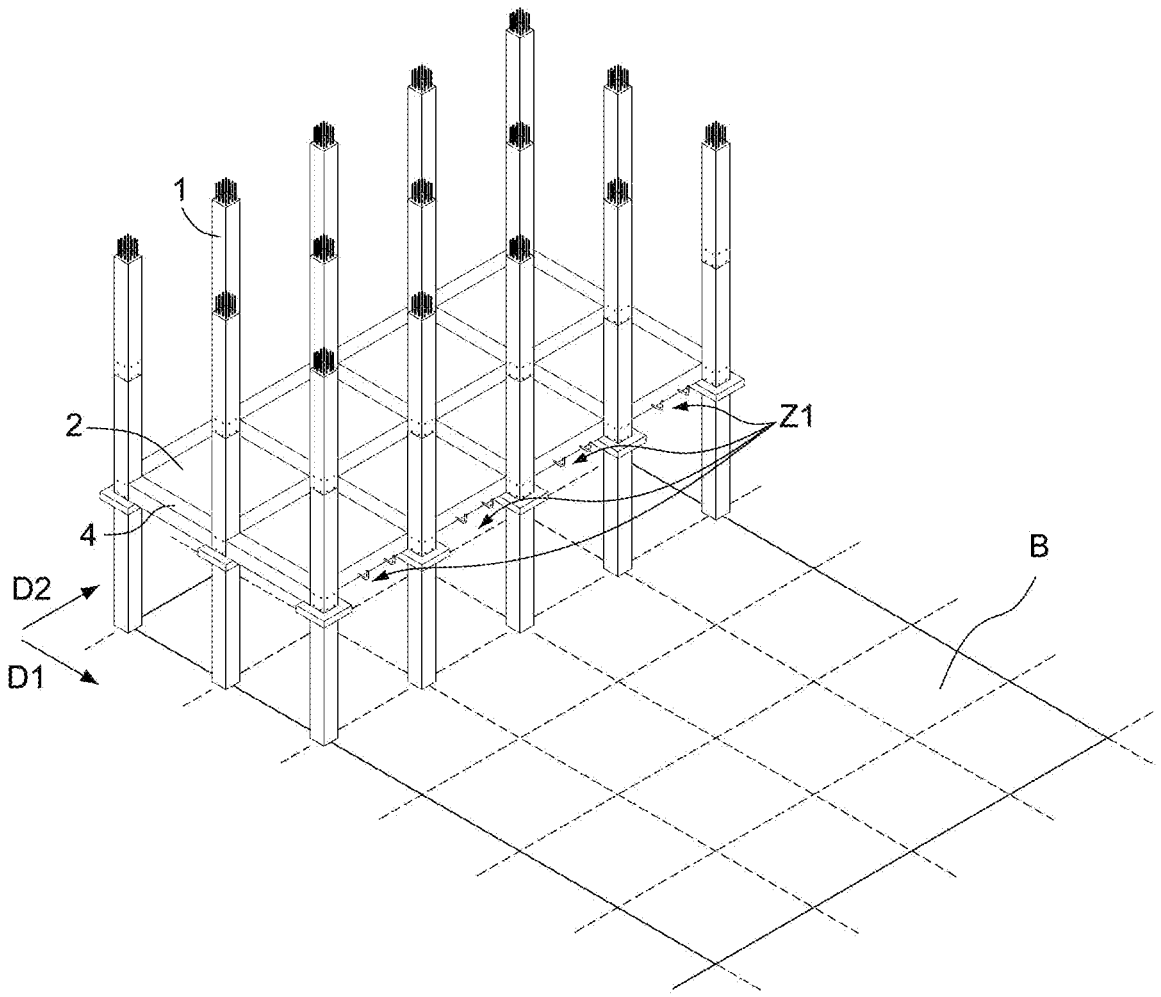
Figure 1H:
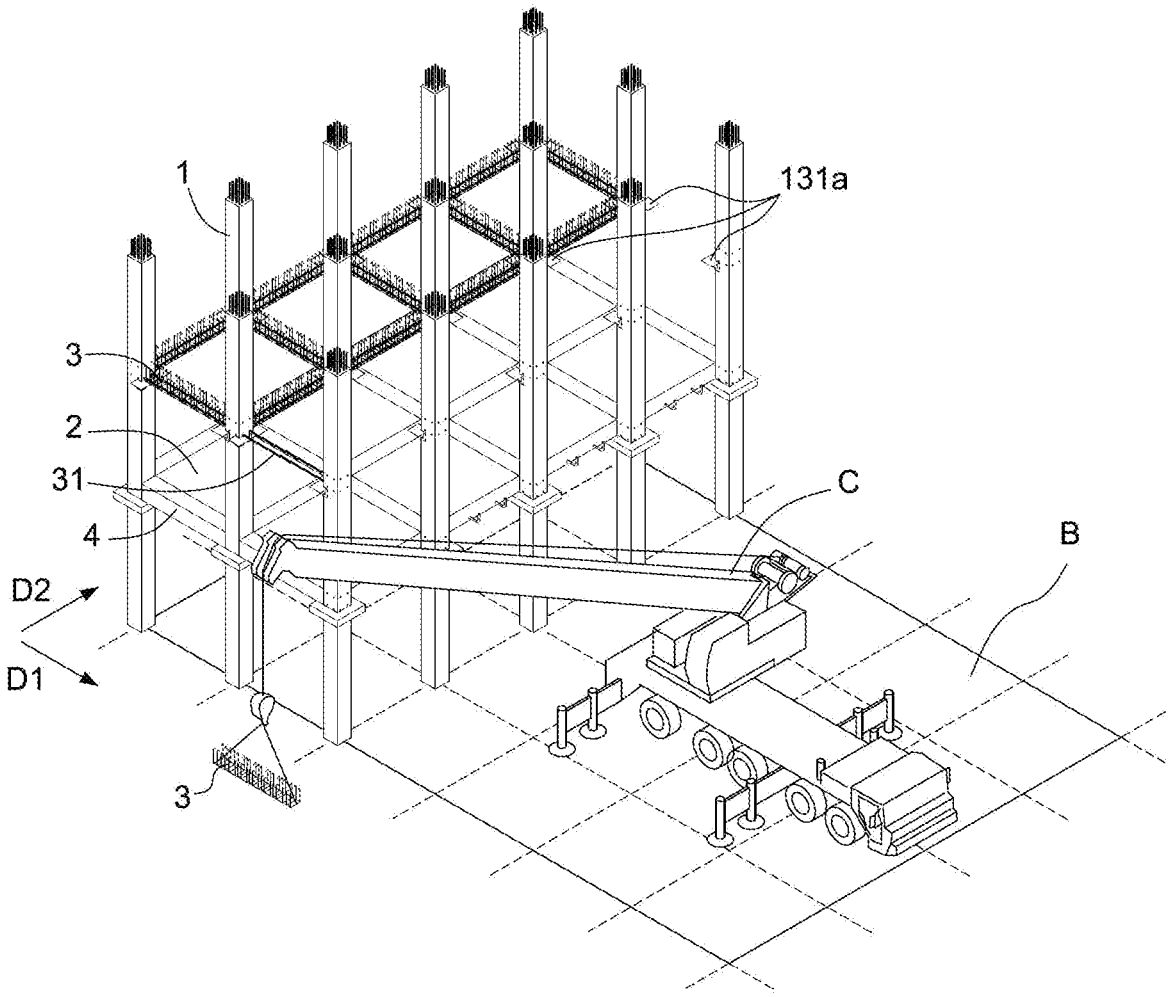
Figure 1I:
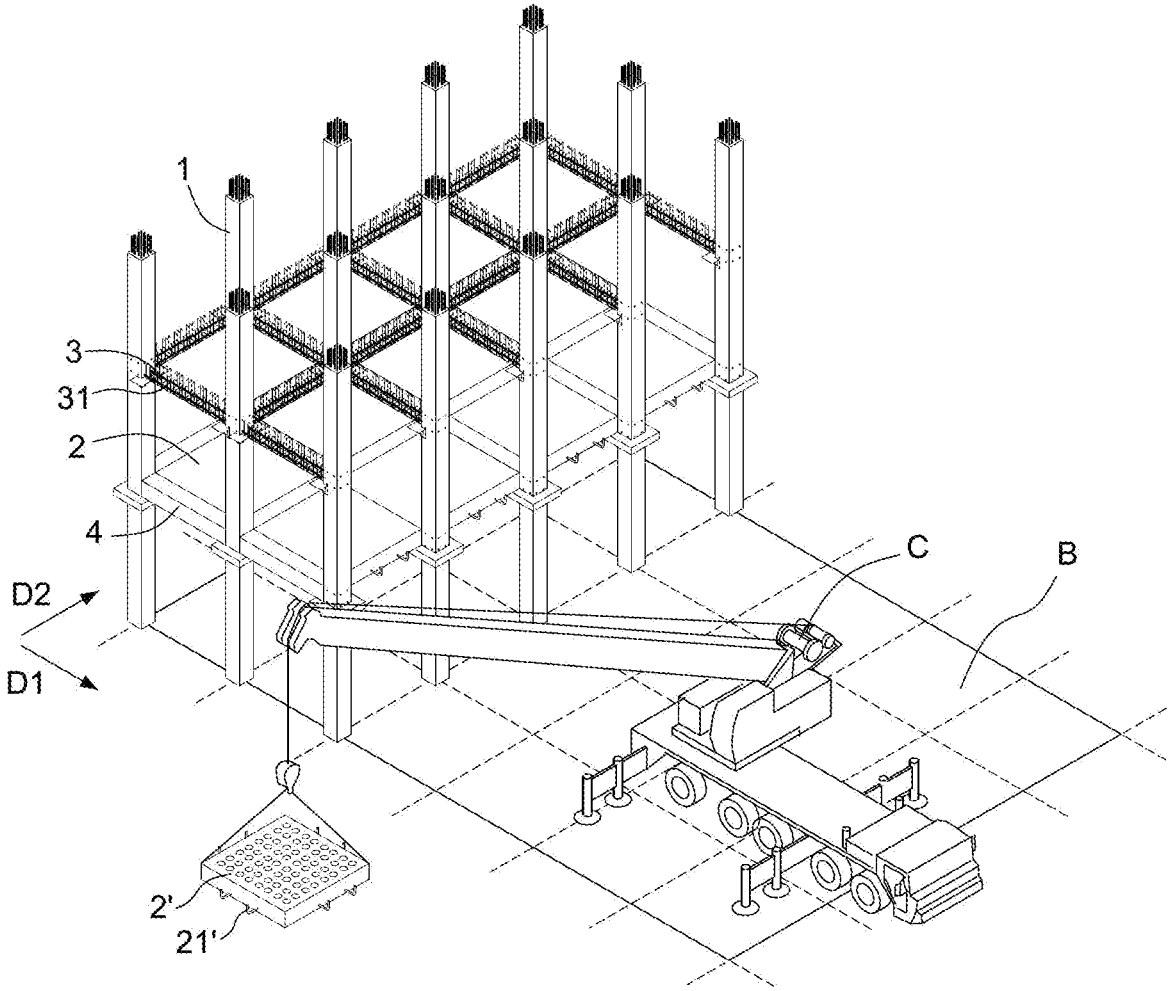
Figure 1J:
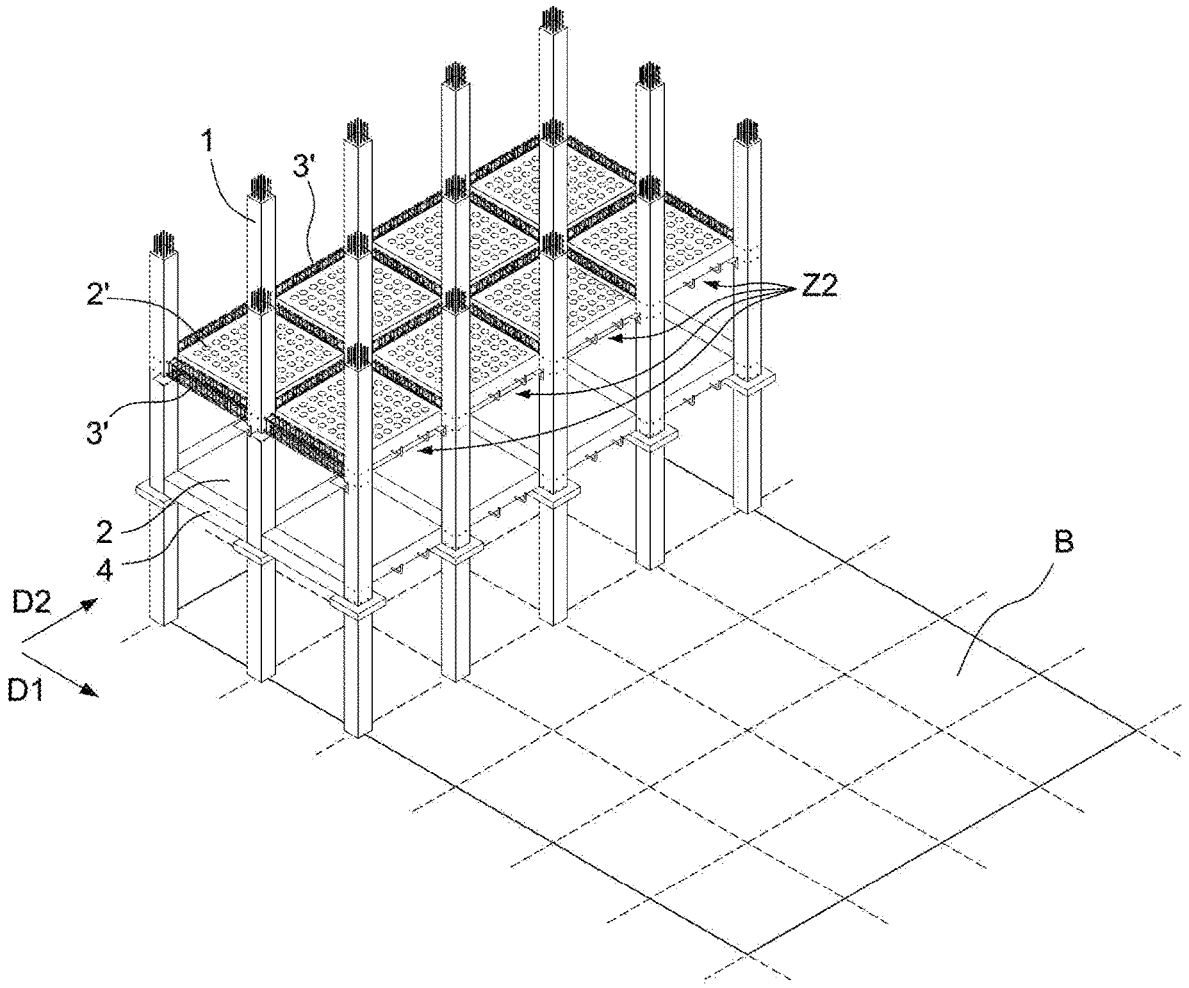
Figure 1K:
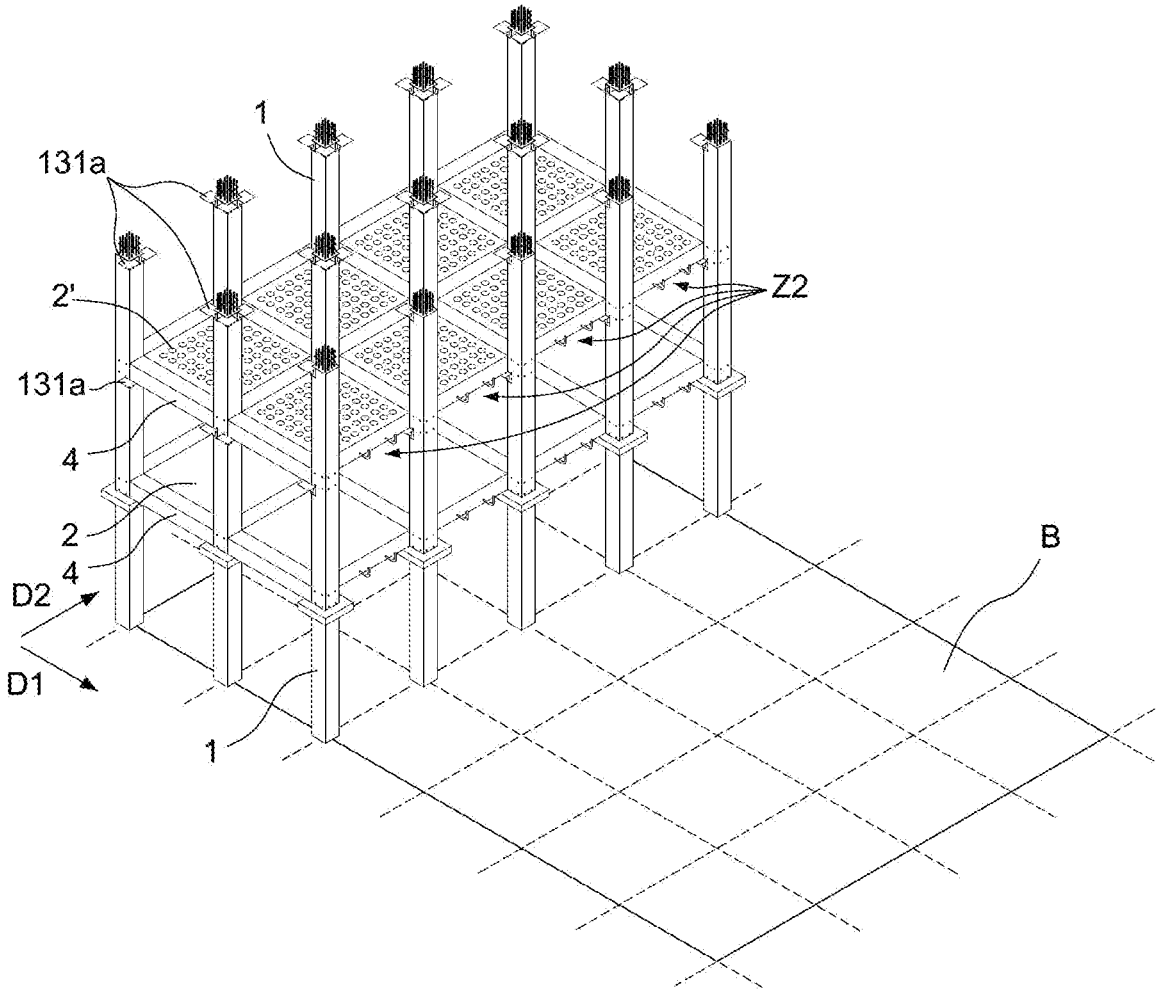
Figure 1I:
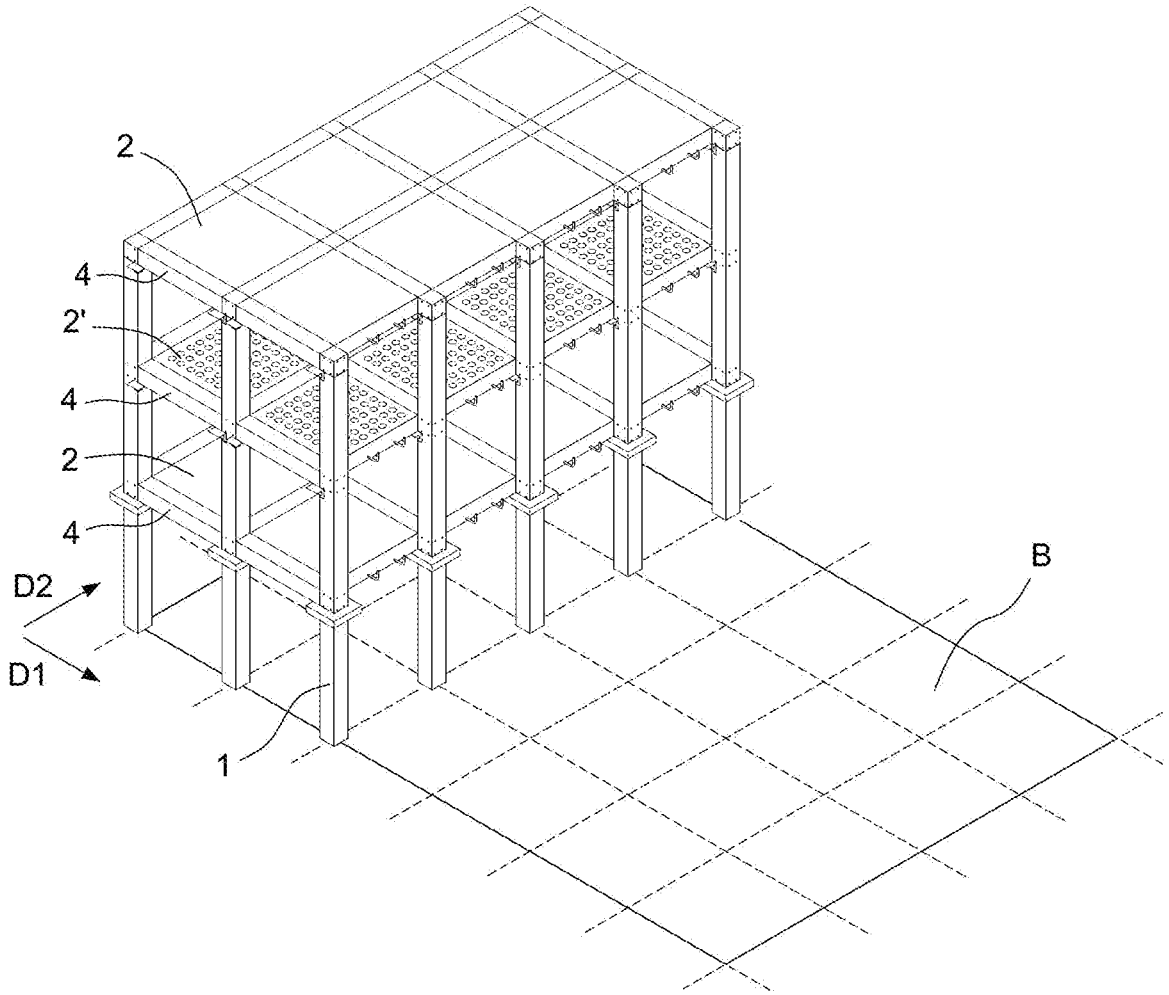
Figure 1M:
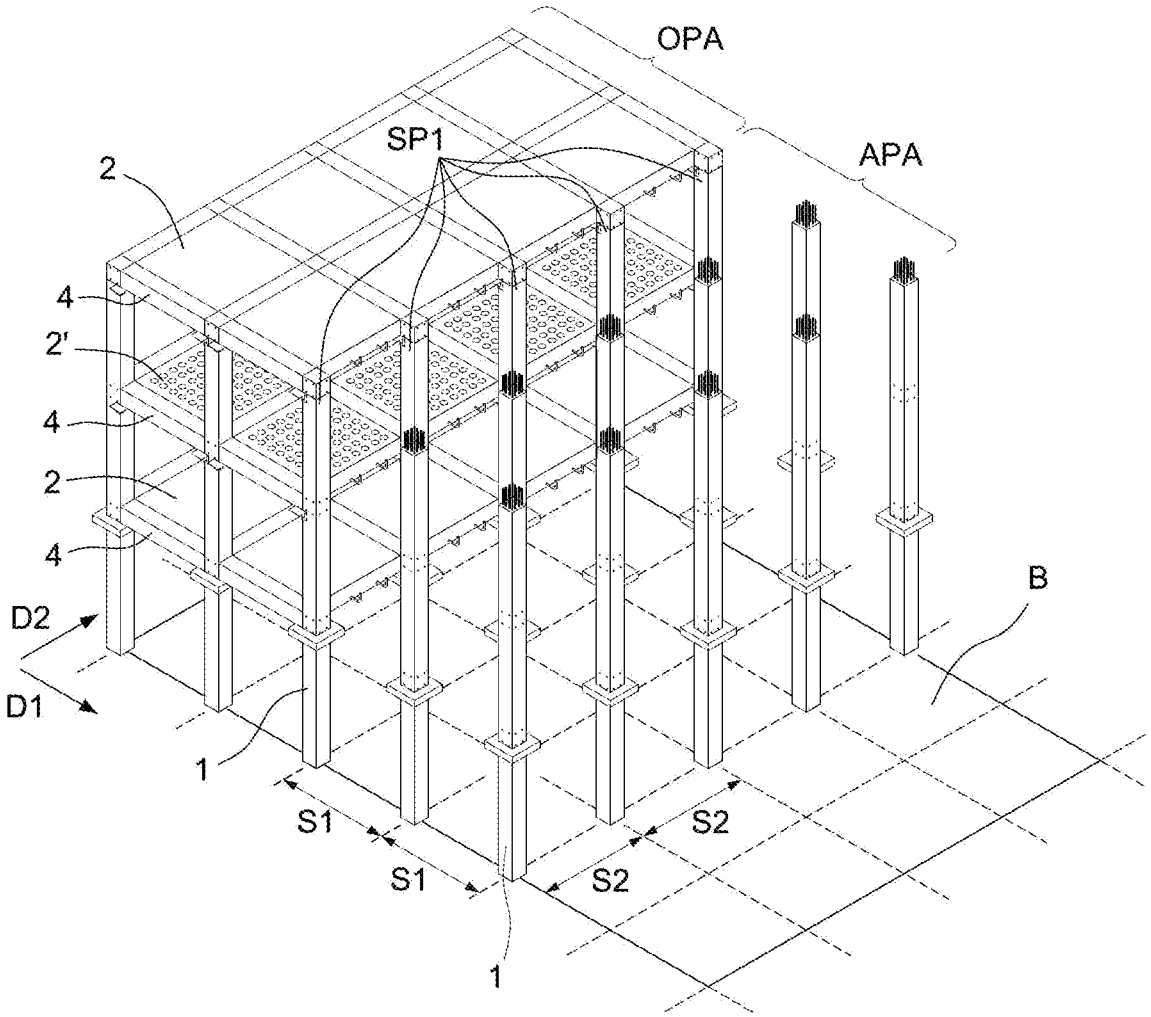
Figure 1N:
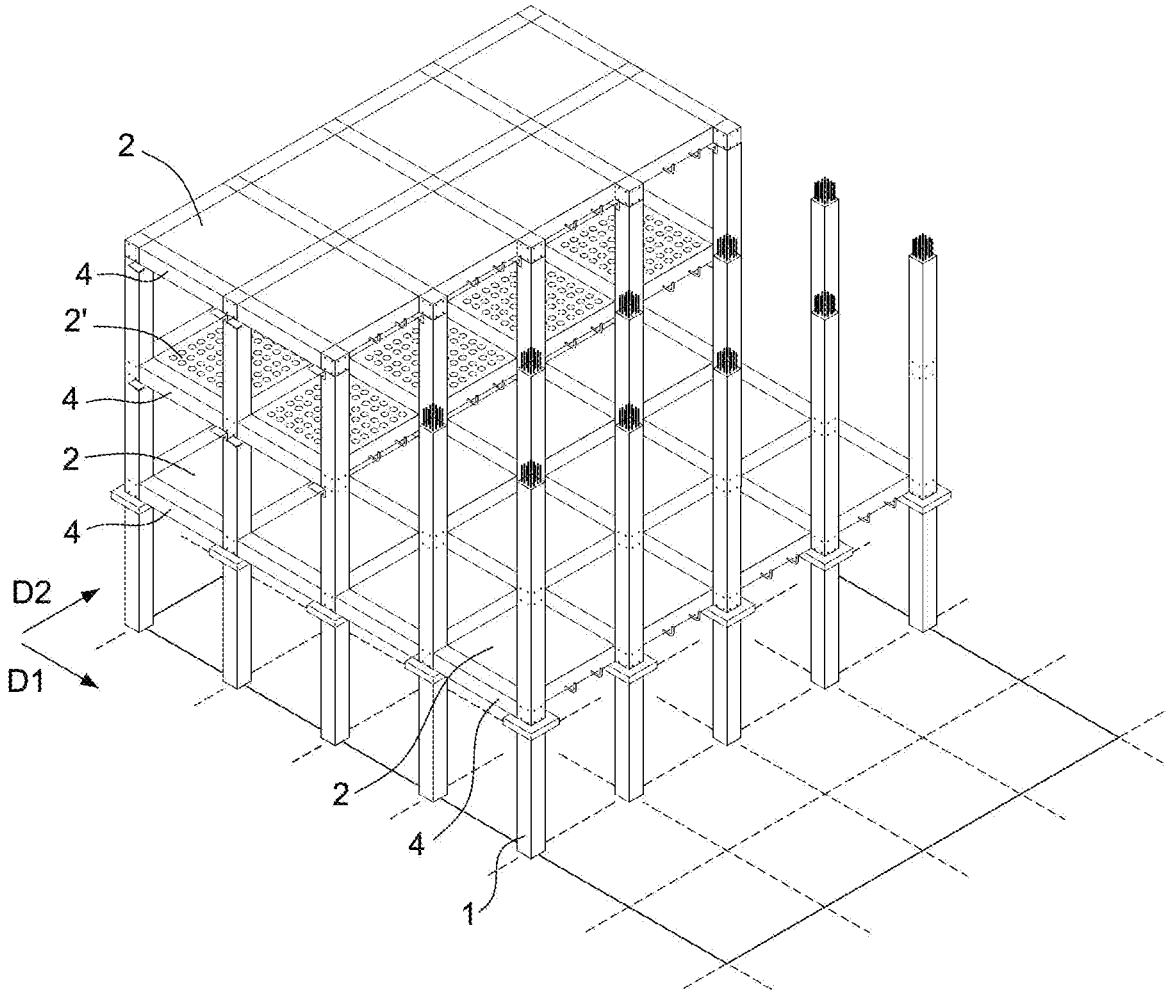
Figure 1O:
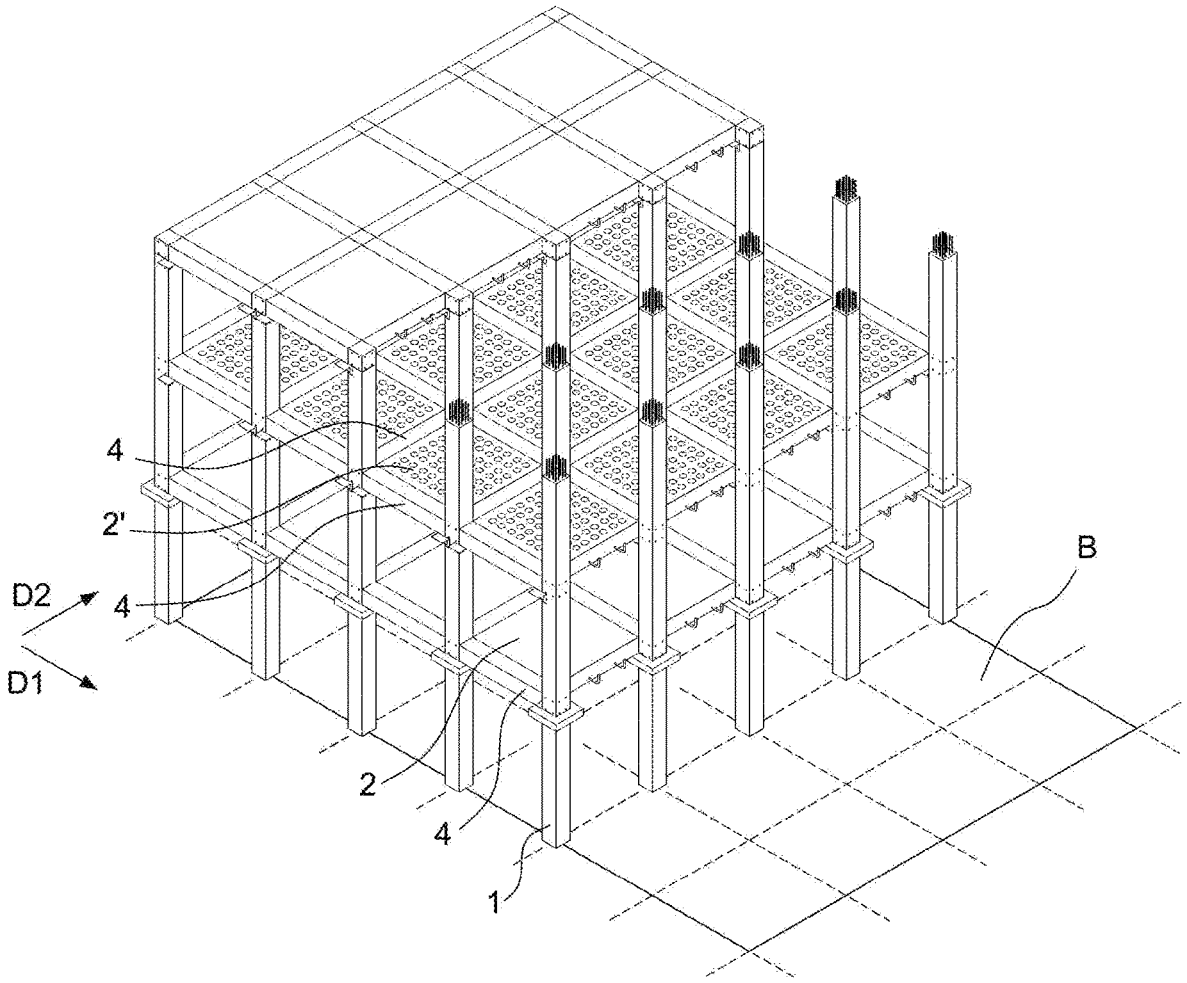
Figure 1P:
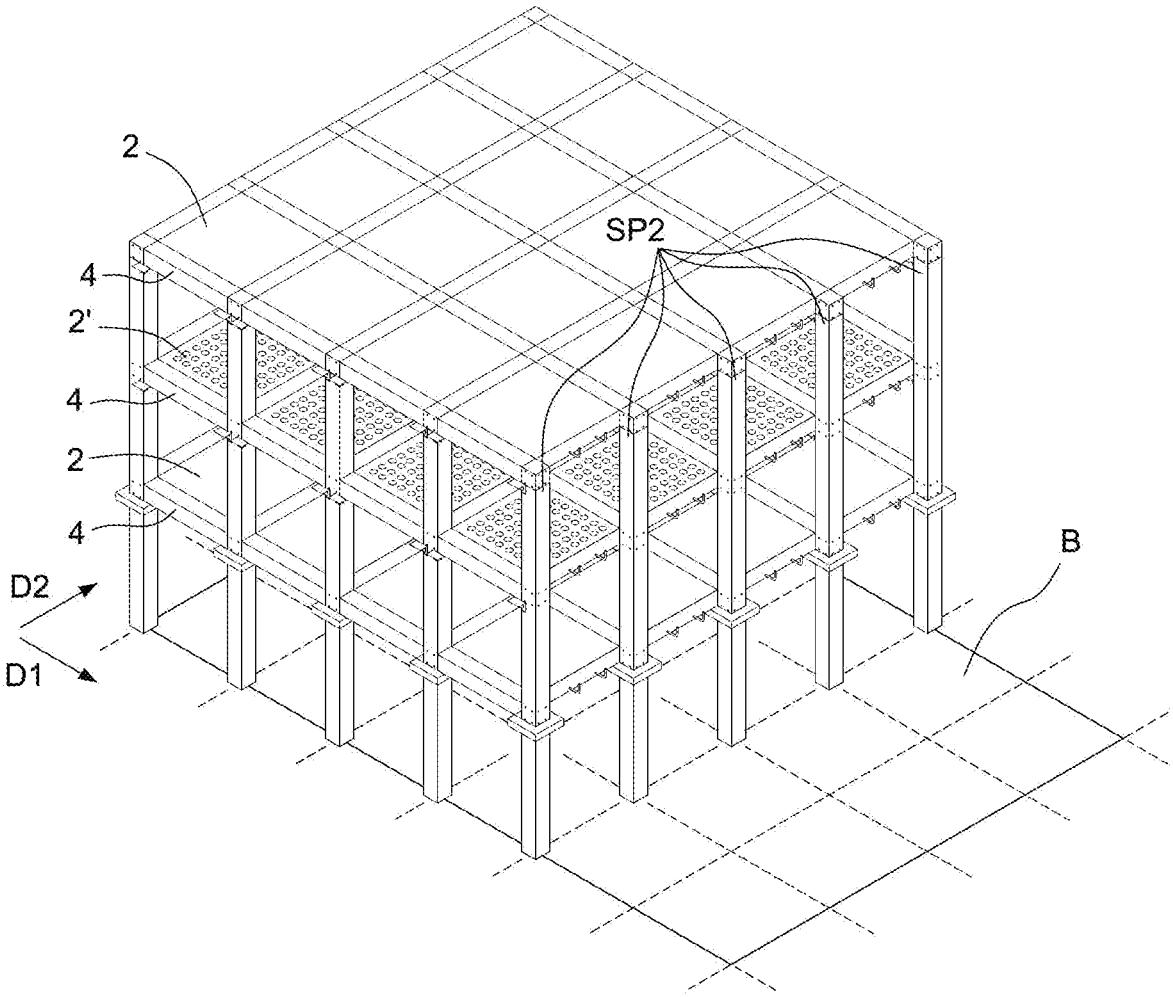
Figure 1Q:
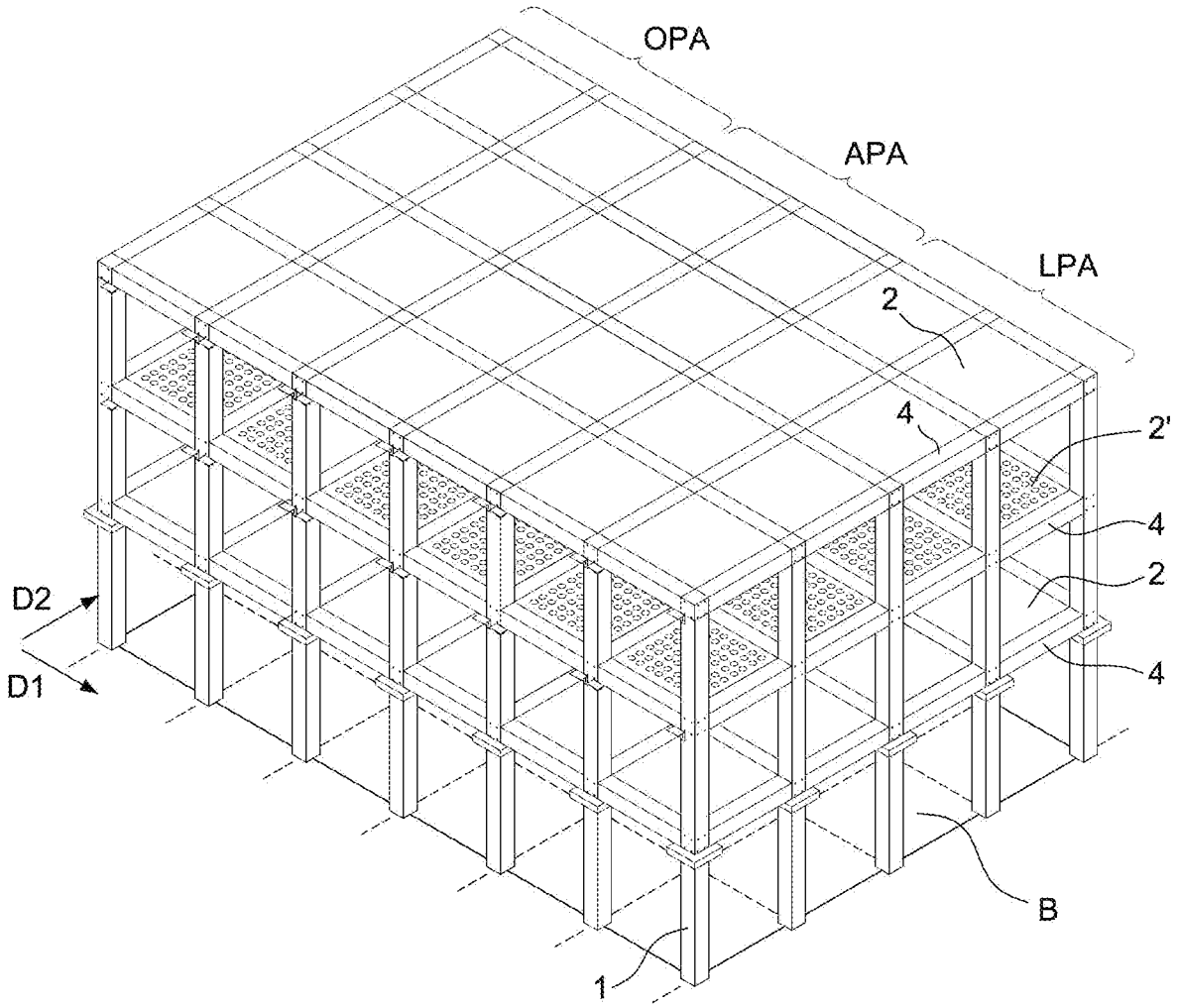

FIGS. 1*a* to 1*q* illustrate the steps of a construction method for a building according to a preferred embodiment of the invention. As commonly known, when a building is to be constructed, construction layout should first proceed according to the blueprints on a construction site. FIG. 1*a* shows the layout of the construction site A marking the predetermined locations for hoisting and positioning the columns of the building. As shown in FIG. 1*b*, a crane C hoists and positions a plurality of precast columns 1, in accordance with the predetermined locations on at least one portion of a predetermined construction area B on a construction site A to form a precast column array having at least two spans S1 along a first direction D1 and having one or more spans S2 along a second direction D2 substantially perpendicular to the first direction D1. In the exemplary embodiment of FIG. 1*b*, four spans S2 are provided therein. Each of the precast columns 1, based on the actual needs, can have a height of one or a plurality of stories (for example in FIG. 1*b*, each precast column 1 has a height of three stories). In addition, the distance of the span S1 along the first direction D1 does not necessarily equal that of the span S2 along the second direction D2. Although the span S1 and the span S2 are not necessarily equal to each other, they typically are approximately the same.

After the hoisting work presented in FIG. 1*b* is accomplished, the precast slab panels 2 and the pre-fabricated beam rebar assemblies 3 are to be hoisted and positioned as shown in FIG. 1*c*, wherein the crane C hoists and positions a plurality of pre-fabricated beam rebar assemblies 3 so that each of them is positioned between each predetermined two adjacent precast columns 1 at the lowest story thereof, as shown in FIG. 1*d*.

Figure 2A:
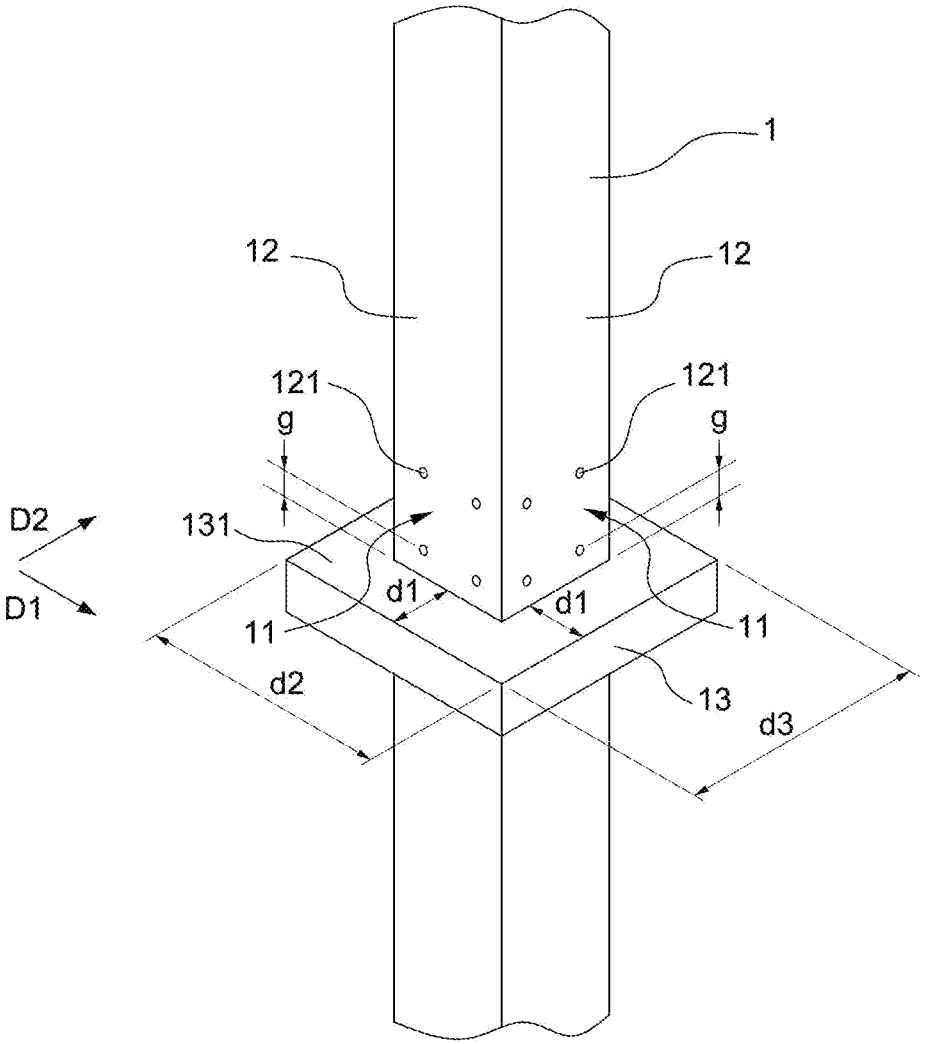
FIG. 2*a* illustrates an exemplary structure of the support portion of the precast column.
Figure 2B:
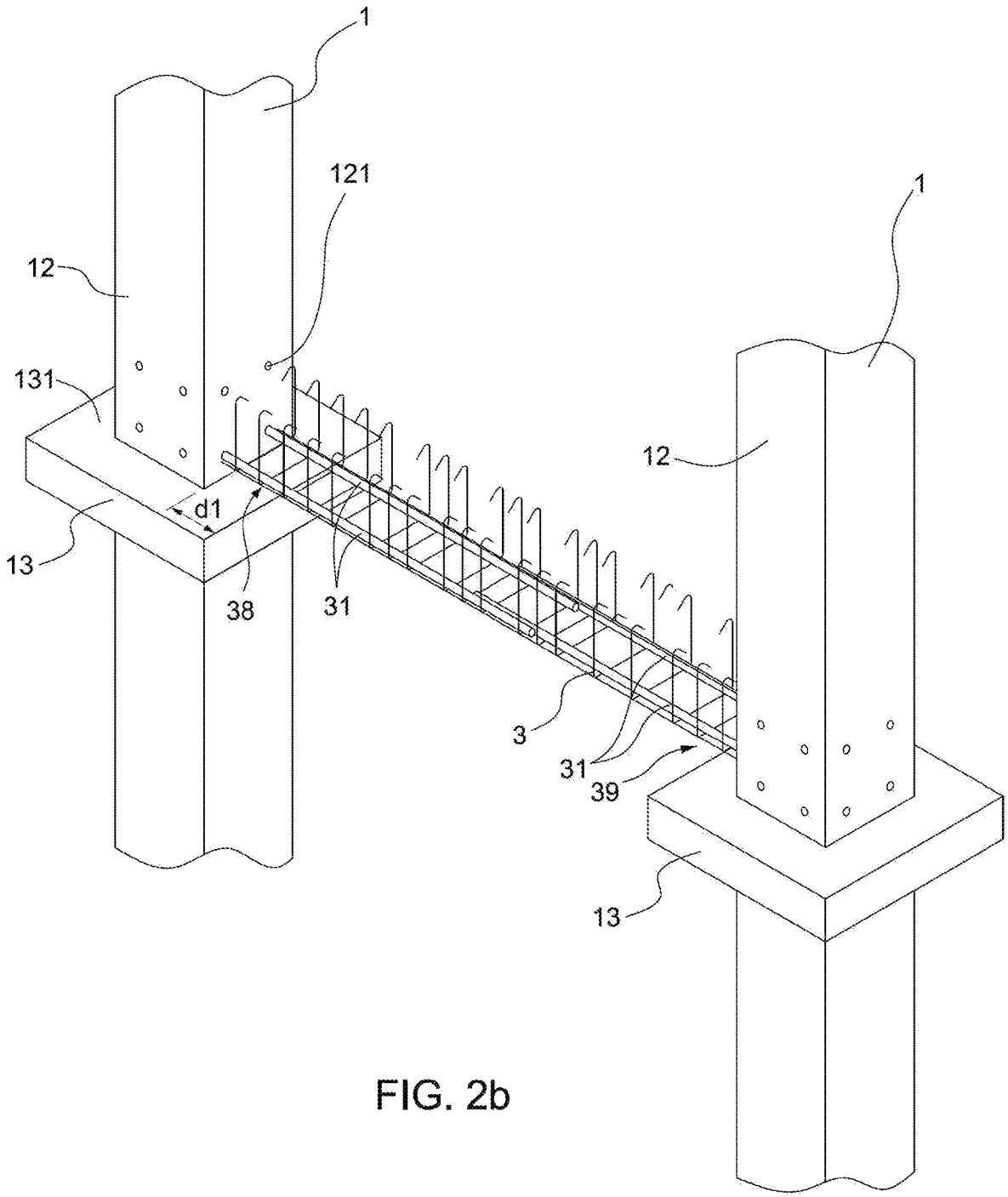
FIG. 2*b* illustrates an exemplary structure of the combination of the horizontal main rebars extending from the precast columns and the pre-fabricated beam rebar assembly.

Specifically, referring to FIGS. 1*c*, 2*a* and 2*b*, the circumferential surfaces 12 of each precast column 1 have a plurality of through holes 121 formed therein, which are distributed in an upper row and a lower row. It can be learned from FIG. 2*a* that a gap g exists between the through holes 121 of the lower row and an upper surface 131 of the support portion 13 of the precast column 1. The support portion 13 is for supporting pre-fabricated beam rebar assemblies 3 and precast slab panels 2. Further referring to FIGS. 2*a* and 2*b*, the through holes 121 of the upper and lower rows are respectively used for the insertion of a horizontally extended main rebar 31. Before the pre-fabricated beam rebar assemblies 3 are respectively hoisted and positioned between each predetermined two adjacent precast columns 1, a main rebar 31 is inserted into each of the plurality of the through holes 121 arranged at the lower row on the circumferential surface 12 of one of the adjacent two precast columns 1. The main bar 31 extends horizontally to partially overlap with a corresponding main rebar 31 inserted into a corresponding through hole 121 arranged at the lower row in the opposite circumferential surface 12 of the other one of the adjacent two precast columns 1. The overlapping sections of the main rebars 31 are then bound together. The pre-fabricated beam rebar assembly 3 is hoisted by the crane C to the upper side of the support potion 13 from below of the main rebars 31. For example, one end 38 of the pre-fabricated beam rebar assembly 3 is firstly inserted at an angle into the gap g between the main rebars 31 and the upper surface 131 of the support portion 13 so that said one end 38 is hoisted and positioned on the surface 131 of the support portion 13 of the corresponding precast column 1. Subsequently, the other end 39 of the pre-fabricated beam rebar assembly 3 is adapted to be inserted into the gap g between the main rebars 31 and the upper surface 131 of the support portion 13 of the other corresponding precast column 1 so that said other end 39 is hoisted and positioned on the surface 131 of the support portion 13 of the other corresponding precast column 1. Then, the pre-fabricated beam rebar assembly 3 is bound with the main rebars 13 extending from the adjacent two precast columns 1 to form a part of the beam rebar cage 3' (see FIG. 2*d*), and a gap for forming the protective layer of the rebars still exists between each of the two ends of the pre-fabricated beam rebar assembly 3 and the upper surface 131 of the corresponding each of the support portion 13 of the adjacent two precast columns 1. The height of the gap g depends on the predetermined thickness of the rebar protective layer.

As shown in FIG. 1*d*, after a pre-fabricated beam rebar assembly 3 is hoisted and positioned between each predetermined two adjacent precast columns 1 in accordance with the above, the crane C begins to hoist and position each of a plurality of the precast slab panels 2 between each predetermined four adjacent precast columns 1 at the working story. In other words, the four corners of the precast slab panel 2 respectively correspond to the adjacent four precast columns 1 so that the precast slab panel 2 can be properly hoisted and positioned. The structure shown in FIG. 1*e* illustrates that the slab panels 2 have been positioned.

Figure 2C:
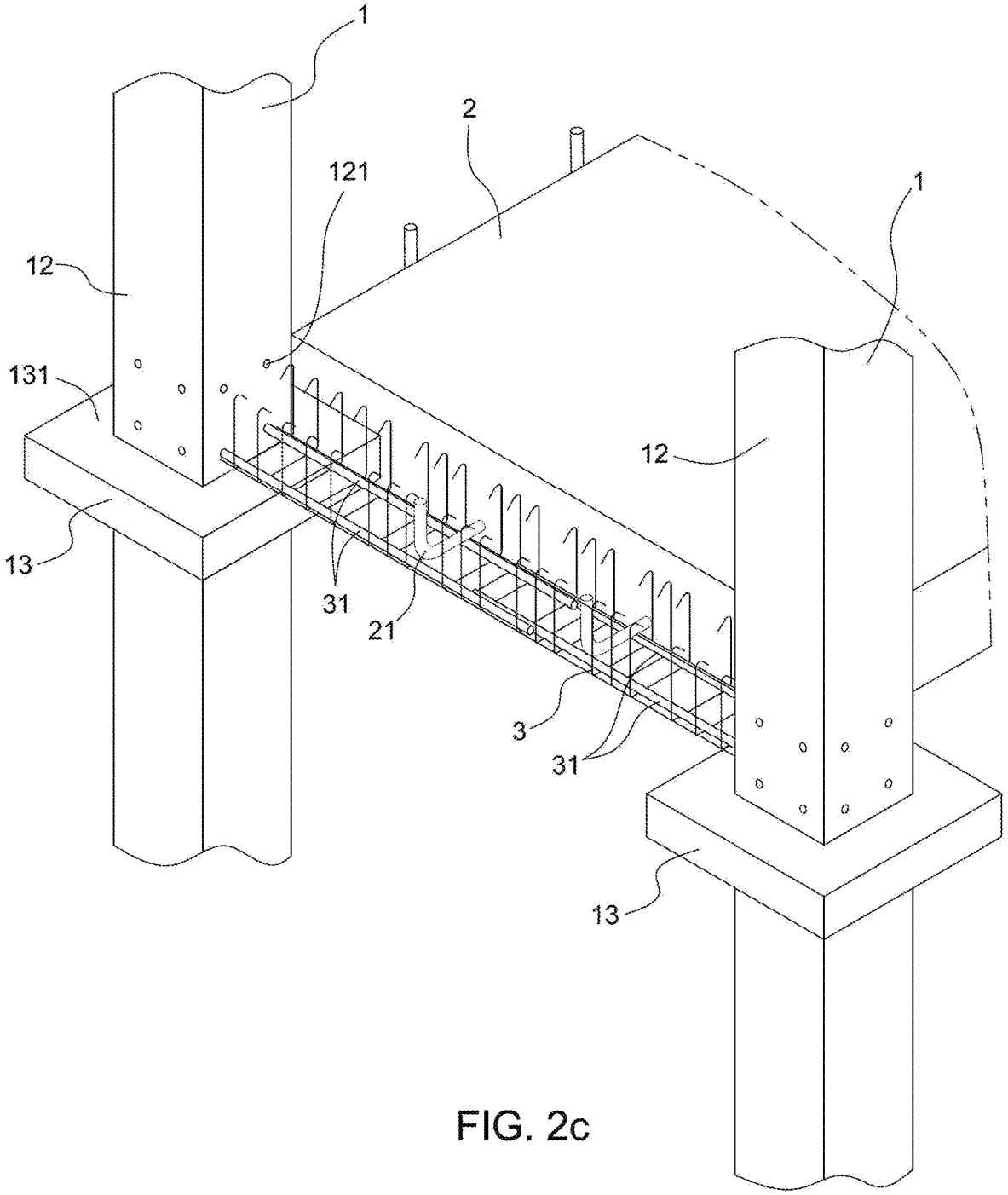
FIG. 2*c* illustrates an exemplary structure of the combination of the horizontal main rebars extending from the precast columns, the pre-fabricated beam rebar assembly and the precast slab panel.

Specifically, as shown in FIG. 2*c*, each side surface of each precast slab panel 2 comprises a plurality of side rebars 21. When the precast slab panel 2 is hoisted and positioned between four adjacent precast columns 1 and is supported by the surfaces 131 of the support portions 13 of each of the four adjacent precast columns 1, the side rebars 21 extending from one side surface of the slab panel 2 pass through the gaps formed in the pre-fabricated beam rebar assembly 3 and are furthered combined with the horizontal main rebars 31 extending between the two adjacent precast columns 1.

Figure 2D:
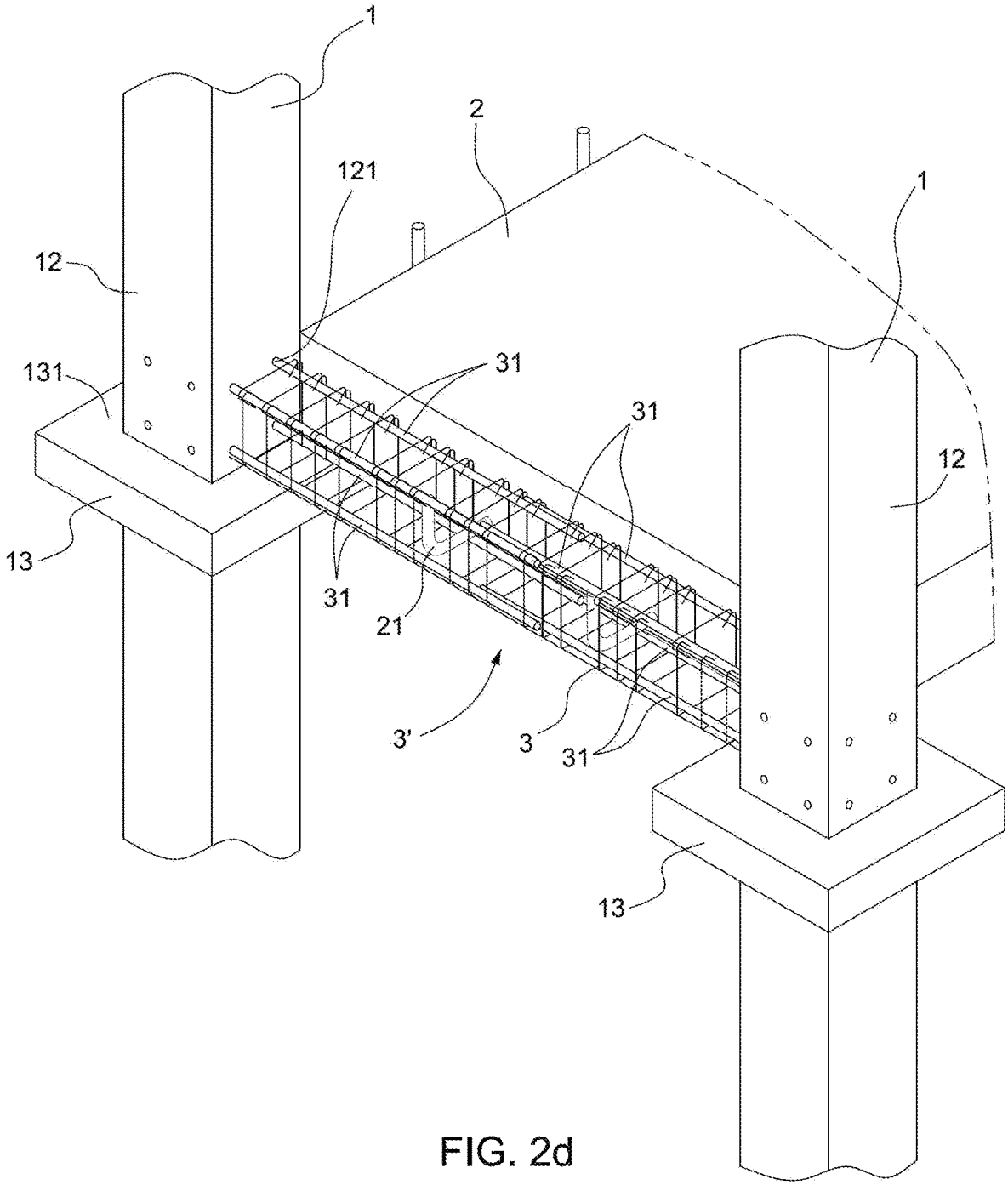
FIG. 2*d* illustrates an exemplary structure of the beam rebar cage between two precast columns.
Figure 2E:
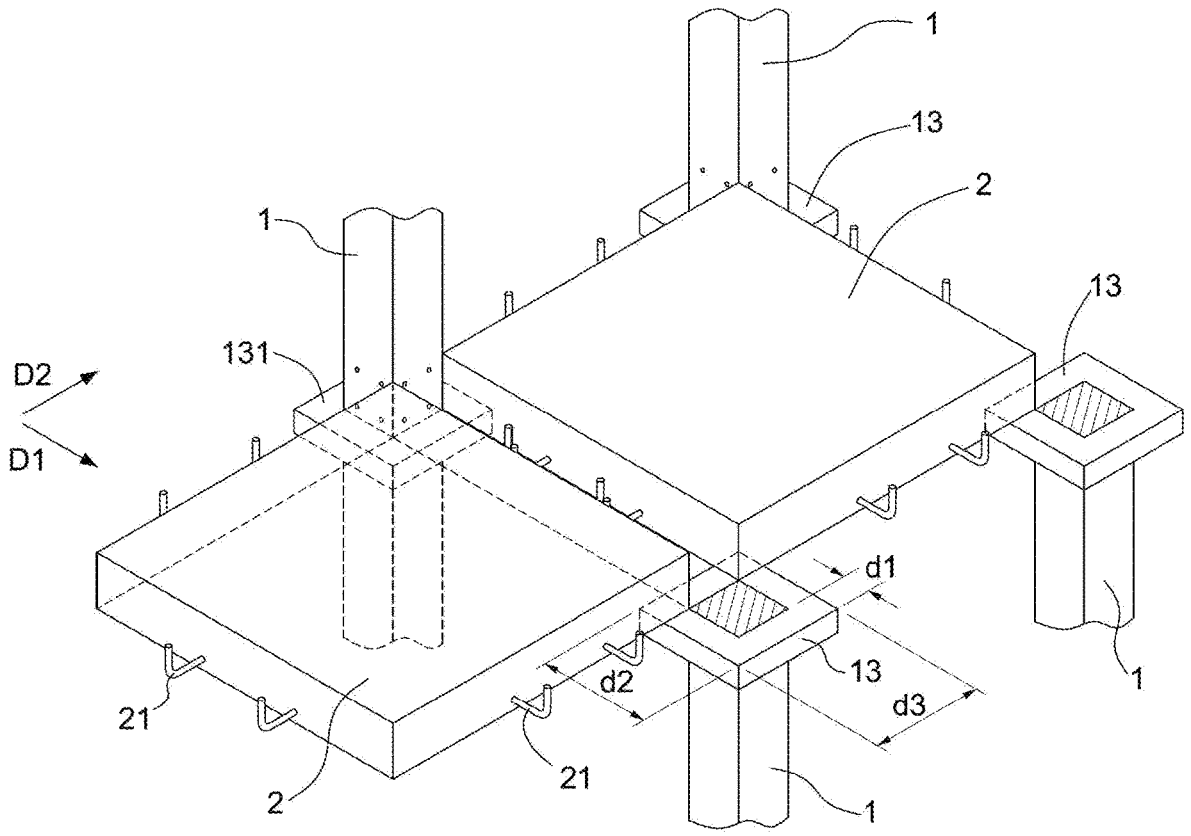
FIG. 2*e* illustrates an exemplary structure of the precast columns supporting a portion of the precast slab panel.

After the plurality of the precast slab panels 2 are hoisted and positioned between each predetermined four adjacent precast columns 1 as shown in FIG. 1*e*, the next step would be completing the beam rebar cage 3' at the working story. Referring to FIGS. 1*f* and 2*d*, a plurality of main rebars 31 will be respectively inserted into each through hole 121 at the upper rows of the opposite circumferential surfaces 12 of the two adjacent columns 1. Similarly, each main rebar 31 extending a distance from each through holes 121 at the upper row of the circumferential surfaces 12 of one of the two adjacent columns 1 partially overlaps with the corresponding rebar 31 extending a distance from each through holes 121 at the upper row of the opposite circumferential surfaces 12 of the other of the two adjacent columns 1. Subsequently, the main rebars 31 disposed at the upper rows are further bound with the pre-fabricated beam rebar assembly 3, and are preferably further bound with the corresponding side rebars of the slab panels 2. After that, an upper stirrup assembly is further provided and bound with the main rebars 31 at the upper rows so as to form the beam rebar cage 3' between the two adjacent precast columns 1. In the exemplary embodiment shown in FIGS. 2*b* to 2*d*, each of the upper row and the low row of the opposite circumferential surfaces 12 at the beam-column connection section 11 of each of the two adjacent precast columns 1 respectively comprises two through holes 121 and two horizontal main rebars 31. However, the quantity of the through holes 121 and main rebars 31 respectively arranged at the upper row and the lower row should not be so limited. Instead, there can be more than two. Therefore, the pre-fabricated beam rebar assembly 3 might be bound with some or all of the overlapping main rebars 31 to form a part of the beam rebar cage 3'. For example, according to the disclosure of FIG. 2*b*, if in the U-shaped pre-fabricated beam 3, three or more through holes 121 and main rebars 31 are provided at the upper row of the beam-column connection section 11, the upper side of the pre-fabricated beam rebar assembly 3 will not be bound with those main rebars 31 in the middle. Similarly, the side rebars 21 of the precast slab panels 2 might be combined with some or the entire overlapping main rebars 31. For example, if the side rebars 21 of the slab panels are C-shaped, the side rebars 21 can be combined with all of the overlapping main rebars 31.

Accordingly, as shown in FIG. 1*f*, the work of hoisting and positioning the slab panels 2 and the pre-fabricated beam rebar assemblies 3 at the lowest story of the precast column array is completed, and the beam rebar cages 3' between each predetermined two adjacent precast columns are also accomplished.

However, it should be noticed that although pre-fabricated beam rebar assemblies 3 can be hoisted and positioned between any two adjacent precast columns 1 positioned along the second direction D2 at the end of the first direction D1 of the precast column array (indicated with "Z1"), the work of the assembling the beam rebar cages 3' of the pre-fabricated beam rebar assemblies 3 at these positions should not be carried out. As an exemplary embodiment, no pre-fabricated beam rebar assemblies 3 or beam rebar cages 3' are hoisted and positioned at Z1 in FIG. 1. In other words, each adjacent two precast columns 1 positioned along the second direction D2 at the end of the first direction D1 of the precast column array can at most comprises a beam rebar assembly 3 (or neither comprise a beam rebar assembly 3 nor a beam rebar cage 3', as shown in FIG. 1*e*). This is because the beam rebar cages 3' should be assembled between the above-mentioned two adjacent precast columns 1 only after the next precast columns 1 and slab panels 2 beyond the end of the first direction D1 have been provided. As an exception, the beam rebar cages 3 along the second direction D2 at the end of the first direction D1 can be simultaneously assembled only when the precast columns 1 occupy the whole predetermined construction area B.

Subsequently, as shown in FIG. 1*g*, the concrete is poured into the molds that surround beam rebar cages 3' between each predetermined two adjacent precast columns 1 so that the beams 4 are formed and the structure of the working story of the precast column array is completed. It should be noticed that no concrete is poured between any two adjacent precast columns 1 positioned along the second direction D2 at the end of the first direction D1 of the precast column array.

For the convenience of the construction work, the steps of hoisting and positioning the beam rebar assemblies 3 and the slab panels 2 can also be switched in sequence to expedite the combination of the pre-fabricated beam rebar assembly 3 with the side rebars 21 extending from the corresponding side surface of the adjacent slab panels 2 and the main rebars 31 extending from the circumferential surface of the two adjacent precast columns 1.

The steps for constructing the structure of the lowest one story of the precast column array shown in FIGS. 1*c* to 1*g* are described above. Where each precast column 1 of the precast column array is more than one story in height, the construction work continues at the next story above the previous completed one, and the same construction steps are repeated until completion of said next story. For example, as shown in FIG. 1*h*, the crane C begins to hoist and position a plurality of pre-fabricated beam rebar assemblies 3 so that each of them is positioned between each predetermined two adjacent precast columns 1 at the next working story. Subsequently, a plurality of slab panels 2' are respectively hoisted and positioned by the crane C between each predetermined four adjacent precast columns 1 at the next working story, as shown in FIGS. 1*i* to 1*j*. Of course, each pre-fabricated beam rebar assembly 3 combines with the main rebars 31 extending from the circumferential surfaces 12 of the corresponding two adjacent precast columns 1 and the side rebars 21' extending from the side surfaces of the corresponding slab panels 2'. The hoisting and positioning work on the pre-fabricated beam rebar assemblies 3 and the precast slab panels 2' at the next working story of the precast column array and the work of accomplishing the beam rebar cages 3' between each predetermined two adjacent precast columns 1 are completed as shown in FIG. 1*j*.

Similarly, as shown in FIGS. 1*j* and 1*k*, since not all the precast columns 1 have been hoisted and positioned to occupy the whole predetermined construction area B, no pre-fabricated beam rebar assemblies 3 or beam rebar cages 3' are hoisted or positioned between any two adjacent precast columns 1 positioned along the second direction D2 at the end of the first direction D1 at the next working story of the precast column array (indicated with "Z2"). Therefore, the concrete is poured into the molds that surround beam rebar cages 3' between each predetermined two adjacent precast columns 1, but not between any two adjacent precast columns 1 positioned along the second direction D2 at the end of the first direction D1 of the precast column array (Z2), so that the beams 4 are formed and the structure of the next working story of the precast column array is completed, as shown in FIG. 1*k*.

The construction steps for completing the structure of a single story of the precast column array as described above can be repeated to accomplish the structure of the rest stories of the precast column array one story by one story. For example, as each of the precast columns 1 of the present embodiment has a height of three stories, repeats of the construction steps would accomplish the three-story structure shown in FIG. 1*l*.

After accomplishing the structure of each story of the precast column array, the crane C moves a distance along the first direction D1 to proceed with the construction work on the next precast column array. As show in FIG. 1*m*, taking the precast columns of the original precast column array OPA positioned at the end of the first direction D1 and along the second direction D2 as the starting points SP1, the crane C begin to hoist and position an additional plurality of precast columns 1 on at least one portion of a predetermined construction area B on a construction site A to form an additional precast column array APA having at least two spans S1 along a first direction D1 from the starting points SP1 and having one or more spans S2 along a second direction D2 substantially perpendicular to the first direction D1. In the embodiment shown in FIG. 1*m*, the additional precast column array includes four spans S2. The precast columns 1 of the additional precast column array APA, based on actual needs, can have a height of a plurality of stories equal to or different from the precast columns of the original precast column array OPA. In the exemplary embodiment shown in FIG. 1*m*, each additional precast column 1 has a height of three stories that equals the height of the precast column 1 of the original precast column array OPA.

As shown in FIG. 1*m*, after the precast columns 1 of the additional column array APA are hoisted and positioned, the structure of each story of the additional column array APA is constructed story by story from the lowest story to the highest story by repeating the construction steps described above. FIGS. 1*n* to 1*p* illustrate the steps of constructing the structure of each story of the additional precast column array.

According to the present embodiment, in order to complete the structure of the building to be constructed on the whole predetermined construction area B, the crane C further moves a distance along the first direction D1 to continue the construction work on the last precast column array LPA. Similarly, taking the precast columns 1 of the additional precast column array APA positioned at the end of the first direction D1 and along the second direction D2 as the staffing points SP2, the crane C begin to hoist and position a further plurality of precast columns 1 on the last portion of the predetermined construction area B on the construction site A to form the last precast column array LPA having at least two spans S1 along a first direction D1 from starting points SP2. The precast columns 1 of the last precast column array LPA, based on actual need, can have a height of a plurality of stories equal to or different from the precast columns 1 of the OPA or APA. After the precast columns 1 of the last precast column array LPA are hoisted and positioned, the structure of each story of the further column array is constructed story by story from the lowest story to the highest story by repeating the construction steps described above. In summary, the spirit of the present embodiment is to accomplish the structure of each story of a precast column array 1 having two or more spans S1 at one construction stage, and to repeat such construction work along the first direction D1 until the structure of the building occupies the whole predetermined construction area B. For example, FIG. 1*q* illustrates the structure of the building having a predetermined six spans along the first direction constructed according to the construction method described above.

During the last working stage at which the structure of the last precast column array LPA is to be constructed, because the precast columns 1 now occupy the whole predetermined construction area B, different from the working stages performed on OPA or APA, the construction steps of hoisting and positioning the pre-fabricated beam rebar assemblies and slab panels, accomplishing the structure of the beam rebar cages, and pouring concrete into the molds surrounding beam rebar cages to form the beams will be performed between any two adjacent precast columns positioned along the second direction D2 at the end of the first direction D1 so that the structure of the whole building can be accomplished as shown in FIG. 1*q*.

As described above, the precast columns 1 can have a height of one or more stories in accordance with actual needs and designs. FIG. 2*a* illustrates a partial structure of the precast column 1 having a cross section that is, for example, rectangular-shaped. A support portion 13 protrudes outward a length d1 from circumferential surfaces 12 of the precast column 1 under a beam-column connection section 11 at the lowest story of the same. The outer circumferential edge of the support portion 13 has a length d2 in the first direction D1 and has a length d3 in the second direction D2. Furthermore, the support portion 13 is used for supporting a portion of each of the precast slab panels 2 or a portion of each of the pre-fabricated beam rebar assemblies 3 disposed adjacent to each of the precast columns 1. A plurality of through holes 121 are formed in each of the circumferential surfaces 12 at the beam-column connection section 11 of the precast column 1, and distributed in an upper row and a lower row for the insertion of the horizontal main rebars.

Referring to FIG. 2*b*, the length d1 of the support portion 13 is able to render a portion or an end of each of a plurality of pre-fabricated beam rebar assemblies 3 adjacent to the precast column 1 to temporarily rest on the surface 131 of the support portion 13, so that the work of upwardly hoisting and positioning the pre-fabricated beam rebar assembly 3, and the combination of the pre-fabricated beam rebar assembly 3 with the main rebars 31 can proceed steadily. In addition, as shown in FIG. 2*a*, the length d1 and the length d2 in the first direction D1, and the length d3 in the second direction D2 of the support portion 13 are sufficient to allow a portion of each of a plurality of precast slab panels 2 or 2' (for example, the corners thereof) adjacent to the precast column 1 to rest on the surface 131 of the support portion 13. In other words, a precast slab panel 2 or 2' is hoisted and positioned so that the four corners thereof are respectively supported by the surface of the support portion 13 of the corresponding four adjacent precast columns 1.

Figure 3:
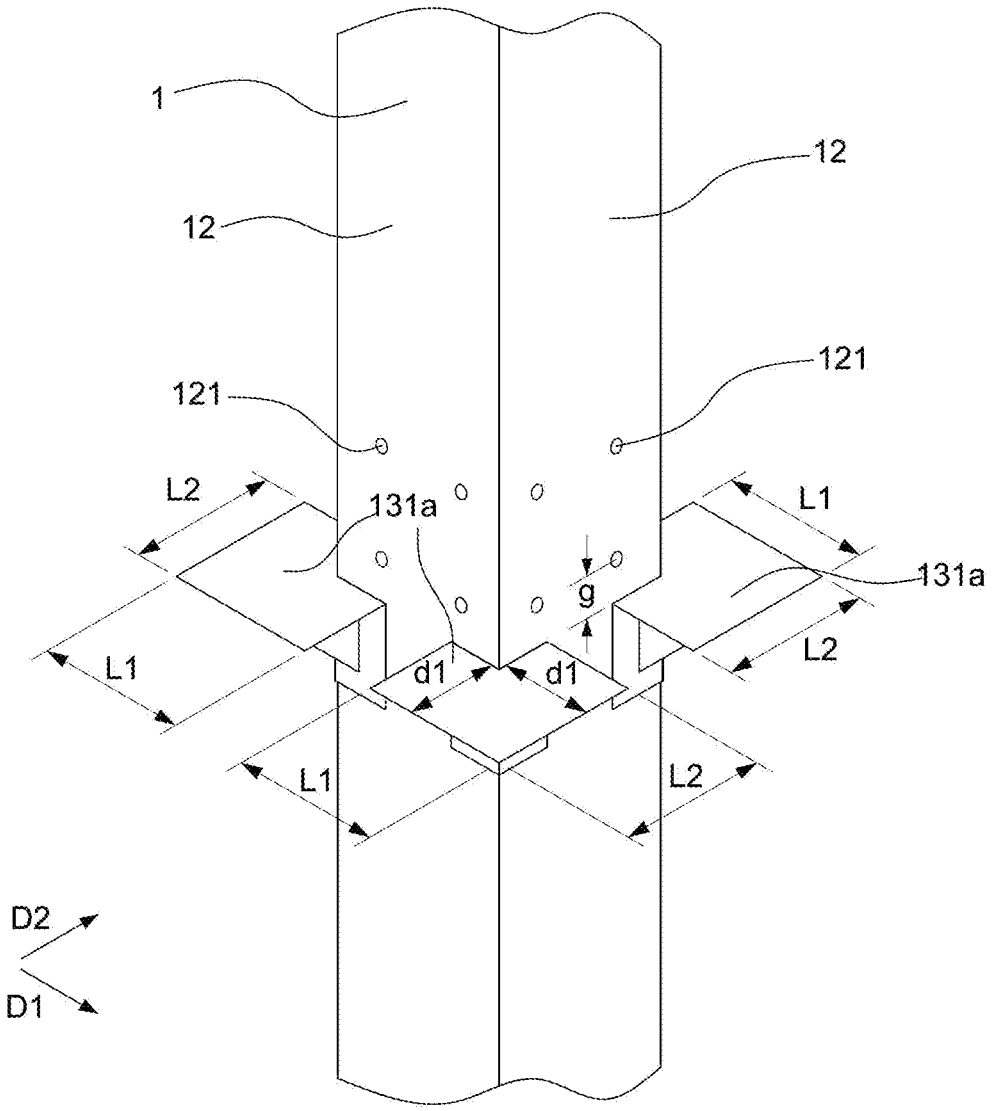
FIG. 3 illustrates an exemplary structure of the support portion in the form of corner brackets.

The support portion 13 at the lowest story of the precast column 1 as shown in FIGS. 2*a* to 2*e* can be a precast RC structure, but not limited thereto. As shown in FIG. 3, in an alternative embodiment, the support portion 13 includes a plurality of corner brackets 131*a* respectively pre-mounted to a plurality of corners of each of the precast columns 1 and located under the beam-column connection section 11 at the lowest story of the same. The corner brackets 131*a* are made of steel, for example, and fastened to the predetermined corner positions. In addition, each of the corner brackets 131*a* transversely extends from the adjacent circumferential surfaces 12 of the corresponding corner of the precast column 1 by the length d1. The outer circumferential edge of the corner bracket 131*a* has a length L1 in the first direction D1 and a length L2 in the second direction D2. The length d1, the length L1, and the length L2 of the corner bracket 131*a* are sufficient to allow a portion of the corresponding precast slab panel 2 or 2' to rest on the surface of the corner bracket 131, or a portion or an end of each of the corresponding pre-fabricated beam rebar assemblies 3 to temporarily rest on the same.

Although in one embodiment, a support portion 13 can be originally pre-mounted or precast under the beam-column connection section 11 at the lowest story of each of the precast columns 1, the support portion 13 should not be originally pre-mounted or precast under the beam-column connection section 11 at the other stories. This is because if the support portion 13 is originally pre-mounted to a story other than the lowest story of the precast column 1, it will block the slab panel 2 or 2' from being hoisted and positioned to the predetermined story from a height lower than that at which the support portion 13 is pre-mounted. Therefore, for the stories other than the lowest story, the support portion 13 can only be mounted to the predetermined position of each story of the precast column 1 after the hoisting work on the slab panel 2 or 2' at its immediate lower story is completed. For example, in FIG. 1*h* the support portions in the form of corner brackets 131*a* are mounted to each of the precast columns 1 at the second story after the structure of the lowest story of the precast column array is completed. Likewise, in FIG. 1*k* the support portions in the form of corner brackets 131*a* are mounted to each of the precast columns 1 at the third story after the structure of the second story of the precast column array is completed.

Figure 4A:
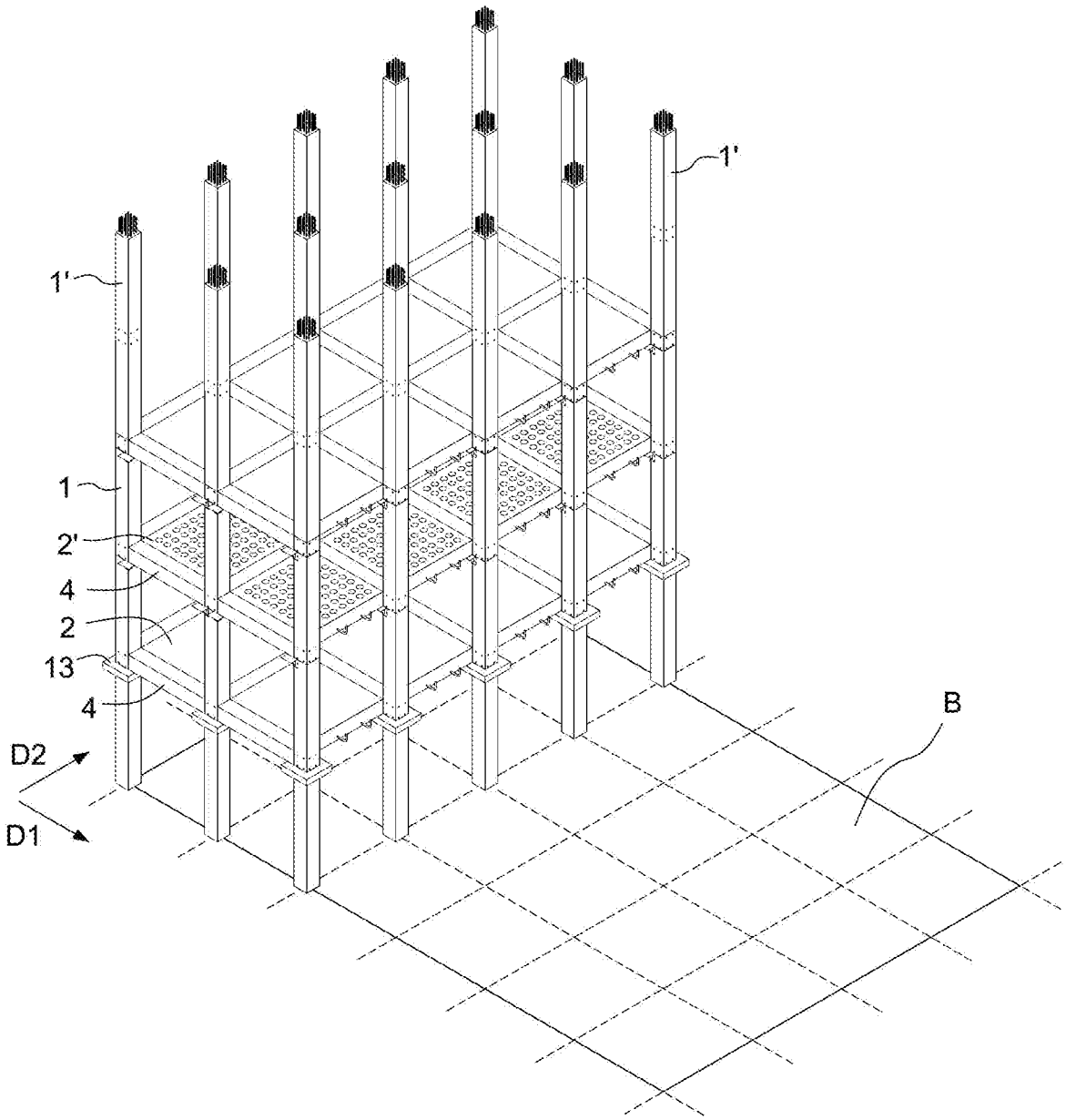
FIGS. 4*a* to 4*f* illustrate a construction method for constructing the structure of a building having jointed precast columns according to another preferred embodiment of the invention.
Figure 4B:
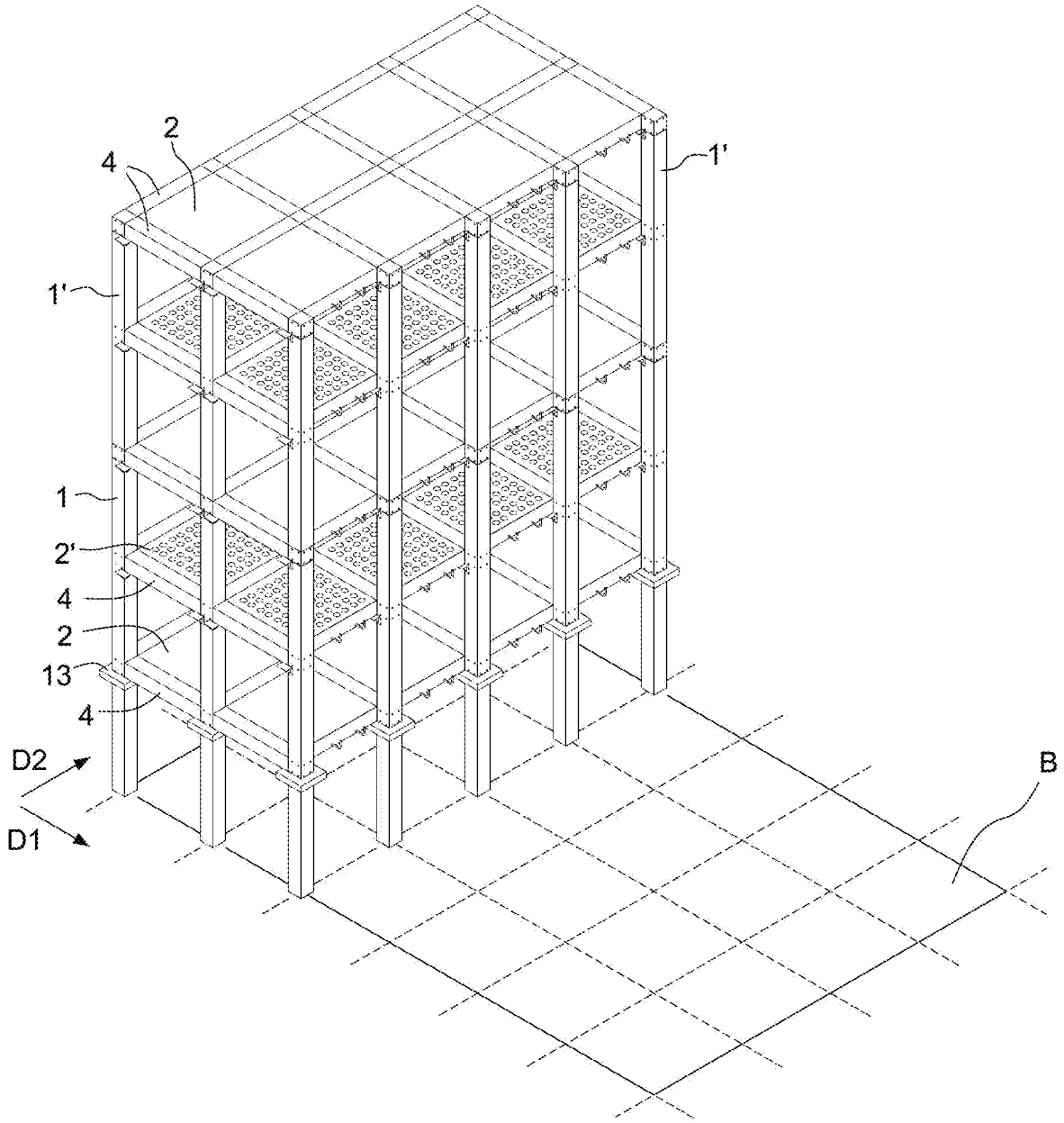
Figure 4C:
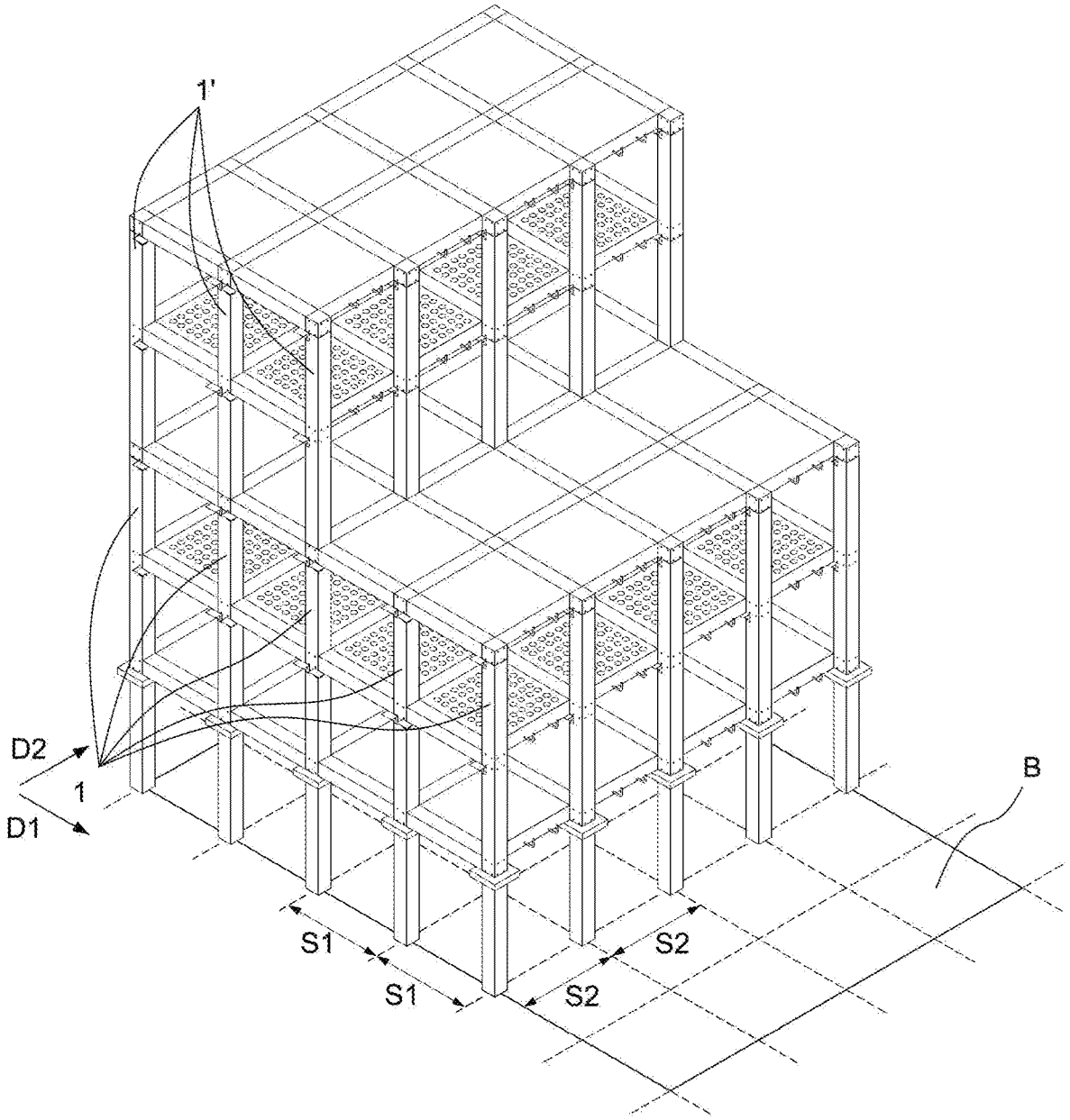

Moreover, in the present embodiment, each precast column 1 of the precast column array can be further end-to-end jointed with another precast column so as to form a jointed precast column array. In this way, the structure of a building with more stories can be constructed. FIGS. 4*a* to 4*e* illustrate the construction method for constructing the structure of a building having jointed precast columns according to another embodiment of the invention. As shown in FIG. 4*a*, after the structure of each story of the original precast column array is accomplished, each precast column 1 thereof is further jointed with another precast column 1' having one or more stories, and thus a jointed precast column array is formed. Subsequently, the structure of each story of the jointed precast column array is constructed according to the same construction steps for constructing each story of the original precast column array. The finished structure of the jointed precast column array is shown in FIG. 4*b*. If necessary, additional precast columns having specific height can be further end-to-end jointed to the precast columns 1' respectively, and then the same construction steps are repeated to accomplish the structure of each story corresponding to the additional precast columns. By repeating such processes, more stories can be added until a predetermined height is reached.

Figure 4D:
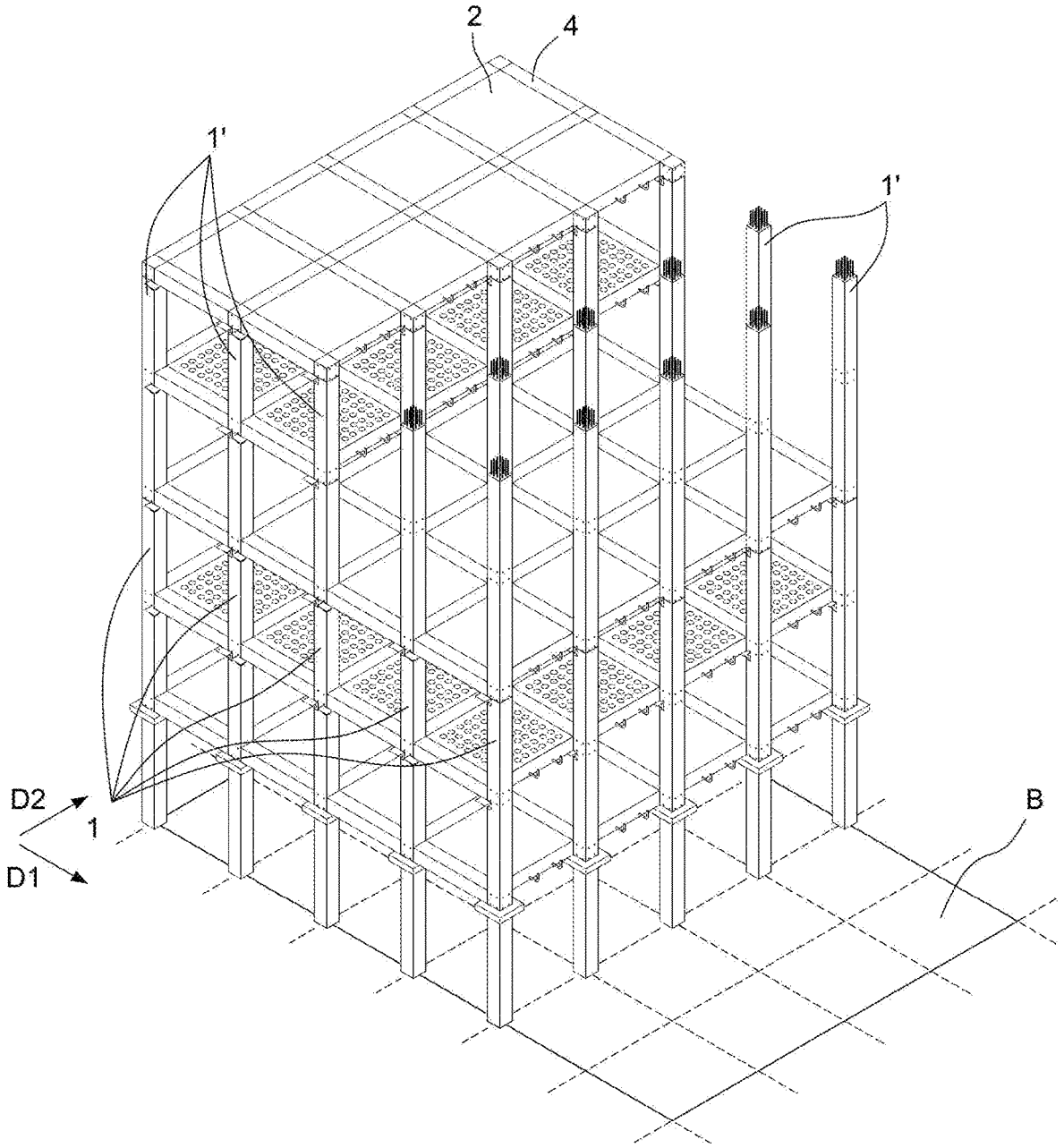
Figure 4E:
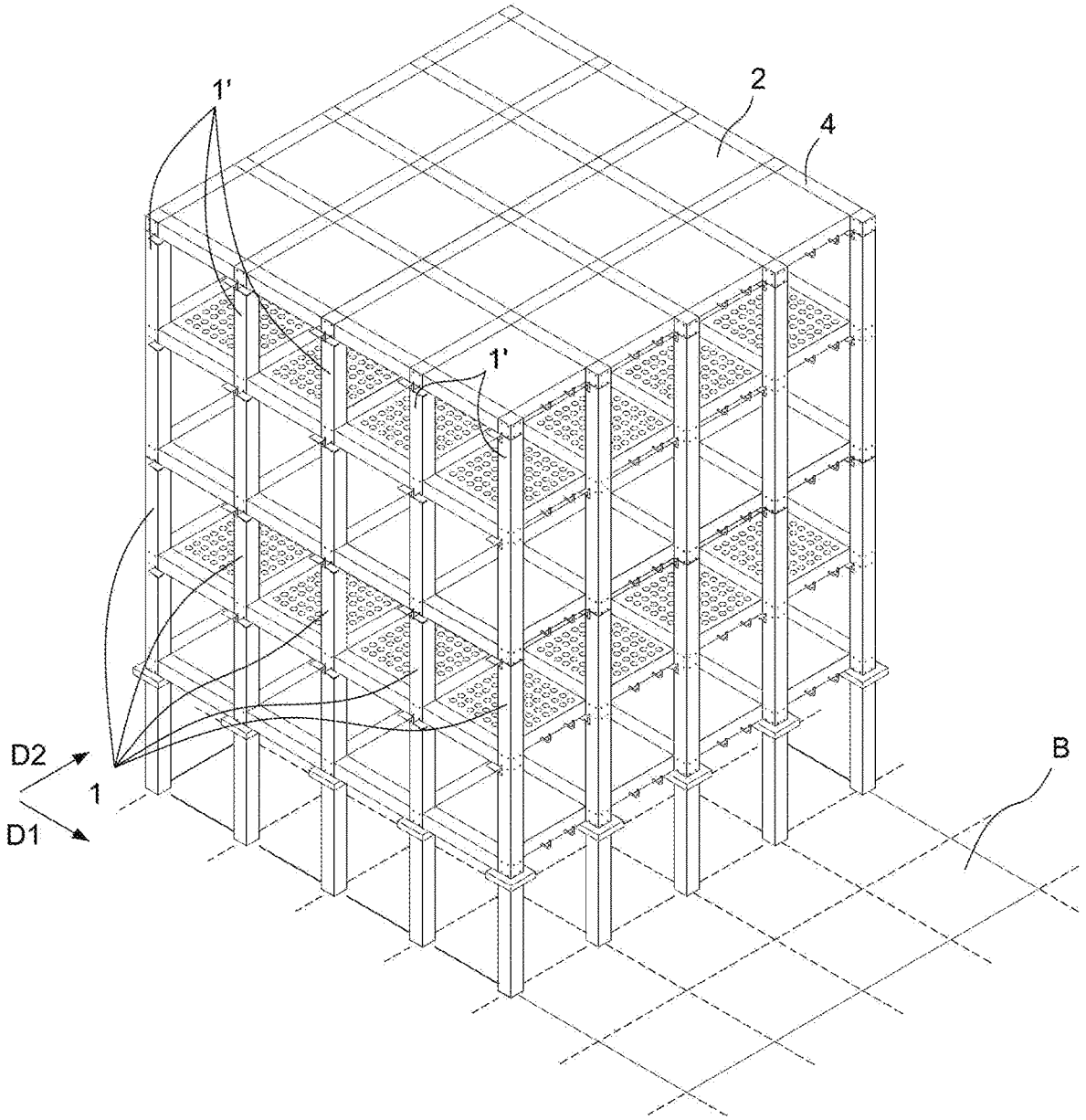

After the structure of the jointed precast column array is accomplished, the crane C moves a distance along the first direction D1 to proceed with the construction work on the next precast column array. As show in FIG. 4*c*, the crane C hoists and positions an additional plurality of precast columns 1 to form an additional precast column array. The structure of each story of the additional precast column array is then accomplished by applying the construction steps described above. Subsequently, as shown in FIG. 4*d*, each of the precast columns 1 thereof is further end-to-end jointed with another precast column 1' having one or more stories, and thus a jointed additional precast column array is formed. The precast column 1' for jointing to the precast column 1 of the additional precast column array may also have different stories from that of the precast column that is end-to-end jointed to the precast column 1 of the original precast column array. The structure of each story of the jointed additional precast column array is constructed by applying the same construction steps for constructing each story of the original precast column array. The finished structure of the jointed additional precast column array is shown in FIG. 4*e*. If necessary, additional precast columns having specific stories can be further end-to-end jointed to each of the precast columns 1' of the jointed additional precast column array respectively to increase the height of the building to be constructed. Such process can be repeated so that the structure the jointed additional precast column array reaches a predetermined height.

Subsequently, the crane C further moves a distance along the first direction D1 to proceed with the construction work on the next precast column array. The crane C further hoists and positions a further plurality of precast columns 1 to form the last precast column array. The structure of each story of the additional precast column array is then accomplished by applying the same construction steps described above. After that, each of the precast columns 1 thereof is further end-to-end jointed with another precast column 1' of one or more stories in height, and thus a further jointed precast column array is formed. The structure of each story of the further jointed precast column array is constructed by applying the same construction steps for constructing each story of the original precast column array. If necessary, additional precast columns of specific height can be further end-to-end jointed to each of the precast columns 1' of the further jointed precast column array respectively to increase the height of the building to be constructed. Such process can be repeated so that the structure the jointed further precast column array reaches a predetermined height.

Figure 4F:
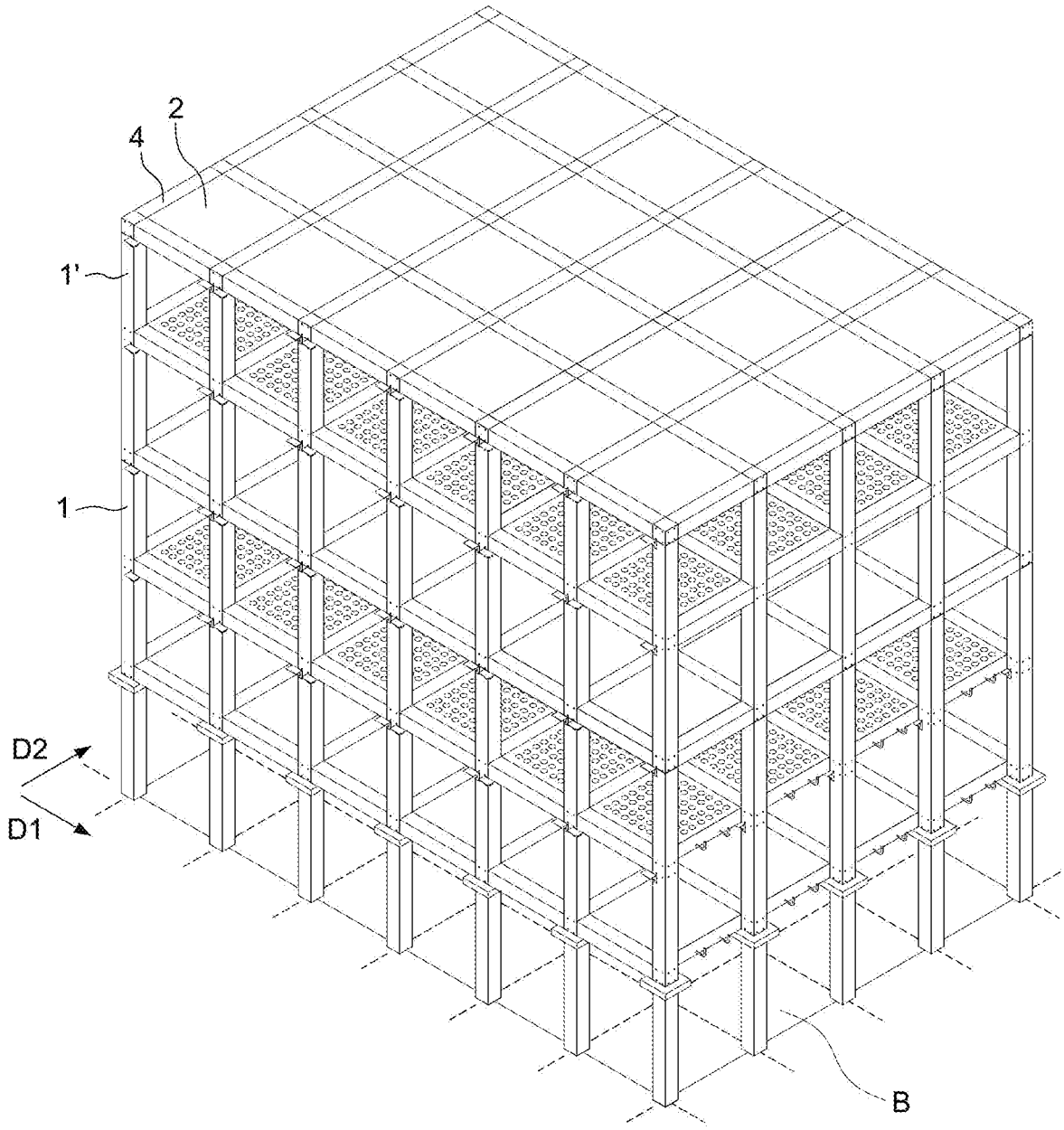

Briefly, the above embodiment of the subject invention discloses that after the construction work on each story of a precast column array is finished, additional precast columns can be end-to-end joined thereto and the structure of each story of the additional precast columns can be further constructed. Such process can be repeated to increase the number of stories of the precast column array to reach a predetermined height. The above construction manner can be applied to the other precast column arrays to be set along the first direction D1 until the precast columns occupy the whole construction area B and the structure of the building is accomplished, for example as shown in FIG. 4*f*.

Figure 5A:
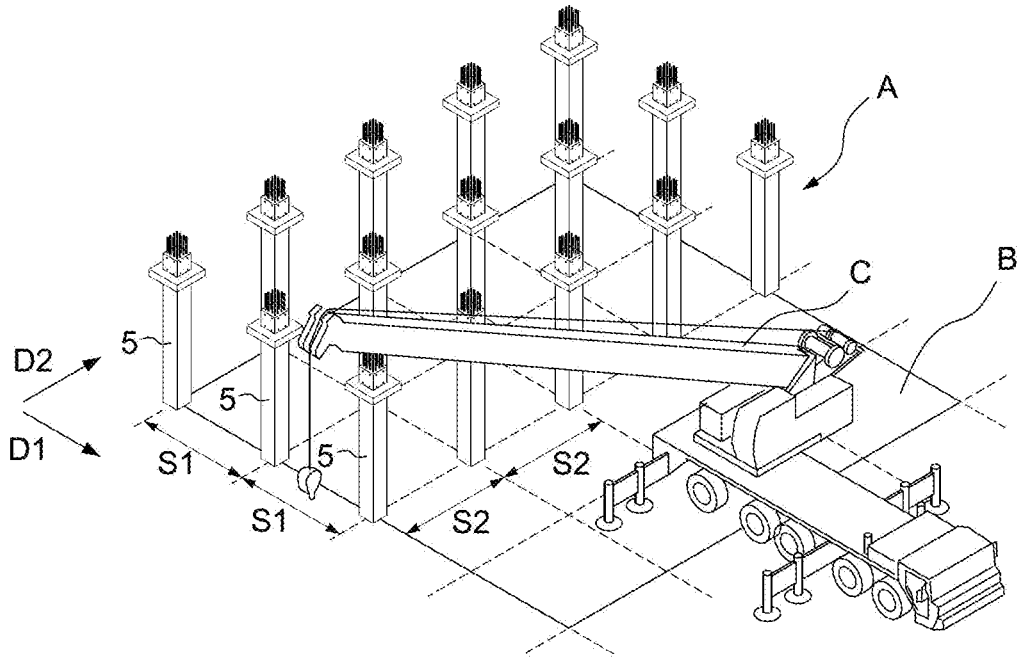
FIGS. 5*a* to 5*p* illustrate a construction method for constructing the structure of a building according to a further preferred embodiment of the invention.
Figure 5B:
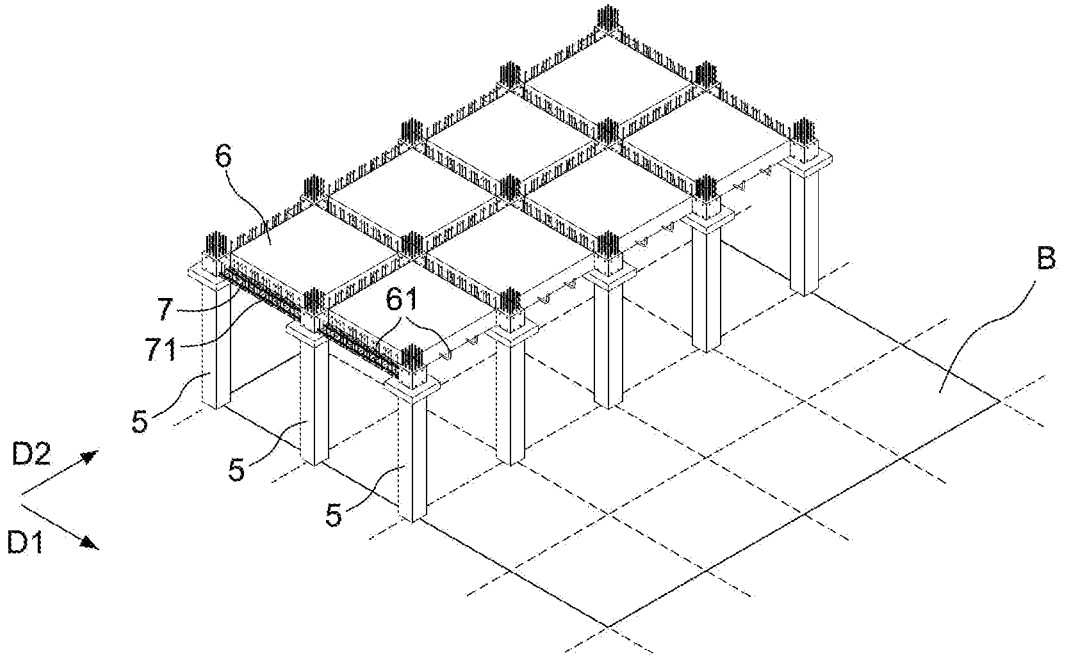
Figure 5C:
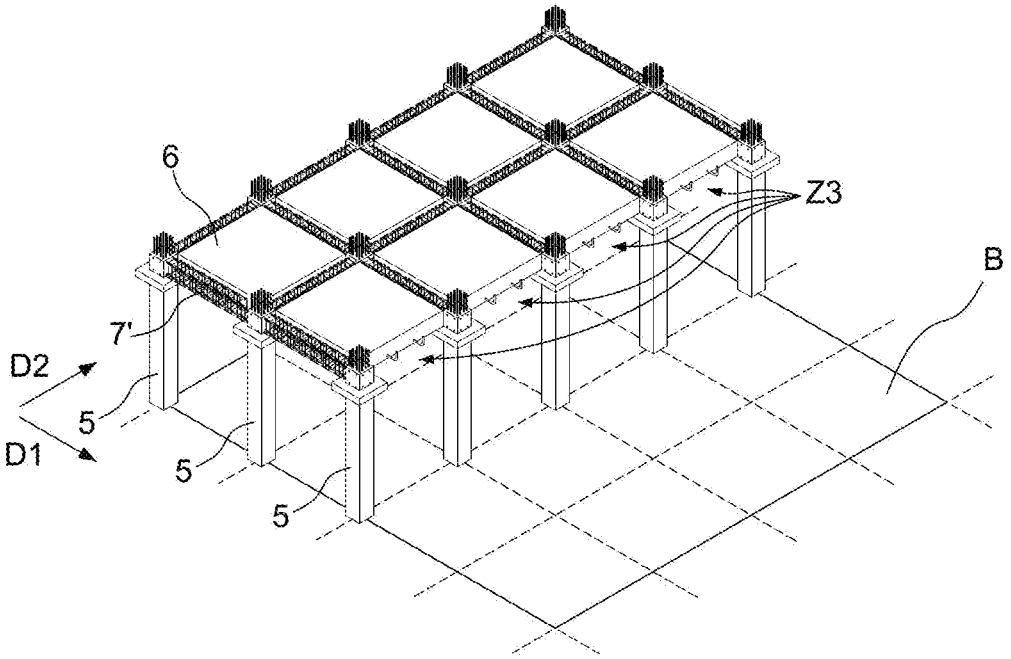
Figure 5D:
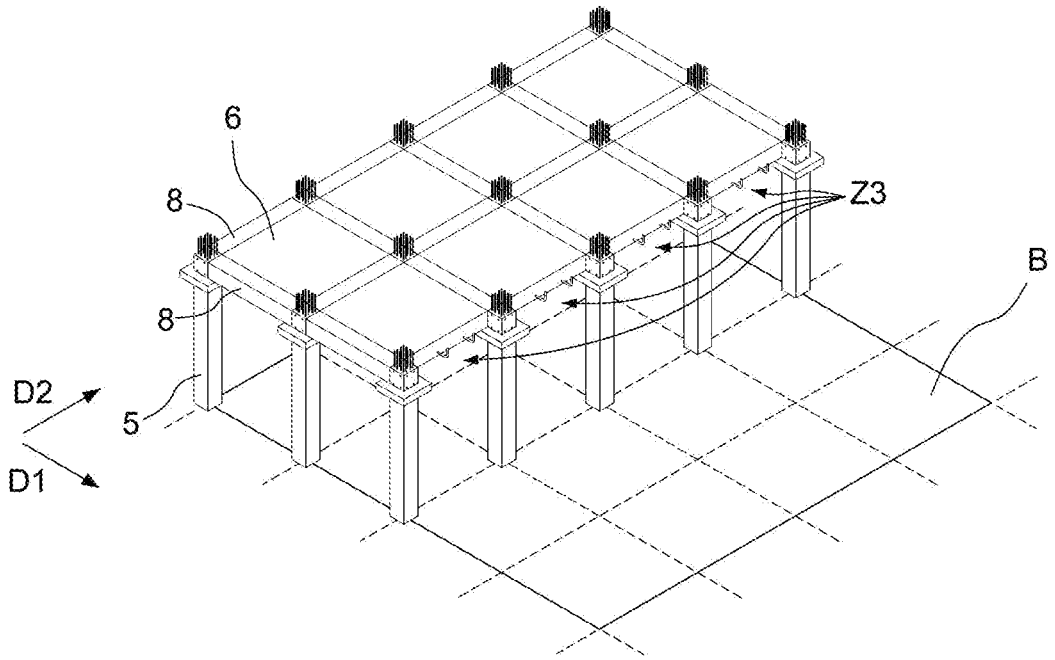
Figure 5E:
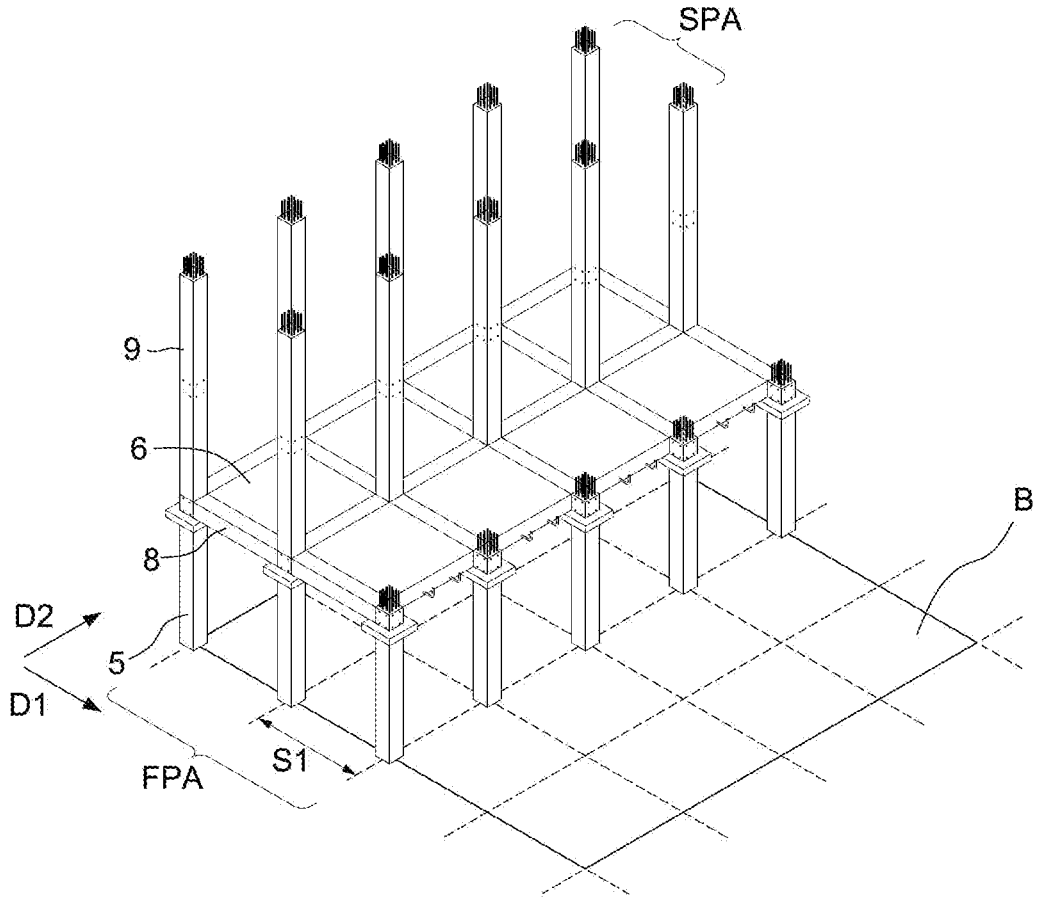
Figure 5F:
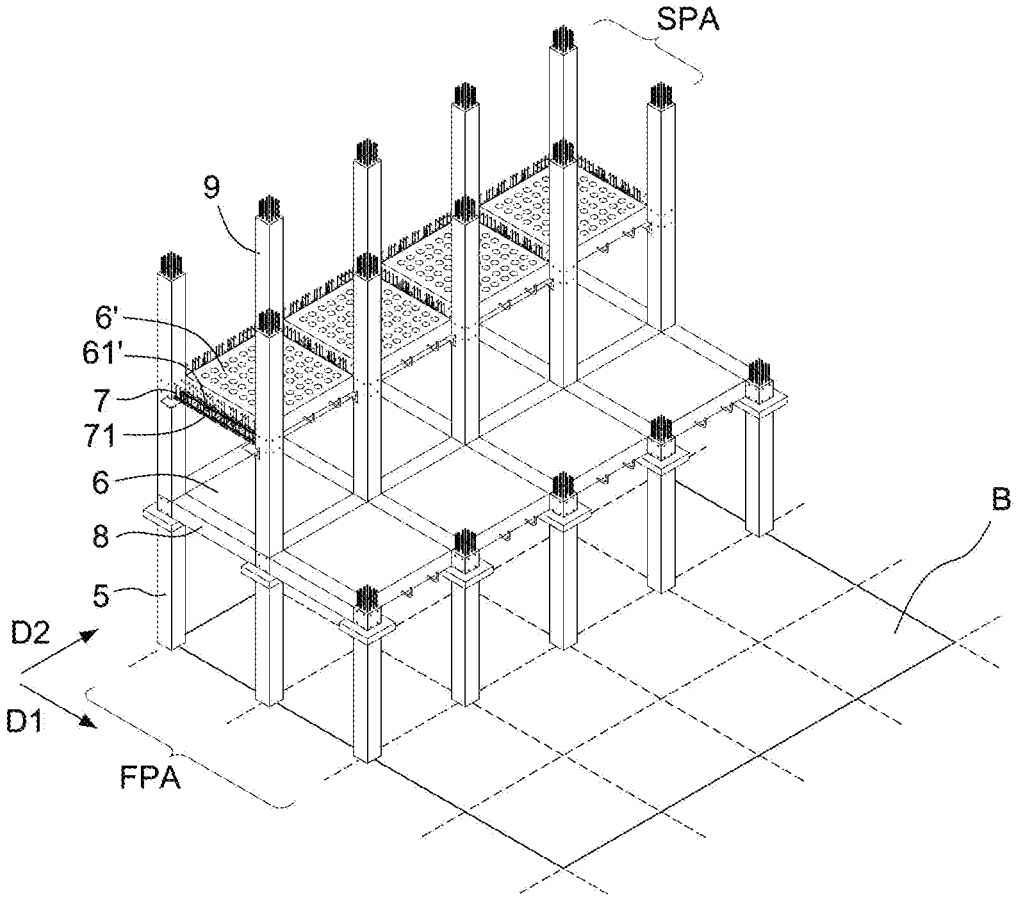
Figure 5G:
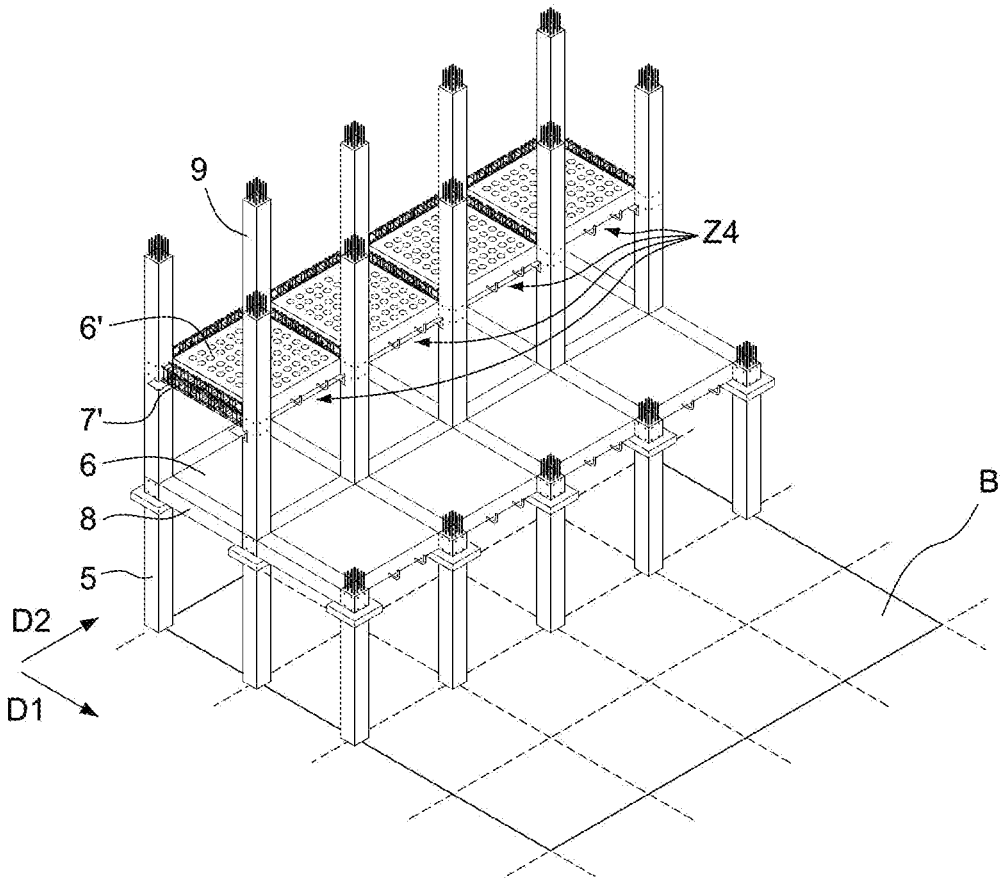
Figure 5H:
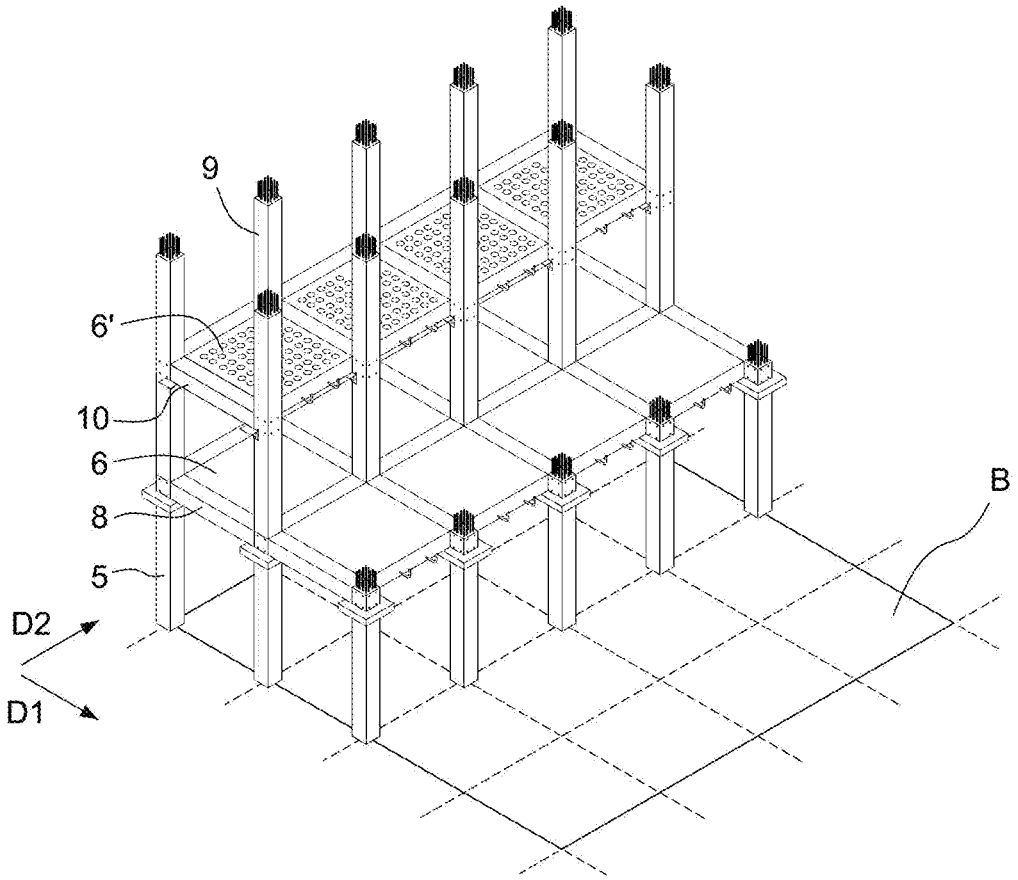
Figure 5I:
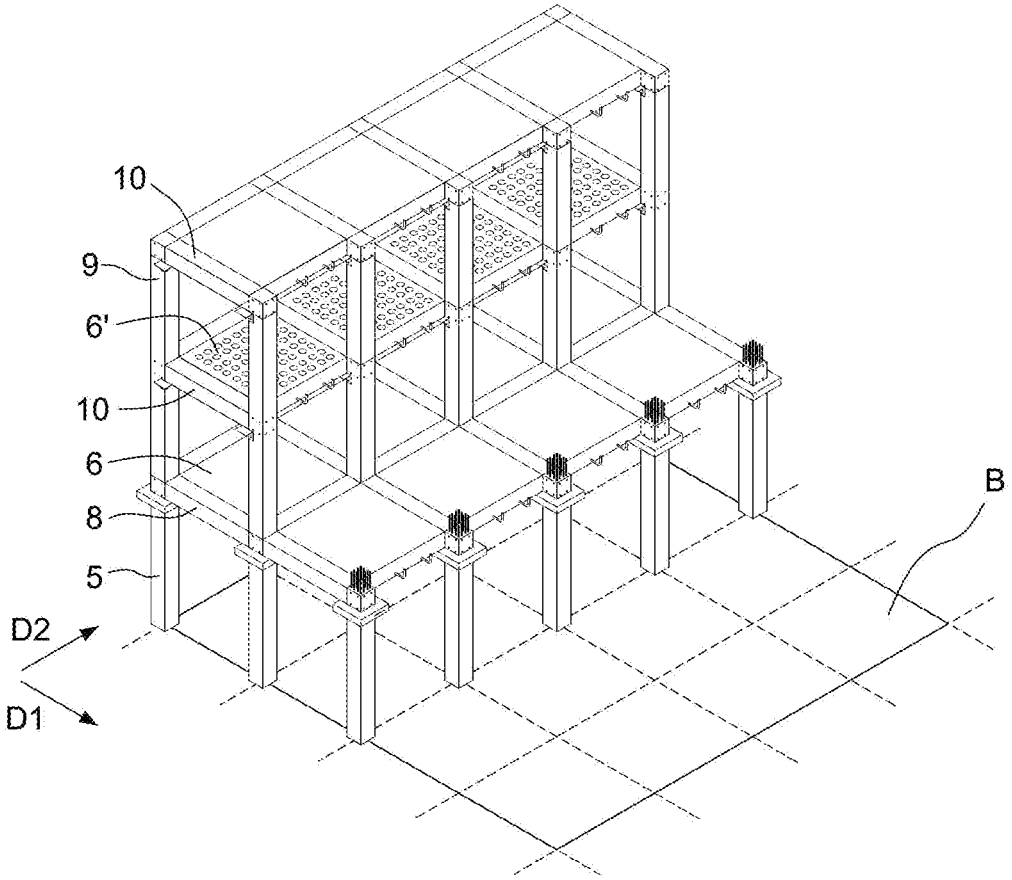
Figure 5J:
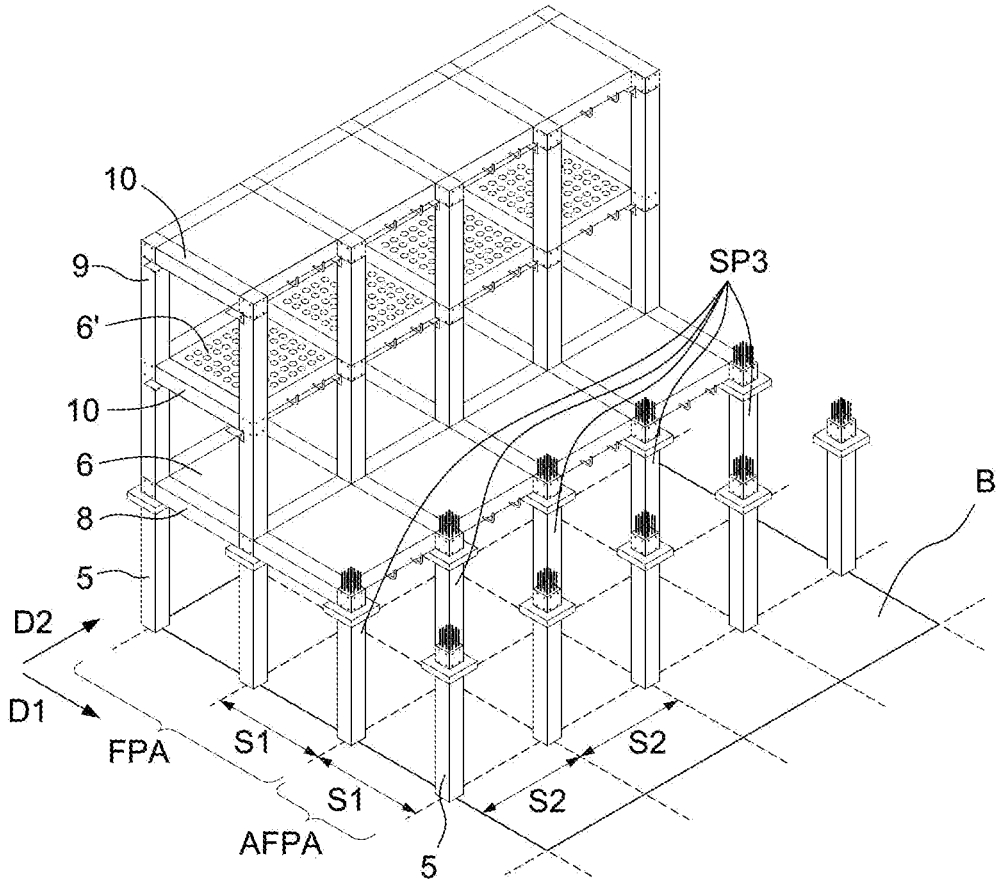
Figure 5K:
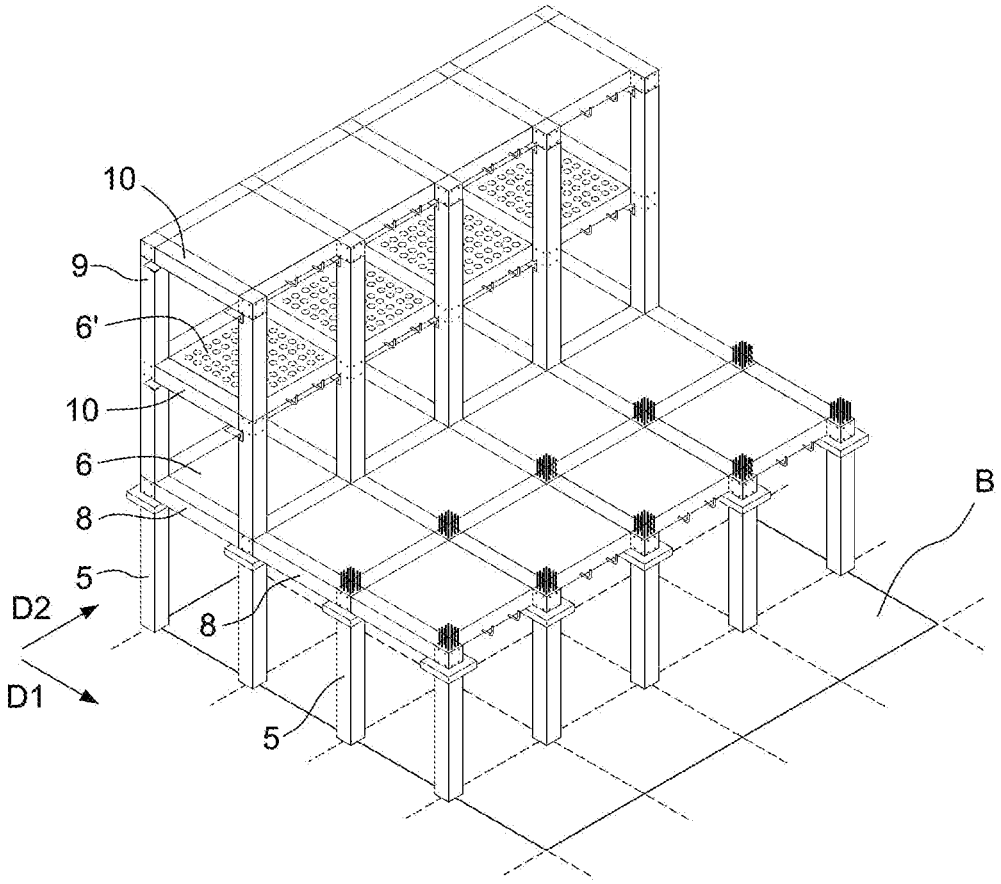
Figure 5I:
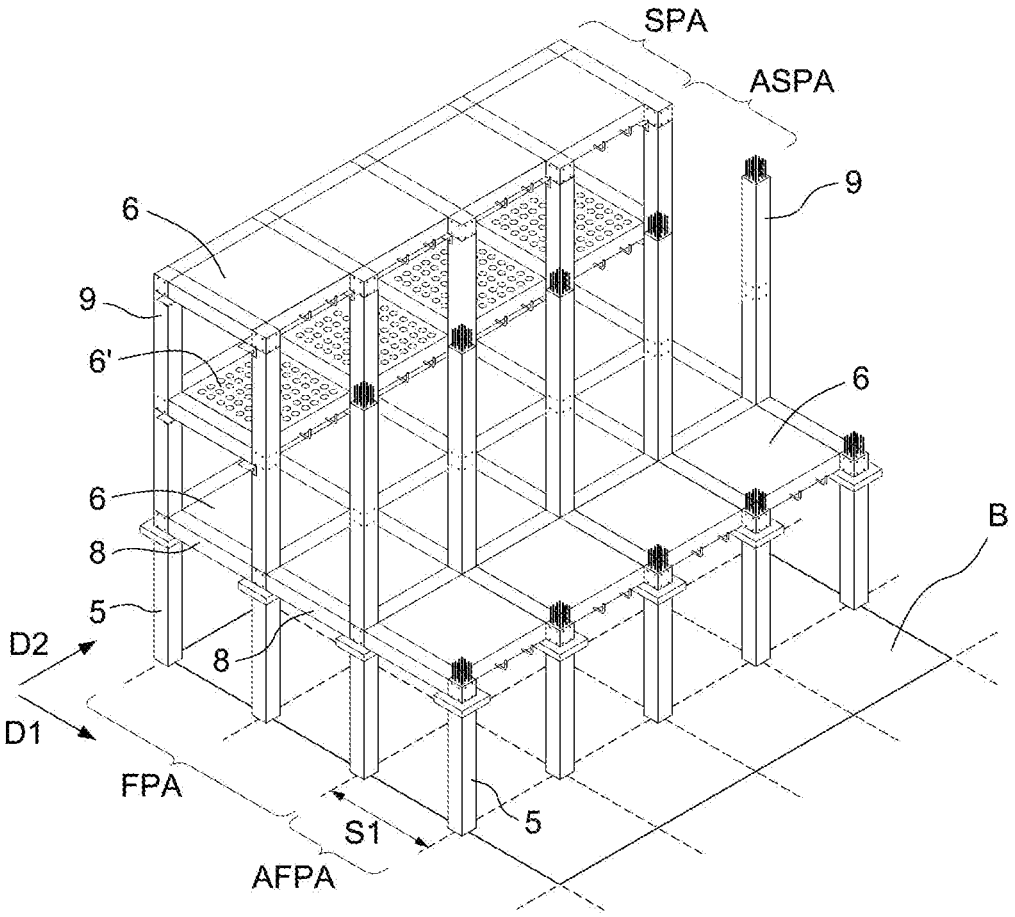
Figure 5M:
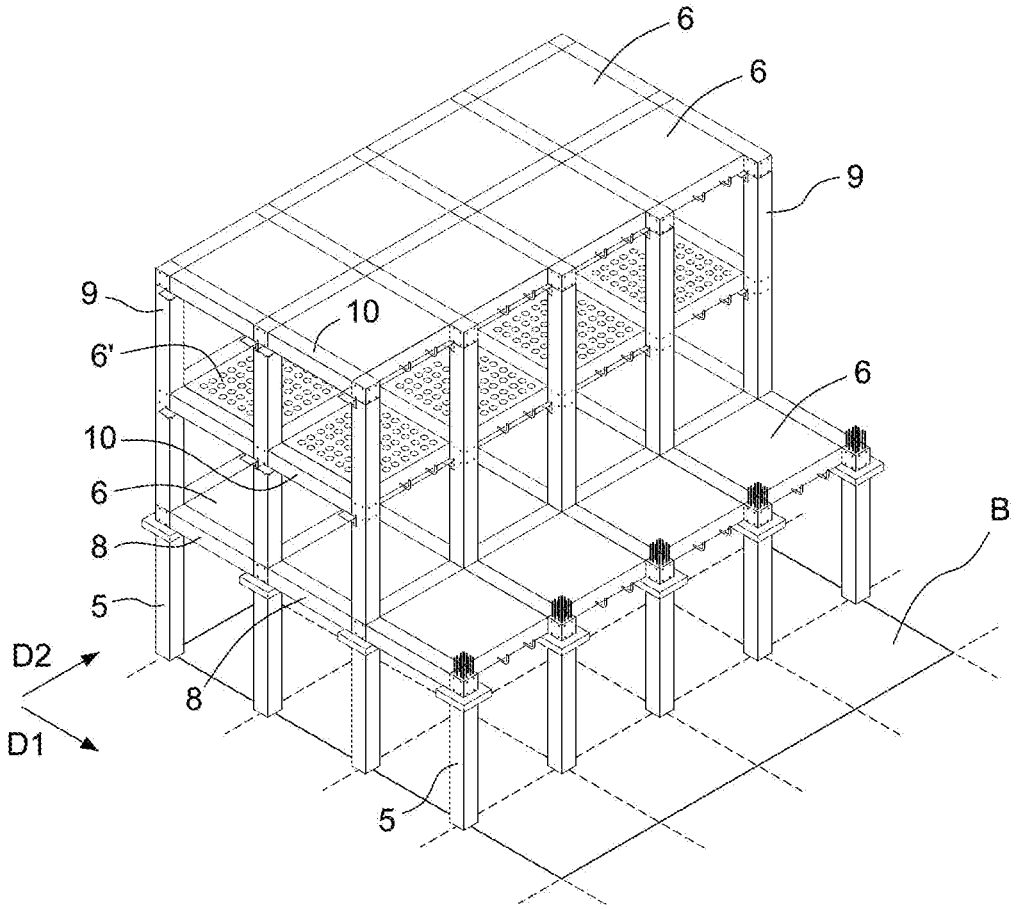
Figure 5N:
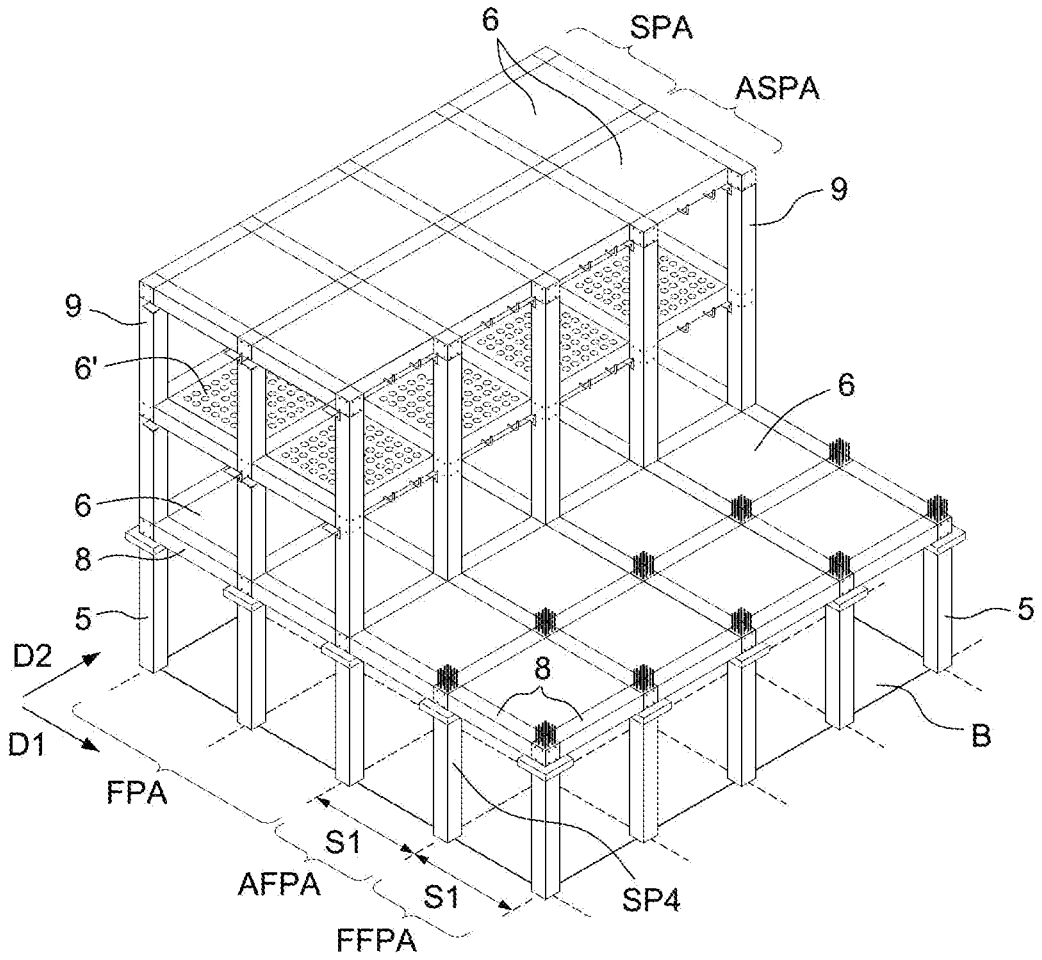
Figure 5O:
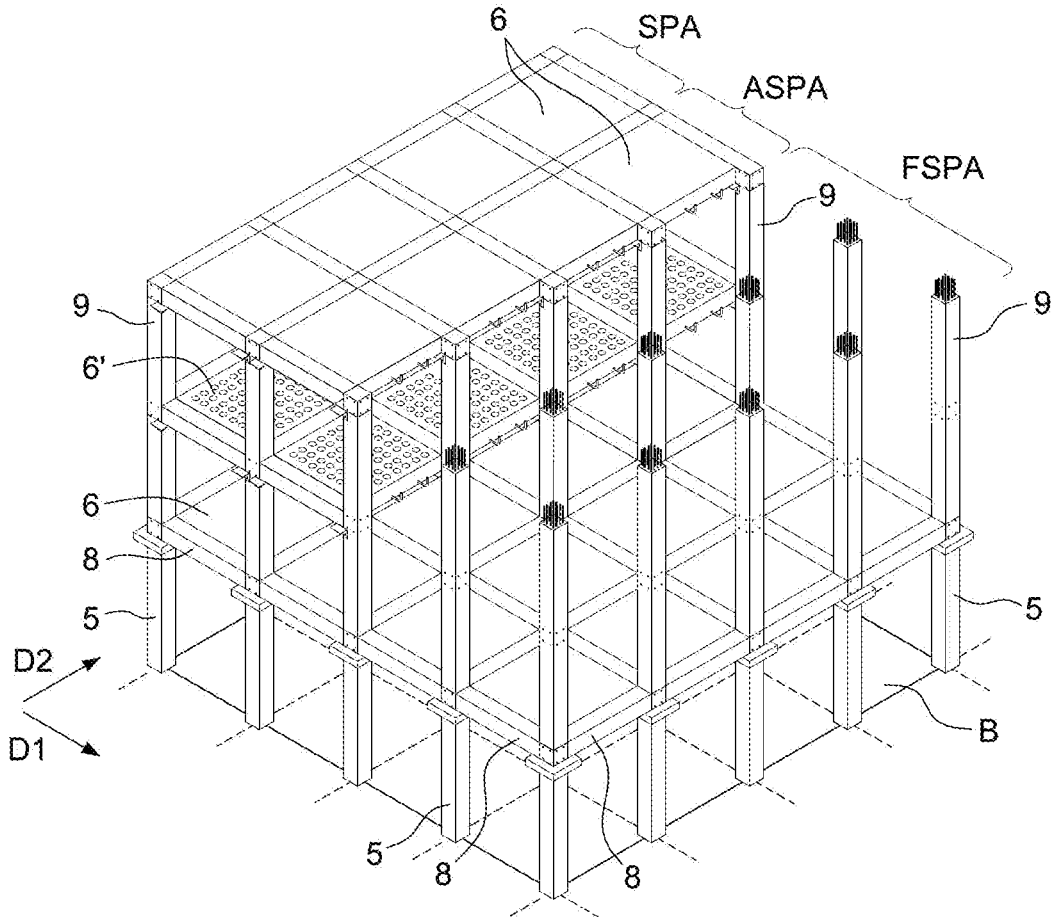
Figure 5P:
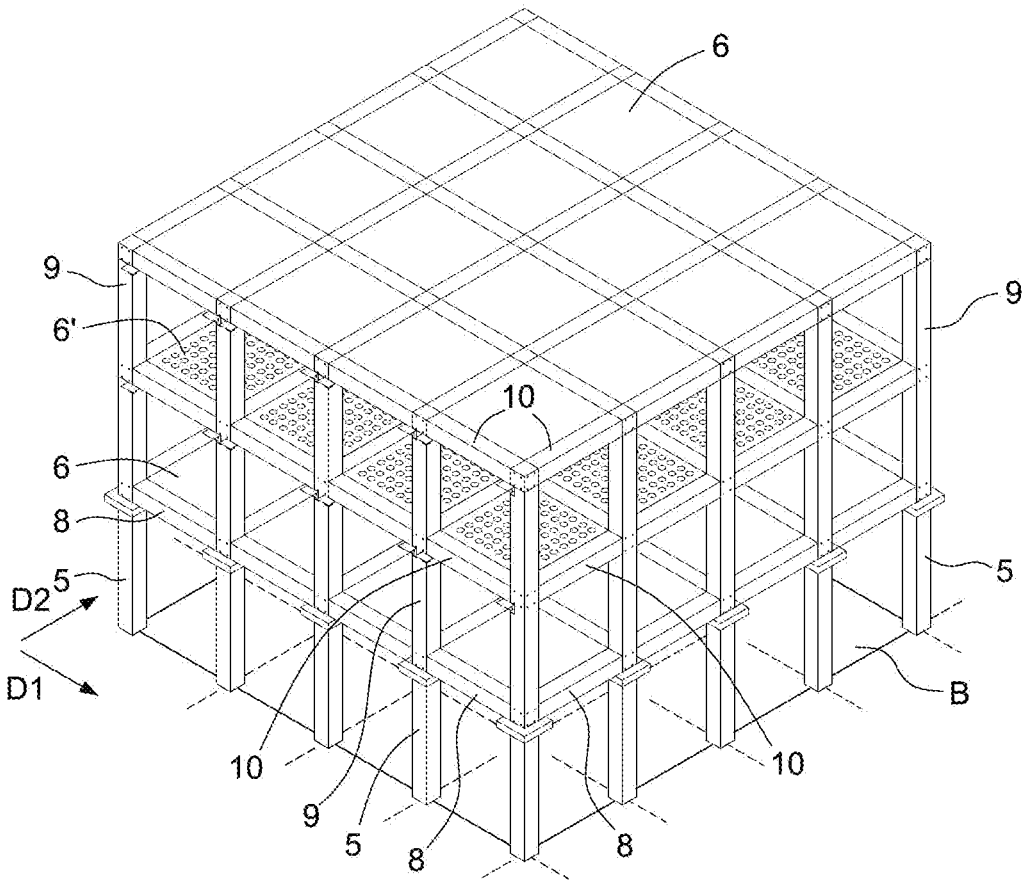

FIGS. 5*a* to 5*p* illustrate the steps of a construction method for a building according to another preferred embodiment of the invention. The grid shown in the figures illustrates the construction layout of a construction site made according to the blueprints. FIG. 1*a* shows the construction layout of the construction site A wherein the predetermined locations for hoisting and positioning the columns of the building are marked. As shown in FIG. 5*a*, the crane C hoists and positions a plurality of first precast columns 5, in accordance with the construction layout. The first precast columns 5 are placed on at least one portion of a predetermined construction area B on a construction site A to form a first precast column array having at least two spans S1 along a first direction D1 and having one or more spans S2 along a second direction D2 substantially perpendicular to the first direction D1. In the exemplary embodiment of FIG. 5*a*, four spans S2 are presented. Each of the first precast columns 5 has a height of one story. In addition, the distance of the span S1 along the first direction D1 may but does not necessarily equal that of the span S2 along the second direction D2.

After the hoisting work presented in FIG. 5*a* is finished, the step of hoisting and positioning pre-fabricated beam rebar assemblies 7 and precast slab panels 6 is performed. In FIG. 5*b*, the crane C hoists and positions a plurality of pre-fabricated beam rebar assemblies 7 so that each of them is positioned between each predetermined two adjacent first precast columns 5. Thereafter, the crane C begins to hoist and position each of a plurality of the precast slab panels 6 between each predetermined four adjacent first precast columns 5 at the working story to complete the structure shown in FIG. 5*b*.

Same as the structures presented in FIG. 2*c*, each pre-fabricated beam rear assembly 7 shown in the structure of FIG. 5*b* is bound with the main rebars 71 extending from the corresponding circumferential surfaces of the adjacent first precast columns 5 and combined with the side rebars 61 extending from the corresponding side surfaces of the adjacent slab panels 6. As shown in FIG. 5*c*, the beam rebar cages 7' between each predetermined two adjacent first precast columns 5 need to be formed after the pre-fabricated beam rebar assemblies 7 and the precast slab panels 6 are hoisted and positioned. The construction method for forming the beam rebar cage 7' is identical to that for forming the beam rebar cage 7' shown in FIG. 2*d*.

However, it should be noticed that in the step of hoisting and positioning a plurality of pre-fabricated beam rebar assemblies 7, at the locations marked Z3, although the pre-fabricated beam rebar assemblies 7 can be hoisted and positioned between any two adjacent first precast columns 5 positioned along the second direction D2 at the end of the first direction D1 of the first precast column array, no beam rebar cages 6 should be assembled at these positions. In the exemplary embodiment shown in FIG. 5*c*, no pre-fabricated beam rebar assemblies 7 or beam rebar cages 6 are placed at the positions indicated with Z3. Subsequently, as shown in FIG. 5*d*, the concrete is poured into the molds surrounding the beam rebar cages 7' between each predetermined two adjacent first precast columns 5 so that the beams 8 are formed and the structure of the working story of the first precast column array FPA is completed.

Depending on actual needs, the step of hoisting and positioning the beam rebar assemblies 7 can be exchanged in sequence with the step of hoisting and positioning the slab panels 6.

Subsequently, as shown in FIG. 5*e*, a plurality of second precast columns 9 are respectively hoisted by the crank C so as to be end-to-end jointed to the first precast columns 5 respectively to form a second precast column array SPA. The second precast column array SPA is on top of the first precast column array FPA. However, the first precast columns 5 of the first precast column array SPA positioned along the second direction D2 at the end of the first direction D1 are not jointed with the second precast columns 9, and therefore the number of spans S1 in the second precast column array SPA is one less than the number of the spans S1 of the first precast column array FPA along the first direction D1.

Thereafter, the construction work on the structure of each story of the second precast column array from the lowest story to the highest story is performed. FIGS. 5*f* to 5*i* illustrate the construction steps of the structure of each story of the second precast column array. Basically, the construction steps of the second precast column array SPA are identical to those of the embodiment shown in FIGS. 1*b* to 1*l*, that is, applying the steps of hoisting and positioning each of a plurality of pre-fabricated beam rebar assemblies 7 between each predetermined two adjacent second precast columns 9, and hoisting and positioning each of a plurality of precast slab panels 6 or 6' between each predetermined four adjacent second precast columns 9 at the working story. Of course, each pre-fabricated beam rear assembly 7 can be combined with the main rebars extending from the corresponding circumferential surfaces of the adjacent second precast columns 9 and the side rebars 61' extending from the corresponding side surfaces of the adjacent slab panels 6". By applying the construction method described previously, the construction work of hoisting and positioning the precast slab panels 6' and the pre-fabricated beam rebar assemblies 7, and assembling the structure of the beam rebar cage 7' between each two adjacent second precast columns 9 is accomplished. Subsequently, the concrete is poured into the molds surrounding the beam rebar cages 7' between each predetermined two adjacent second precast columns 9 to form beams 10 so that the structure of the second precast column array SPA at the working story is completed. Then, the structure of each story of the second precast column array SPA is completed story by story upwardly to obtain a structure shown in FIG. 5*i*.

Likewise, where indicated as Z4 in FIG. 5*g*, no beam rebar cages 7' are to be assembled between any two adjacent second precast columns 9 along the second direction D2 at the end of the first direction D1 of the second precast column array SPA, which serves as a connection area between the second precast column array SPA and the to-be-constructed next precast column array.

After the structure of the second precast column array SPA is completed, the crane C moves a distance along the first direction D1 to proceed with the construction work of the next stage. As shown in FIG. 5*j*, taking location of the precast columns 5 of the first precast column array FPA positioned at the end of the first direction D1 and along the second direction D2 as the starting points SP3, the crane C (not shown) begin to hoist and position an additional plurality of first precast columns 1 on at least one portion of the predetermined construction area B on the construction site A to form an additional first precast colon array AFPA having at least one span S1 along a first direction D1 from the starting points SP3 along a second direction D2 substantially perpendicular to the first direction D1.

Thereafter, the construction steps for the first precast column array FPA of shown in FIGS. 5*b* to 5*d* are adopted to accomplish the structure shown in FIG. 5*k*. Subsequently, as shown in FIG. 5*l*, the crane C (not shown) will further hoist and position a plurality of second precast columns 9 so that they are respectively end-to-end jointed to the precast columns 5 of the first precast column array FPA to from the additional second precast column array ASPA. Specifically, the first additional precast columns 5 of the additional first precast column array AFPA positioned along the second direction D2 at the end of the first direction D1 are not jointed with the second precast columns 9, and therefore the number of the spans S1 of the second precast column arrays (SPA, ASPA) is one less than the number of the spans S1 of the first precast column arrays (FPA, AFPA) along the first direction D1.

Thereafter, as shown in FIG. 5*m*, the construction work on the structure of each story of the additional second precast column array ASPA from the lowest story to the highest story thereof is accomplished by repeating the construction steps shown in FIGS. 5*f* to 5*i*. Subsequently, the crane C (not shown) moves a further distance along the first direction D1 to proceed with the construction work of the next stage. As shown in FIG. 5*n*, taking location of the precast columns 5 of the additional first precast column array AFPA positioned at the end of the first direction D1 and along the second direction D2 as the starting points SP4, the crane C begin to hoist and position a further plurality of first precast columns 5 on at least one portion of the predetermined construction area B on the construction site A to form a final first precast column array FFPA having at least one span S1 along a first direction D1 from the starting points SP4 along a second direction D2 substantially perpendicular to the first direction D1. As shown in FIG. 5*n*, the construction work for the final first precast column array FFPA is accomplished according to the construction steps for the original first precast column array shown in FIGS. 5*b* to 5*d*. It should be noticed that, in FIG. 5*n*, the first precast columns 5 occupy the whole predetermined construction area B and there will be no next first precast column array, the construction steps of hoisting and positioning the pre-fabricated beam rebar assemblies 7, accomplishing the structure of the beam rebar cages 7', and pouring concrete into the molds surrounding the beam rebar cages 7' to form the beams 8, will also be performed between any two adjacent precast columns positioned along the second direction D2 at the end of the first direction D1 while proceed with relevant construction steps of the same working story.

Thereafter, as shown in FIG. 5*o*, the crane C (not shown) will further hoist and position a plurality of precast columns 9 so that they are respectively end-to-end jointed to each of the below first precast columns 5 to from a final second precast column array FSPA. Thereafter, the construction work on the structure of each story of the further second precast column array from the lowest story to the highest story thereof proceeds by repeating the construction steps shown in FIGS. 5*f* to 5*i*.

Likewise, as there will be no next second precast column array, the construction steps of hoisting and positioning the pre-fabricated beam rebar assemblies 7, accomplishing the structure of the beam rebar cages 7', and pouring concrete into the molds surrounding the beam rebar cages 7' to form the beams 8, will also be performed between any two adjacent precast columns positioned along the second direction D2 at the end of the first direction D1. The building thus ultimately accomplished is shown in FIG. 5*p*.

The technical concept disclosed in the embodiment shown in FIGS. 5*a* to 5*p* is that the structure of the building is created along the first direction D1. Prior to that the first columns 5 have fully occupied the predetermined construction area B, the construction steps illustrated in FIGS. 5*j* to 5*m* will be performed to increase the structural body along the first direction D1, and the final construction steps shown in FIGS. 5*n* to 5*p* will be performed after the first precast columns 5 have fully occupied the predetermined construction area B.

Figure 6A:
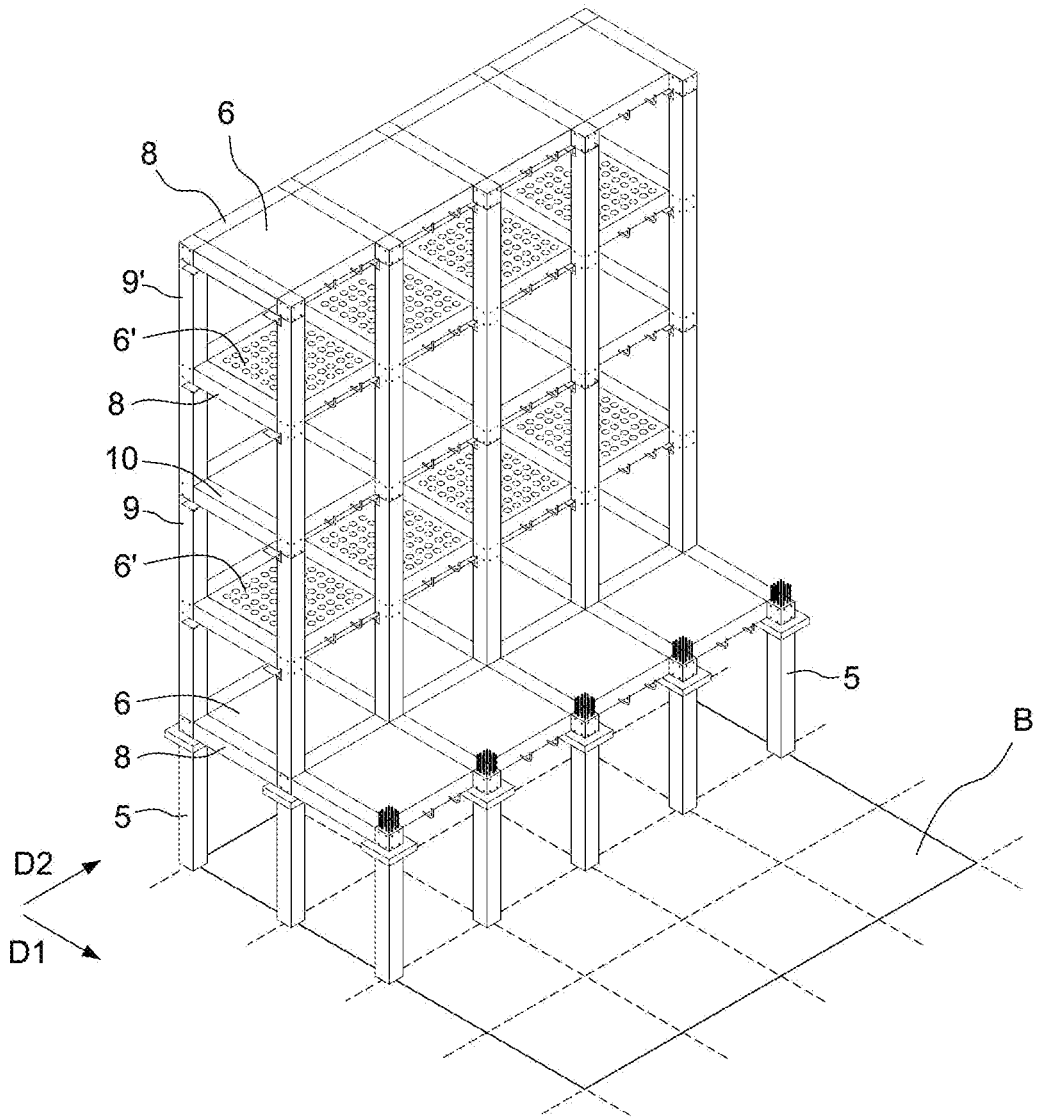
FIG. 6*a* illustrates an exemplary structure of jointed precast column array based on the structure of the precast column array shown in FIG. 5*i;*

Based on the technical concept disclosed in the construction method illustrated in FIGS. 4*a* to 4*e*, the embodiment of the construction method disclosed in FIGS. 5*a* to 5*n* can be varied so as to increase the height (or the total stories) of the building. For example, after the construction work shown in FIG. 5*i* (i.e., the structure of each story of the original second precast column array is accomplished), another plurality of precast columns 9' having one or more stories can be respectively end-to-end jointed to each of the second precast column 9 to form a jointed second precast column array. Subsequently, the construction steps described above are adapted to each story of the jointed second precast column array to obtain the structure shown in FIG. 6*a*, and then the construction step shown in FIG. 5*j* is followed. In one embodiment, additional precast columns having specific stories can be further end-to-end jointed to the precast columns 9' respectively, and then the same construction steps are repeated to accomplish the structure of each story thereof. By repeating such process, stories can be added until a predetermined height is reached.

Figure 6B:
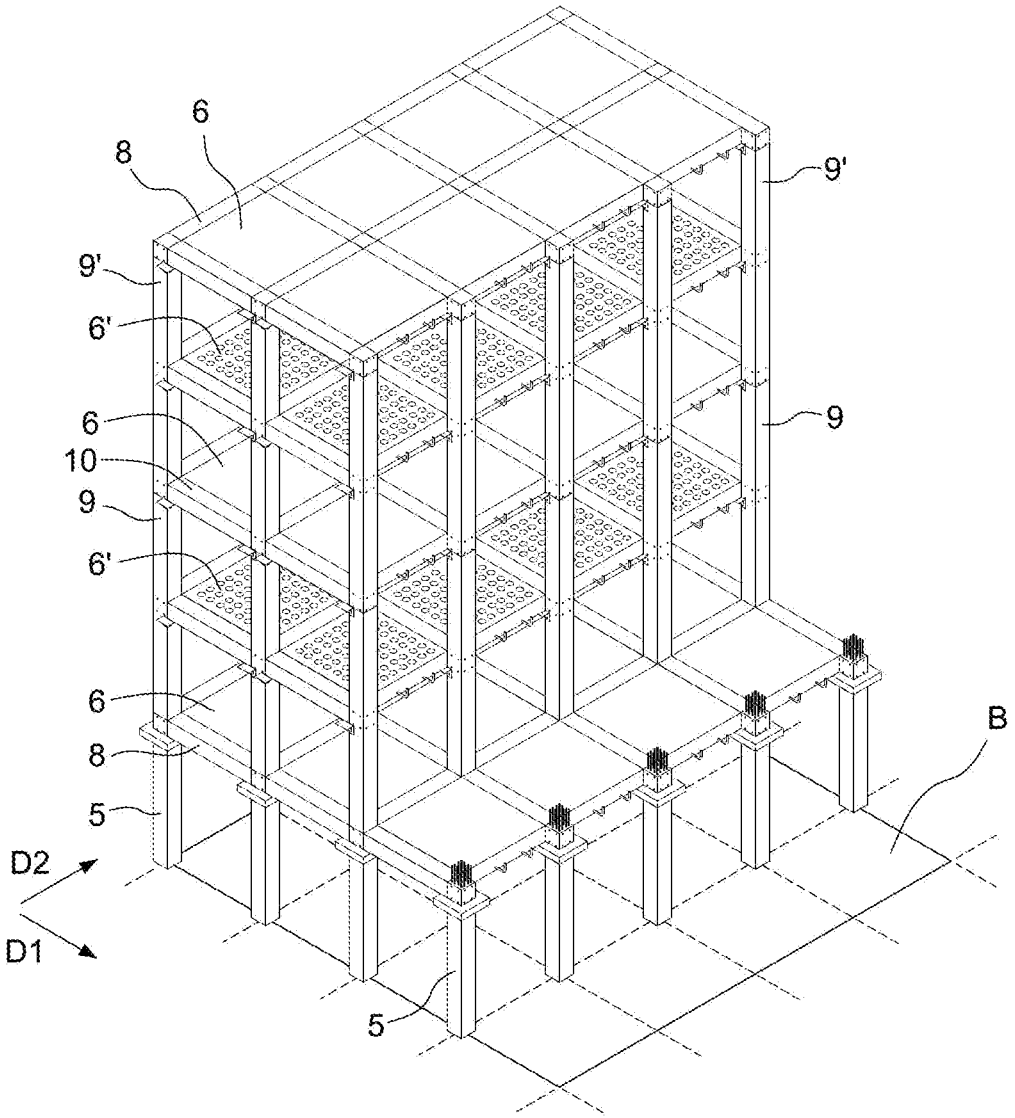
FIG. 6*b* illustrates an exemplary structure of jointed precast column array based on the structure of the precast column structure shown in FIG. 5*m;*

Likewise, in one embodiment, after the construction work shown in FIG. 5*m* (i.e., the structure of each story of the additional second precast column array ASPA is accomplished), another plurality of precast columns 9' having one or more stories can be respectively end-to-end jointed to each of the second precast columns 9 to form a jointed additional second precast column array. Subsequently, the construction steps described above are applied to each story of the jointed additional second precast column array to obtain the structure shown in FIG. 6*b*, and then the construction step shown in FIG. 5*n* is followed. If necessary, additional precast columns of specific height can be further jointed to the precast columns 9' respectively, and then construction steps are repeated to accomplish the structure of each story. By repeating such process, stories can be added a predetermined height is reached, and then the construction step shown in FIG. 5*n* is followed.

Figure 6C:
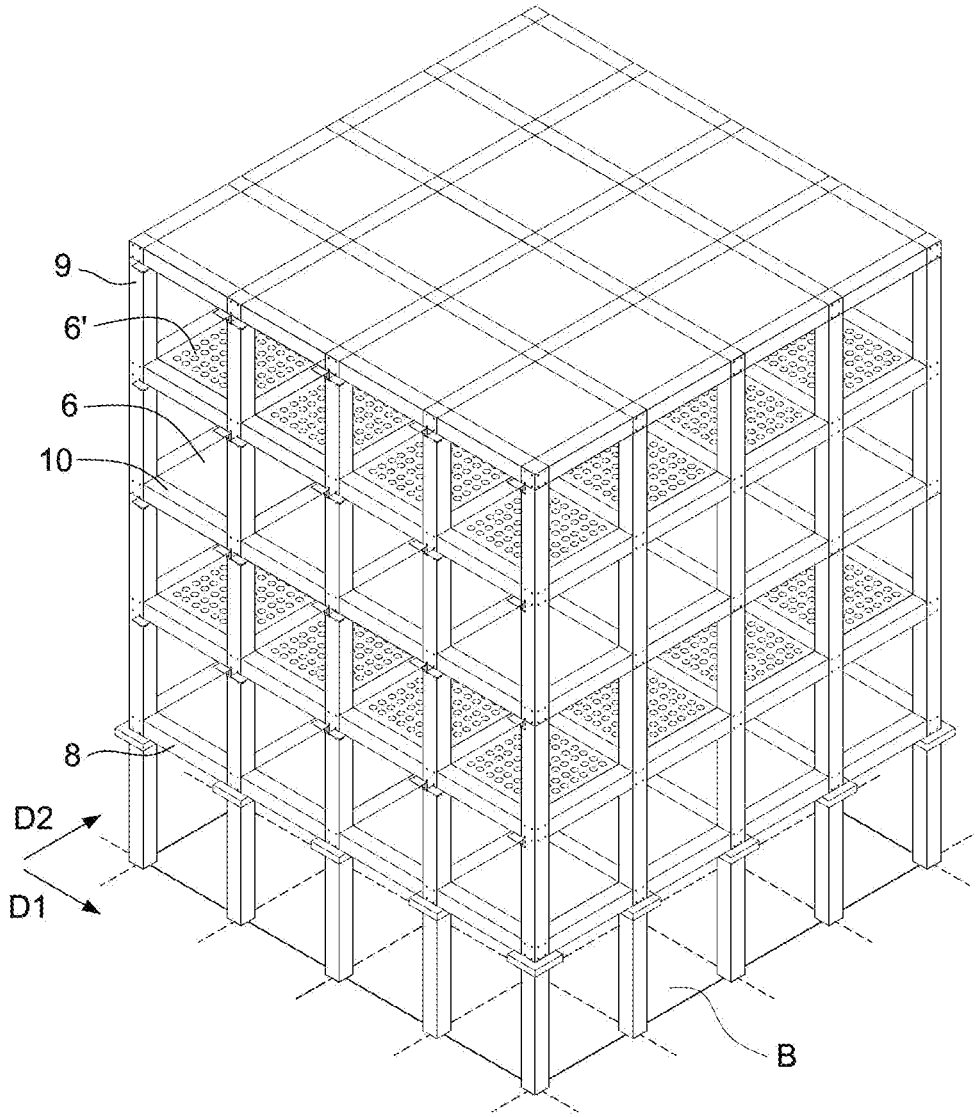
FIG. 6*c* illustrates an exemplary structure of jointed precast column array based on the structure of the precast column structure shown in FIG. 5*n;*

Before the precast columns 5 occupy the whole predetermined area B and while it is still necessary to increase the structural body along the first direction D1, the construction steps (including respectively jointing another precast columns 9' having one or more stories in height to each second precast column 9 of latest second precast column array to form another jointed second precast column array, and accomplishing the structure of each story of the another jointed second precast column array story by story) can proceed each time after the construction steps of FIGS. 5*j* to 5*m* are repeated. After the precast first columns 5 have been hoisted and positioned to occupy the whole predetermined construction area B, the construction steps shown in FIGS. 5*n* to 5*p* will proceed in order to finalize the construction work on the building. Moreover, after the structure shown in FIG. 5*p* is accomplished, another precast columns 9' having one or more stories can be jointed to each of the rest of the second precast columns 9 of the last second precast column array and the structure of each story of the jointed second precast column 9 can be accomplished story by story to obtain the building shown in FIG. 6*c*.

In one embodiment, the precast column 5 of the first precast column array FPA as illustrated in FIGS. 5*a* to 5*p* and FIGS. 6*a* to 6*c* has a single story and has a beam-column connection section 11 identical to that of the precast column 1 as shown in FIG. 2*a*. The precast column 5 also comprises a support portion as shown in FIG. 2*b*. Meanwhile, the combination manner of the main rebars extending from the beam-column connection section of the precast column 5 with the side rebars extending from the precast slab panels 6 (or 6') and the pre-fabricated beam rebar assemblies to form a beam rebar cage 7' is identical to that shown in FIG. 2*d*. Furthermore, as the precast column 5 has a single story, the support portion 131 can be pre-formed or pre-mounted to the precast column 5 under the beam-column connection section 11 thereof. The configuration of the support portion 131 can be identical but not limited to the precast RC structure shown in FIG. 2*a* or the corner brackets 131*a* shown in FIG. 3.

The structures of the support portion and the beam-column connection section of each story of the precast column 9 of the second precast array or the precast column 9' to be jointed to the precast column 9 are identical to the corresponding structures of the support portion 131, 131*a* and the beam-column connection section 11 of the precast column 1 as shown in FIG. 2*a*. It should be noted that except for the lowest story, a support portion 131 should not be pre-mounted or pre-formed to the precast column 9 or each precast column 9' so that the hoisting and positioning work on the slab panels 6, 6' at the working story will not be hindered by the protruding support portions 131, 131*a*. In other words, for these stories, the support portion 131, 131*a* can be mounted to the story of the precast column 9 or the precast column 9' only after the construction work of hoisting and positioning the slab panel 9 at the corresponding immediate lower story has been accomplished. The configuration of the support portion 131 of the precast column 9 or the precast column 9' can be identical but is not limited to the precast RC structure shown in FIG. 2*a* or the corner brackets 131*a* shown in FIG. 3.

The precast columns 1 and 9 and the precast columns 1' and 9' for end-to-end jointing to the precast columns 1 and 9 in some embodiments may cover a plurality of stories. According to the above-described preferred embodiments, each of the precast columns 1 extends through the same number of stories as the others, and so does each of the precast columns 9, each of the precast columns 1' and each of the precast columns 9'. Therefore, the building made according to the above preferred embodiments presents a regular cubic structure. However, in some other embodiments, due to space limitations, each of the precast columns 1 may extend through a number of stories different from those of the others, and so may each of the precast columns 9, each of the precast columns 1' and each of the precast columns 9'. For example, if the building to be constructed is very large or certain industrial equipment to be used therein is extremely heavy, the precast main columns for supporting the whole building may need to be enhanced and their locations may need to be located at a predetermined construction area. Therefore, the precast main columns (or jointed precast main columns) at these locations may require a greater height or cross-section with respect to the rest of the precast columns. Furthermore, if the building to be constructed is not of a regular cubic structure and/or has a convex or a concave shape at certain locations, such a building can be accomplished by changing the number of stories to be covered by the above-mentioned precast columns in certain locations.

It should be noted that the precast slab panels as disclosed in the above embodiments can be precast floor panels 2 and 6, or the precast waffle slabs 2' and 6' having venting holes. The choice of hoisting and positioning precast floor panels or precast waffle slabs at a specific area or specific position of the building depends on the actual need or the required usage. For example, if the building is a high-tech plant, some or all of the precast slab panels can use precast waffle slabs with venting holes therein.

Figure 7A:
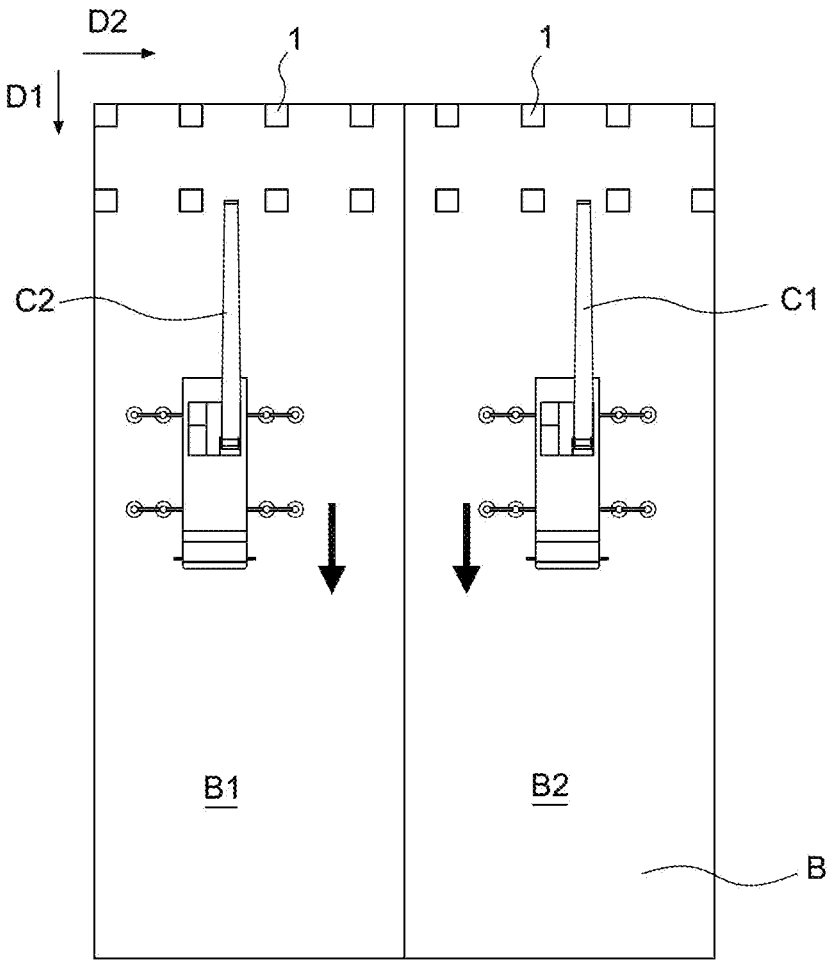
FIGS. 7*a* to 7*c* respectively illustrate exemplary construction methods for constructing a building with the use of a plurality of cranes.
Figure 7B:
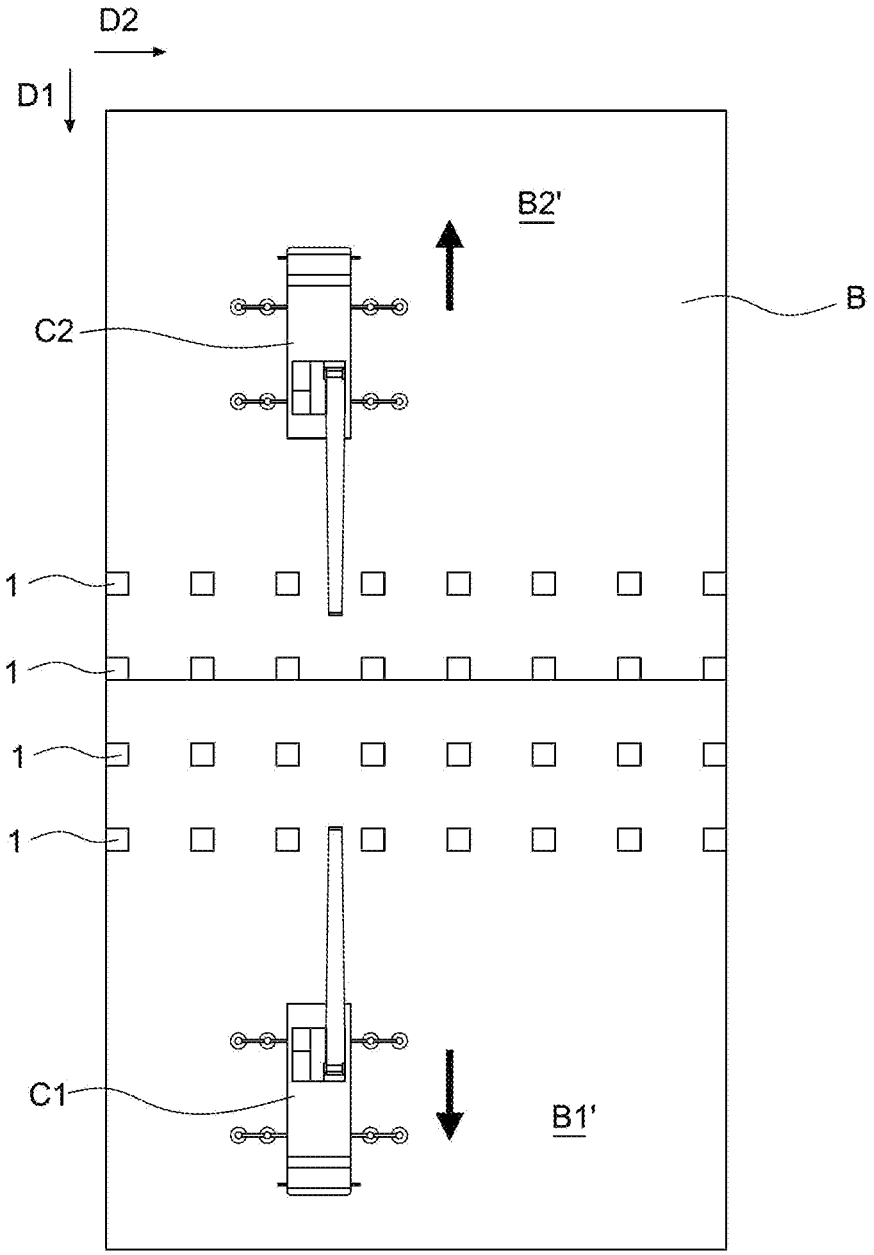
Figure 7C:
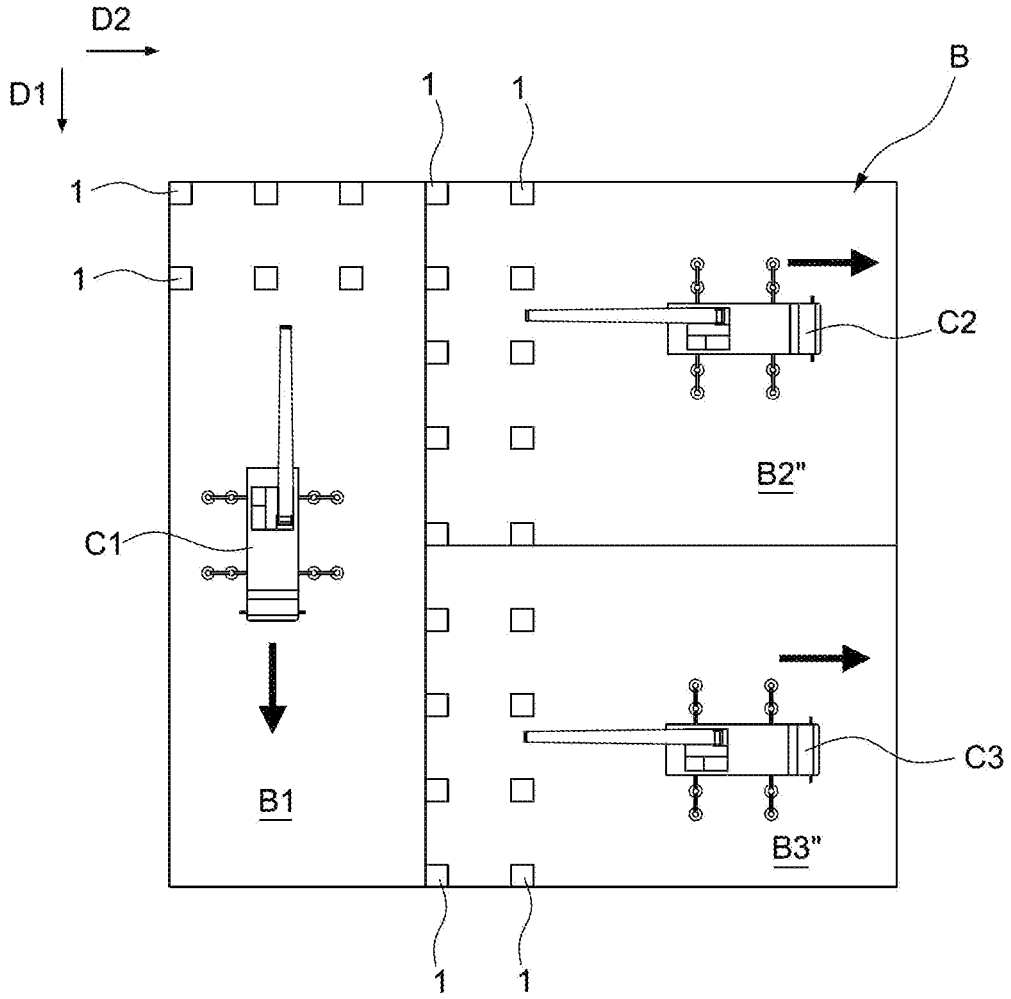

Moreover, the embodiments as disclosed above relate to exemplary applications of constructing a building with a crane C at a construction site. They are for illustrative purposes only. For example, in order to rapidly complete the building(s) in a large predetermined construction area, the predetermined construction area can be divided into several sub-construction areas, and the construction work on each sub-construction area can be done by one or more cranes C so as to speed up the process. For example, in FIG. 7*a*, the predetermined construction area B on the construction site A can be divided into sub-construction areas B1 and B2 along the second direction D2, and two cranes C1 and C2 can be responsible for the construction of a part of the building along the first direction D1 respectively on the sub-construction areas B1 and B2 to speed up the construction work. In FIG. 7*b*, the predetermined construction area B on the construction site A can be divided into sub-construction areas B1' and B2' along the first direction D1, and two cranes C1 and C2 can respectively conduct the construction work at both sides of the boundary line of the sub-construction areas B1 and B2. Each of them constructs a part of the building along the first direction D1. For a very large predetermined construction area B, more cranes are required. In FIG. 7*c*, the predetermined construction area B is divided into sub-construction areas B1", B2" and B3". The crane C1 is responsible for the construction work on the sub-construction B1" along the first direction D1. The crane C2 is responsible for the construction work on the sub-construction area B2" along the first direction D1 at the intersection boundary of the areas B1" and B2". The crane C3 is responsible for the construction work on the sub-construction area B3 along the first direction D1 at the intersection boundary of the areas B1" and B3". In this way, the construction work on the building can be rapidly accomplished.

In contrast to the conventional construction method, such as constructing the building story by story on the whole predetermined construction area, the method provided by the embodiments of the subject invention are able to reasonably and efficiently arrange the routes for the construction work such as hoisting the structure, shipping construction materials, or labor working routes, and to rapidly finish the construction work to shorten the time required for construction. Moreover, for high-tech plants (such as a FAB) adopting the construction method of the embodiments of the subject invention, the subcontractor for constructing the clean room is able to proceed with relevant work after a certain portion of the building (such as one particular precast column array) is accomplished so as to further speed up the construction of the plant. In this way, the goal of fast construction of high-tech plants can be achieved.

The embodiments as described above only serve the purpose of explaining the technical concept of the subject invention so that a person with general knowledge in the field is able to understand the subject invention and practice it. The above descriptions are not intended to limit the subject invention and any variation or modification based on the spirit of the subject invention should be deemed within the scope of the following claims.

What is claimed is:

1. A method for constructing a building, the method comprising the steps of:

(a) hoisting and positioning a plurality of precast columns covering at least one story of the building on at least one portion of a predetermined construction area on a construction site to form a precast column array having at least two spans along a first direction and having one or more spans along a second direction substantially perpendicular to the first direction;

(b) hoisting and positioning a plurality of pre-fabricated beam rebar assemblies so that each of the plurality of pre-fabricated beam rebar assemblies is positioned between each predetermined two adjacent precast columns; and further hoisting and positioning a plurality of precast slab panels so that each of the plurality of precast slab panels is positioned between each predetermined four adjacent precast columns, and then completing a beam rebar cage between each predetermined two adjacent precast columns;

(c) pouring concrete into molds surrounding the beam rebar cages to form a beam between each predetermined two adjacent precast columns;

(d) repeating step (b) to step (c) at a subsequent story immediately above until the construction work of step (b) to step (c) at a highest story covered by the precast columns is completed, and then proceeding with step (e);

(e) taking the precast columns positioned at the end of the first direction and along the second direction as the starting points of the span along the first direction to repeat step (a) to step (d) until the construction work of the precast columns and the precast slab panels occupying the whole predetermined construction area is completed.

2. The method of claim 1, wherein before the precast columns are hoisted and positioned to cover the whole predetermined construction area, no beam rebar cage is assembled between any two adjacent precast columns positioned along the second direction at the end of the first direction when proceeding with step (b).

3. The method of claim 2, wherein the cross-section of the precast columns is rectangular, and wherein a support portion transversely protrudes a length from circumferential surfaces under a beam-column connection section of a lowest story of each of the precast columns, wherein the support portion is used for supporting a portion of each of the precast slab panels or a portion of each of the pre-fabricated beam rebar assemblies disposed adjacent to each of the precast columns.

4. The method of claim 3, wherein the support portion comprises a plurality of corner brackets pre-mounted to a plurality of corners of each of the precast columns and located under the beam-column connection section of the lowest story thereof, and each of the plurality of corner brackets transversely protrudes the length from the adjacent circumferential surfaces of a corresponding corner to support a portion of a corresponding precast slab panel or to support a portion of corresponding pre-fabricated beam rebar assemblies.

5. The method of claim 1, further comprising the following step between step (b) and step (c) or between step (c) and step (d):

mounting a next support portion to each of the precast columns under a next beam-column connection section of the subsequent story immediately above, said next support portion transversely protruding a length from the circumferential surfaces of each of the precast columns, wherein said next support portion is used for supporting a portion of each of the to-be-hoisted precast slab panels or a portion of each of the to-be-hoisted pre-fabricated beam rebar assemblies at the subsequent story immediately above.

6. The method of claim 5, wherein said next support portion comprises a plurality of corner brackets pre-mounted to a plurality of corners of each of the precast columns under the beam-column connection section of the next story thereof, wherein each of the plurality of corner brackets transversely protrudes the length from the adjacent circumferential surfaces of a corresponding corner to support a portion of a corresponding precast slab panel or support a portion of corresponding pre-fabricated beam rebar assemblies.

7. The method of claim 1, wherein in step (b) a plurality of through holes are correspondingly and respectively formed in the circumferential surfaces of each of the predetermined two adjacent precast columns opposite each other at a beam-column connection section, and a main rebar is inserted into each of the plurality of the holes formed in the surface of one of the adjacent two precast columns, wherein the main rebar extends horizontally to partially overlap with a corresponding main rebar inserted into a corresponding through hole in the opposite surface of the other one of the adjacent two precast columns.

8. The method of claim 7, wherein in step (b) each of the pre-fabricated beam rebar assemblies is bound with some or all of the main rebars extending from the through holes of each corresponding predetermined two adjacent precast columns for forming a part of the beam rebar cage between each corresponding predetermined two adjacent precast columns.

9. The method of claim 8, wherein each side surface of each of the plurality of the precast slab panels has a plurality of side rebars protruding therefrom, and wherein in step (b) the side rebars extending from the side surface of the slab panel adjacent to a corresponding predetermined two adjacent precast columns are combined with some or all of the main rebars extending from the through holes of each of the corresponding predetermined two adjacent precast columns.

10. The method of claim 1, wherein some or all of the plurality of slab panels are waffle slabs having a plurality of venting holes therein.

11. The method of claim 10, further comprising proceeding with step (f) after the completion of step (d) and prior to step (e), wherein step (f) comprises end-to-end jointing each of another plurality of precast columns extending one or more stories to each of the plurality of precast columns to form a jointed precast column array; repeating step (b) to step (f) until the construction of the predetermined stories of the building is completed, and then proceeding with step (e).

12. A method for constructing a building, the method comprising the steps of:

(a) hoisting and positioning a plurality of first precast columns that are one story tall onto at least one portion of a predetermined construction area on a construction site to form a first precast column array having at least two spans along a first direction and having one or more spans along a second direction substantially perpendicular to the first direction;

(b) hoisting and positioning a plurality of pre-fabricated beam rebar assemblies so that each of the plurality of pre-fabricated beam rebar assemblies is positioned between each predetermined two adjacent first precast columns; and further hoisting and positioning a plurality of precast slab panels so that each of the plurality of precast slab panels is positioned between each predetermined four adjacent first precast columns, and then completing a beam rebar cage between each predetermined two adjacent precast columns;

(c) pouring concrete into molds surrounding the beam rebar cage to form a beam between each predetermined two adjacent first precast columns;

(d) end-to-end jointing each of a plurality of second precast columns that are at least one story tall respectively to each of the plurality of the first precast columns of the first precast column array respectively, wherein the first precast columns of the first precast column array positioned along the second direction at an end of the first direction are not jointed with a second precast column, so as to form a second precast column array having one fewer spans than those of the first precast column array along the first direction and having one or more spans along the second direction;

(e) proceeding with the following steps on the plurality of the second precast columns story by story from a lowest story to a highest story thereof:

(i) hoisting and positioning a plurality of pre-fabricated beam rebar assemblies so that each of the plurality of pre-fabricated beam rebar assemblies is positioned between each predetermined two adjacent second precast columns; and further hoisting and positioning a plurality of precast slab panels so that each of the plurality of precast slab panels is positioned between each predetermined four adjacent second precast columns, and completing a beam rebar cage between each predetermined two adjacent second precast columns;

(ii) pouring concrete into molds surrounding the beam rebar cage to form a beam between each predetermined two adjacent second precast columns;

(iii) repeating step (i) to step (iii) until the construction work on the structure of the highest story of the plurality of the second precast columns is completed;

(f) taking the first precast columns positioned at the end of the first direction and along the second direction as the starting points of the span along the first direction and then hoisting and positioning a plurality of first precast columns having one story to form a next first precast column array having at least one span along a first direction and having one or more spans along a second direction being substantially vertical to the first direction, and repeating step (b) to step (e) until all the first and second precast columns and the precast slab panels of the building are positioned.

13. The method of claim 12, wherein prior to that the first precast columns are hoisted and positioned to cover the whole predetermined construction area, no beam rebar cages are assembled between any two adjacent first precast columns positioned along the second direction at the end of the first direction when proceeding with step (b).

14. The method of claim 12, wherein before the second precast columns are hoisted and positioned to cover the whole predetermined construction area, no beam rebar cages are assembled between any two adjacent second precast columns positioned along the second direction at the end of the first direction when proceeding with step (b).

15. The method of claim 13, wherein when the first precast column array covers the whole predetermined area on the construction site, step (d) further comprising: end-to-end jointing additional second precast columns that are at least one story tall respectively to each first precast columns of the first precast column array respectively along the second direction at the end of the first direction.

16. The method of claim 12, wherein the cross-sections of the first precast columns and the second precast columns are both rectangular, and wherein a support portion transversely protrudes a length from circumferential surfaces under a beam-column connection section of each of the first precast columns, or from circumferential surfaces under a beam-column connection section at the lowest story of each of the second precast columns, wherein the support portion is used for supporting a portion of the precast slab panels adjacent to the corresponding first precast column or adjacent to the corresponding second precast column at the lowest story thereof, or used for supporting a portion of each of the pre-fabricated beam rebar assemblies disposed adjacent to the corresponding first precast column or disposed adjacent to the corresponding second precast column at the lowest story thereof.

17. The method of claim 16, wherein the support portion comprises a plurality of corner brackets pre-mounted to a plurality of corners of each of the first precast columns under the beam-column connection section thereof, or pre-mounted to a plurality of corners of each of the second precast columns under the beam-column connection section at the lowest story thereof, and each of the plurality of corner brackets transversely extends a length from the adjacent circumferential surfaces of the corresponding corner of each of the first precast columns or the second precast columns to support a portion of the corresponding precast slab panel or to support a portion of the corresponding pre-fabricated beam rebar assemblies.

18. The method of claim 12, wherein the cross-sections of the first precast columns and the second precast columns are both rectangular shape, the method further comprising the following step between step (i) and step (ii) or between step (ii) and step (iii):

mounting a next support portion to each of the second precast columns under the beam-column connection section of the next story of each of the second precast columns, said next support portion transversely protruding a length from circumferential surfaces of each of the second precast columns, wherein said next support portion is used for supporting a portion of each of the precast slab panels or a portion of each of the pre-fabricated beam rebar assemblies to be hoisted and positioned at the next story.

19. The method of claim 18, wherein said next support portion comprises a plurality of corner brackets pre-mounted to a plurality of corners of each of the second precast columns under a beam-column connection section of the next story thereof, wherein each of the plurality of corner brackets transversely protrudes the length from the adjacent circumferential surfaces of the corresponding corner to support a portion of the corresponding precast slab panel or support a portion of the corresponding pre-fabricated beam rebar assemblies.

20. The method of claim 12, wherein a plurality of through holes are respectively and correspondingly formed in the opposite circumferential surfaces of the predetermined two adjacent first precast columns at beam-column connection sections thereof, and a main rebar is inserted into each of the plurality of the holes formed in the surface of one of the two adjacent first precast columns wherein the main rebar extends horizontally to partially overlap with a corresponding main rebar inserted into a corresponding through hole on the opposite surface of the other one of the two adjacent first precast columns; and wherein a plurality of through holes are respectively and correspondingly formed in the opposite surfaces of the predetermined two adjacent second precast columns at beam-column connection sections thereof at the same story, and a main rebar is inserted into each of the plurality of the holes formed in the surface of one of the two adjacent second precast columns wherein the main rebar extends horizontally to partially overlap with a corresponding main rebar inserted into a corresponding through hole on the opposite surface of the other one of the two adjacent second precast columns.

21. The method of claim 20, wherein each of the pre-fabricated beam rebar assemblies is bound with some or all of the overlapping main rebars extending from the through holes of each corresponding predetermined two adjacent first precast columns for forming a part of the beam rebar cage between each corresponding predetermined two adjacent first precast columns; and wherein each of the pre-fabricated beam rebar assemblies is bound with some or all of the overlapping main rebars extending from the through holes of each corresponding predetermined two adjacent second precast columns for forming a part of the beam rebar cage between each corresponding predetermined two adjacent second precast columns.

22. The method of claim 21, wherein each side surface of each of the plurality of the precast slab panels has a plurality of side rebars protruding therefrom, and wherein the side rebars extending from the side surface of the slab panel adjacent to a corresponding two adjacent first precast columns are combined with some or all of the main rebars extending from the through holes of each of the corresponding two adjacent first precast columns for forming a part of the beam rebar cage between the corresponding two adjacent first precast columns.

23. The method of claim 21, wherein each side surface of each of the plurality of the precast slab panels has a plurality of side rebars protruding therefrom, and wherein the side rebars extending from the side surface of the slab panel adjacent to a corresponding two adjacent second precast columns are combined with some or all of the main rebars extending from the through holes of each of the corresponding two adjacent second precast columns for forming a part of the beam rebar cage between the corresponding two adjacent second precast columns.

24. The method of claim 12, wherein some or all of the plurality of slab panels are waffle slabs having a plurality of venting holes therein.

25. The method of claim 12, further comprising proceeding with step (g) after the completion of step (e) and prior to step (f), step (g) comprising end-to-end jointing each of another plurality of precast columns to each of the plurality of the second precast columns to form a jointed second precast column array, and each of the another plurality of precast columns having one or more stories; repeating step (e) to step (g) until the construction of predetermined stories of the building is completed, and then proceeding with step (f).

* * * * *